US012502577B1

(12) United States Patent
Lewis

(10) Patent No.: US 12,502,577 B1
(45) Date of Patent: Dec. 23, 2025

(54) MODULAR, ADAPTIVE, AND MULTIFUNCTIONAL FITNESS TRAINING SYSTEMS, SYSTEM COMPONENTS, AND METHODS OF MAKING AND USING THE SAME

(71) Applicant: Travis R. Lewis, Valdosta, GA (US)

(72) Inventor: Travis R. Lewis, Valdosta, GA (US)

( * ) Notice: Subject to any disclaimer, the term of this patent is extended or adjusted under 35 U.S.C. 154(b) by 0 days.

(21) Appl. No.: 19/242,940

(22) Filed: Jun. 18, 2025

Related U.S. Application Data

(60) Provisional application No. 63/688,041, filed on Aug. 28, 2024, provisional application No. 63/662,646, filed on Jun. 21, 2024.

(51) Int. Cl.
*A63B 23/04* (2006.01)
*A63B 17/04* (2006.01)
*A63B 69/00* (2006.01)

(52) U.S. Cl.
CPC ..... *A63B 23/0464* (2013.01); *A63B 17/04* (2013.01); *A63B 69/0028* (2013.01); *A63B 2209/02* (2013.01)

(58) Field of Classification Search
CPC ..... A63B 23/0464; A63B 69/0028; A63B 2209/02; A63B 3/00; A63B 17/00; A63B 17/04
See application file for complete search history.

(56) References Cited

U.S. PATENT DOCUMENTS 2,150,580 A 3/1939 Crowley
3,226,118 A * 12/1965 Nehl ..... A63B 71/00 403/402
3,345,068 A 10/1967 Bowen
6,475,116 B2 11/2002 Wu
6,955,631 B2 10/2005 Wu
7,070,541 B2 * 7/2006 Madigan ..... A63B 23/0464 434/247
8,317,661 B2 11/2012 Wright
8,574,133 B2 11/2013 Dieter
8,579,768 B2 11/2013 Prstojevich
9,039,575 B2 5/2015 Holland
9,327,154 B2 5/2016 Lin
9,675,830 B2 6/2017 Holland et al.
10,272,353 B2 * 4/2019 Oh ..... B62B 3/008
10,300,338 B2 * 5/2019 Chen ..... A63B 26/003
10,532,260 B2 * 1/2020 Del Monte ..... A63B 69/0026
11,000,749 B1 5/2021 Forney
11,890,497 B2 2/2024 Holland
12,268,944 B2 * 4/2025 Waffensmith ..... A63B 69/0026
2006/0266274 A1 * 11/2006 Kuo ..... E01F 9/688 116/63 P
2007/0135226 A1 6/2007 Henderson
(Continued)

FOREIGN PATENT DOCUMENTS

CN 112516514 A * 3/2021 ..... A63B 17/00
DE 20 2014 100 717 2/2014
KR 20220121556 9/2022

OTHER PUBLICATIONS

PCT/US2025/034281 International Search Report and Written Opinion, Oct. 7, 2025.

*Primary Examiner* — Megan Anderson

(57) ABSTRACT

Agility ladders, agility ladder components, and agility ladder kits are disclosed. Methods of making and using agility ladders, agility ladder components, and agility ladder kits are also disclosed.

23 Claims, 35 Drawing Sheets

(56) References Cited

U.S. PATENT DOCUMENTS

| | | | |
|---|---|---|---|
| 2015/0099609 | A1 | 4/2015 | White |
| 2017/0072240 | A1 | 3/2017 | Wu |
| 2021/0162252 | A1 | 6/2021 | Lin |

* cited by examiner

MODULAR, ADAPTIVE, AND MULTIFUNCTIONAL FITNESS TRAINING SYSTEMS, SYSTEM COMPONENTS, AND METHODS OF MAKING AND USING THE SAME

CROSS-REFERENCE TO RELATED APPLICATIONS

This patent application claims the benefit of priority to (1) U.S. Provisional Patent Application Ser. No. 63/688,041 filed on Aug. 28, 2024 entitled "AGILITY LADDERS, AGILITY LADDER COMPONENTS, AGILITY LADDER KITS, AND METHODS OF MAKING AND USING THE SAME," and (2) U.S. Provisional Patent Application Ser. No. 63/662,646 filed on Jun. 21, 2024 entitled "AGILITY LADDERS, AGILITY LADDER COMPONENTS, AGILITY LADDER KITS, AND METHODS OF MAKING AND USING THE SAME," the subject matter of both of which is hereby incorporated by reference in its entirety.

FIELD OF THE INVENTION

The present invention relates to exercise and training equipment, such as agility ladders, agility ladder components, and methods of making and using exercise and training equipment, such as agility ladders and agility ladder components.

BACKGROUND

There is a need in the art for exercise and training equipment, such as agility ladders and agility ladder kits, that are easy to store, assemble, and use. Efforts continue to further develop exercise and training equipment, such as agility ladders, that can assist a person's or animal's agility training.

SUMMARY OF THE INVENTION

The present invention is directed to exercise and training equipment. The exercise and training equipment may comprise agility ladders, agility ladder components, and agility ladder kits. The agility ladders, agility ladder components, and agility ladder kits provide a number of benefits over traditional agility ladders. For example, the agility ladders, agility ladder components, and agility ladder kits of the present invention can be easily assembled so as to result in a variety of agility ladder configurations, enabling a user to try a variety of agility training exercises.

The present invention is directed to exercise and training equipment in the form of agility ladders. In some embodiments of the present invention, the agility ladder comprises (i) one or more agility ladder ground strips, and (ii) one or more agility ladder strip connectors, wherein each agility ladder strip connector is capable of connecting three or more agility ladder ground strips to one another. It should be understood that the herein-described agility ladders, agility ladder ground strips, and agility ladder strip connectors, when used in exercise and training systems other than agility ladders, could be referred to simply as exercise and training equipment, exercise and training equipment strips (or sticks), and exercise and training equipment strip (or stick) connectors. Consequently, throughout the present specification and claims, exercise and training equipment may be used instead of agility ladders, exercise and training equipment strips (or sticks) may be used instead of agility ladder ground strips, and exercise and training equipment strip (or stick) connectors may be used instead of agility ladder strip connectors.

The present invention is further directed to exercise and training system components or agility ladder components such as agility ladder ground strips, and agility ladder strip connectors. In some embodiments of the present invention, the exercise and training system component or agility ladder component comprises an agility ladder ground strip, wherein the agility ladder ground strip comprises an upper strip major surface, a lower strip major surface opposite the upper strip major surface, opposite strip ends separated by a strip length Ls, and opposite strip side edges separated by a strip width Ws, wherein each of the opposite strip side edges comprises alternating edge hills and edge valleys such that the strip width Ws varies along the strip length Ls. In some embodiments, the opposite strip side edges comprise a wavy edge configuration with alternating edge hills and edge valleys such that the strip width Ws alternates from (i) a larger strip width $Ws_L$ to (ii) a smaller strip width $Ws_S$ to (iii) the larger strip width $Ws_L$ to (iv) the smaller strip width $Ws_S$, etc. along the strip length Ls.

In some embodiments of the present invention, the exercise and training system component or agility ladder component comprises an agility ladder ground strip, wherein the agility ladder ground strip comprises opposite strip side edges having a straight, parallel configuration such that the strip width Ws is substantially constant or constant along at least a portion of the strip length Ls. In some embodiments wherein opposite strip side edges have a straight, parallel configuration, the strip width Ws is substantially constant or constant along a majority of the strip length Ls (i.e., greater than 50% of the strip length Ls). In some embodiments wherein opposite strip side edges have a straight, parallel configuration, the strip width Ws is substantially constant or constant along all of the strip length Ls (i.e., 100% of the strip length Ls).

In some embodiments of the present invention, the agility ladder ground strip has (i) opposite strip side edge features that extend along at least a portion of the strip length Ls (or all of the strip length Ls), and/or (ii) upper strip edge features that extend along at least a portion of the strip length Ls (or all of the strip length Ls), and/or (iii) lower strip edge features that extend along at least a portion of the strip length Ls (or all of the strip length Ls), wherein each of (i) the opposite strip side edge features, (ii) the upper strip edge features, and (iii) the lower strip edge features, when present, (a) provides one or more connector surface contact points along at least a portion of the strip length Ls (or all of the strip length Ls), and (b) have some amount of curvature therein, for example, curvature extending along a side edge or both side edges, such as a wavy edge configuration or the curved profile configuration, or extending along upper/lower surfaces, as discussed below. As discussed herein, in some embodiments, the opposite strip side edge features comprise a straight, parallel configuration of side edges, each side edge having a curved profile, wherein the opposite strip side edges with curved profile provide a majority of connector surface contact points along at least a portion of the strip length Ls (or all of the strip length Ls).

In some embodiments of the present invention, the exercise and training system component or agility ladder component comprises an agility ladder strip connector, wherein the agility ladder strip connector comprises (i) an upper connector major surface, (ii) a lower connector major surface opposite the upper connector major surface, (iii) opposite connector ends separated by a connector length Lc, (iv)

a first connector side edge extending between the opposite connector ends, (v) a second connector side edge opposite the first connector side edge, and being separated from the first connector side edge by a connector width Wc, (vi) a strip receiving opening within each of the opposite connector ends with each strip receiving opening sized to receive a strip end of a given agility ladder ground strip, and (vii) a connector channel extending from the first connector side edge to the second connector side edge. In some embodiments, the agility ladder strip connector comprises (i) a strip end stop within each of the strip receiving openings so that a given agility ladder ground strip extends a desired length into a given strip receiving opening, and/or (ii) one or more strip engagement members within the connector channel so as to engage with a given agility ladder ground strip extending through the connector channel.

In some embodiments, agility ladder strip connectors of the present invention comprise (i) an upper connector major surface, (ii) a lower connector major surface opposite the upper connector major surface, (iii) opposite connector ends separated by a connector length Lc, (iv) a first connector side edge extending between the opposite connector ends, (v) a second connector side edge opposite the first connector side edge, and being separated from the first connector side edge by a connector width Wc, (vi) a strip receiving opening within each of the opposite connector ends with each strip receiving opening sized to receive a strip end of a given agility ladder ground strip, and (vii) a width-extending connector channel extending from the first connector side edge to the second connector side edge, wherein each strip receiving opening connects with a corresponding strip receiving opening to form a length-extending connector channel extending from a first connector end of the opposite connector ends to a second connector end of the opposite connector ends.

In other embodiments, agility ladder strip connectors are positioned along outer side edges and/or one or more end edges of an agility ladder ground strip. In these embodiments, a given agility ladder ground strip of the present invention comprises an upper strip major surface, a lower strip major surface opposite the upper strip major surface, opposite strip ends separated by a strip length Ls, and opposite strip side edges separated by a strip width Ws, wherein each of the opposite strip side edges comprises one or more agility ladder strip connectors extending thereon, each agility ladder strip connector being capable of connecting to two or more additional agility ladder ground strips 10'.

The present invention is also directed to methods of making exercise and training systems and components such as agility ladders, agility ladder components, and agility ladder kits. In some embodiments of the present invention, the method of making an exercise and training system component or agility ladder component comprises forming an agility ladder ground strip, wherein the agility ladder ground strip comprises an upper strip major surface, a lower strip major surface opposite the upper strip major surface, opposite strip ends separated by a strip length Ls, and opposite strip side edges separated by a strip width Ws, wherein each of the opposite strip side edges comprises alternating edge hills and edge valleys such that the strip width Ws varies along the strip length Ls. The forming step may comprise a thermoforming step (e.g., a molding step) to form the agility ladder ground strip from a polymeric material, such as a polypropylene.

The present invention is further directed to methods of using exercise and training systems and components such as agility ladders, agility ladder components, and agility ladder kits. In some embodiments of the present invention, the method of using exercise and training systems or agility ladders, agility ladder components, and/or agility ladder kits comprises connecting (i) one or more of the herein-described agility ladder ground strips, and (ii) one or more of the herein-described agility ladder strip connectors to one another to form an agility ladder configuration.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

The features of the present agility ladders, agility ladder components, and agility ladder kits, and methods are set forth in part in the following preferred embodiments. This overview is intended to provide nonlimiting descriptions of the present subject matter and is not intended to provide an exclusive or exhaustive explanation. The preferred embodiments below provide further information about the agility ladders, agility ladder components, and agility ladder kits, and methods of the present invention as described herein.

DETAILED DESCRIPTION OF THE INVENTION

The present invention relates to agility ladders, agility ladder components, and agility ladder kits. Exemplary agility ladders, agility ladder components, and agility ladder kits are shown, for example, in FIGS. 1-43J.

As shown in FIGS. 1-43J, exemplary agility ladders 100, agility ladder components 10/10'/20/20'/30/30', and agility ladder kits 200 of the present invention may comprise a number of components including, but not limited to, (i) one or more agility ladder ground strips 10/10', and (ii) one or more agility ladder strip connectors 20/20', wherein each agility ladder strip connector 20/20' is capable of connecting three or more agility ladder ground strips 10/10' to one another. It should be noted that agility ladder ground strips 10/10' may also be referred to as agility ladder ground sticks 10/10'.

Figure 1:
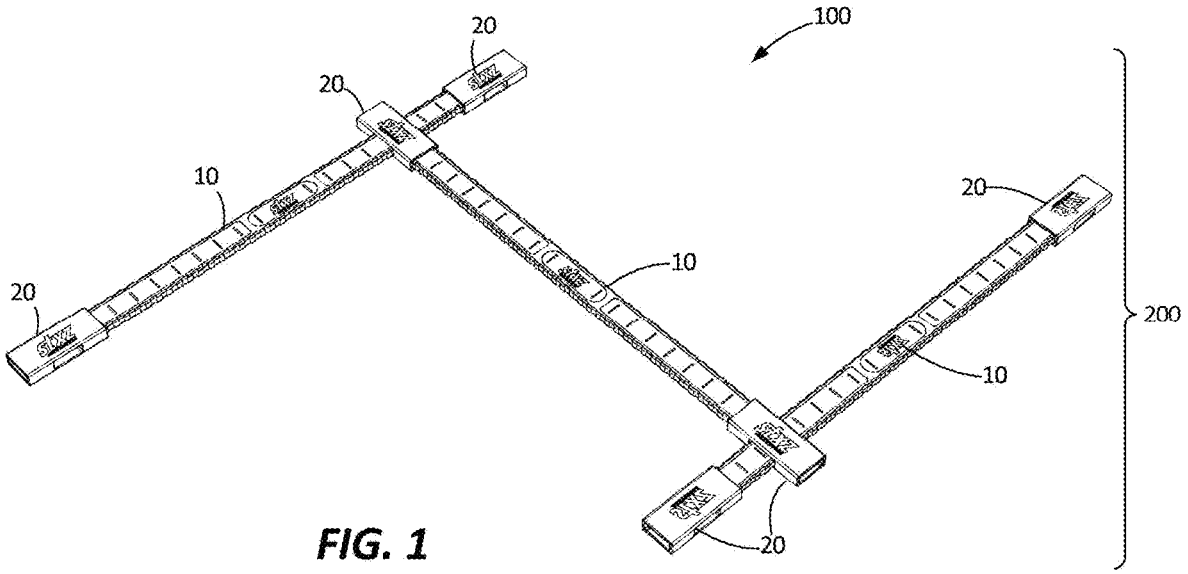
FIG. 1 is a perspective view of an exemplary agility ladder of the present invention.
Figure 2:
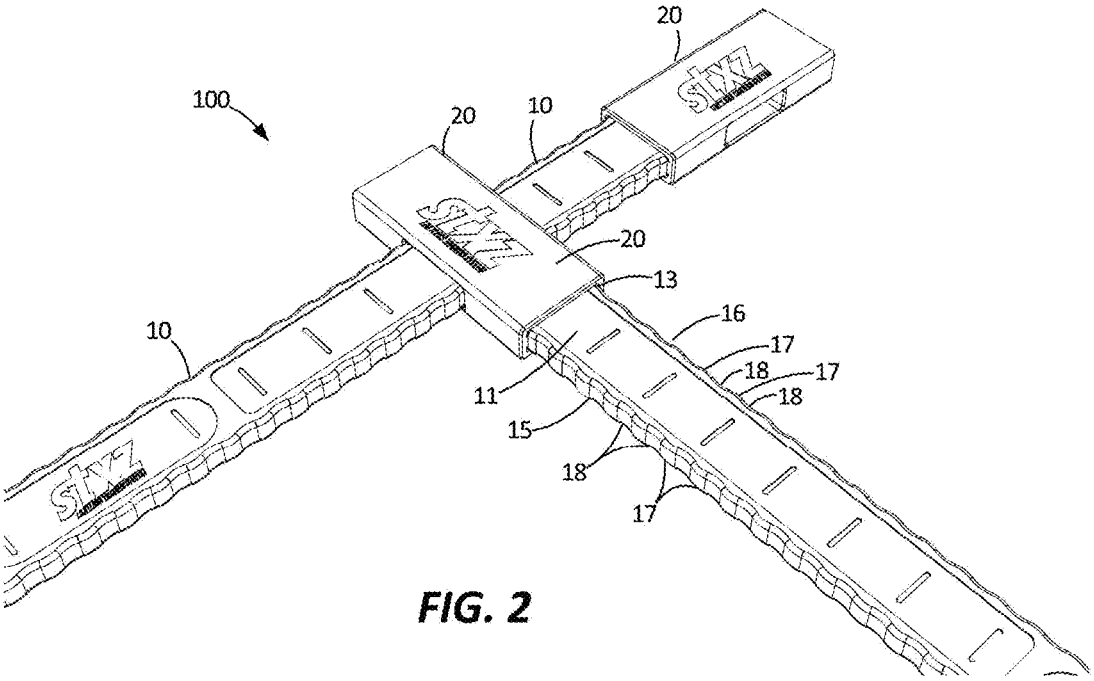
FIG. 2 is a close-up view of a junction within the exemplary agility ladder shown in FIG. 1.
Figure 3:
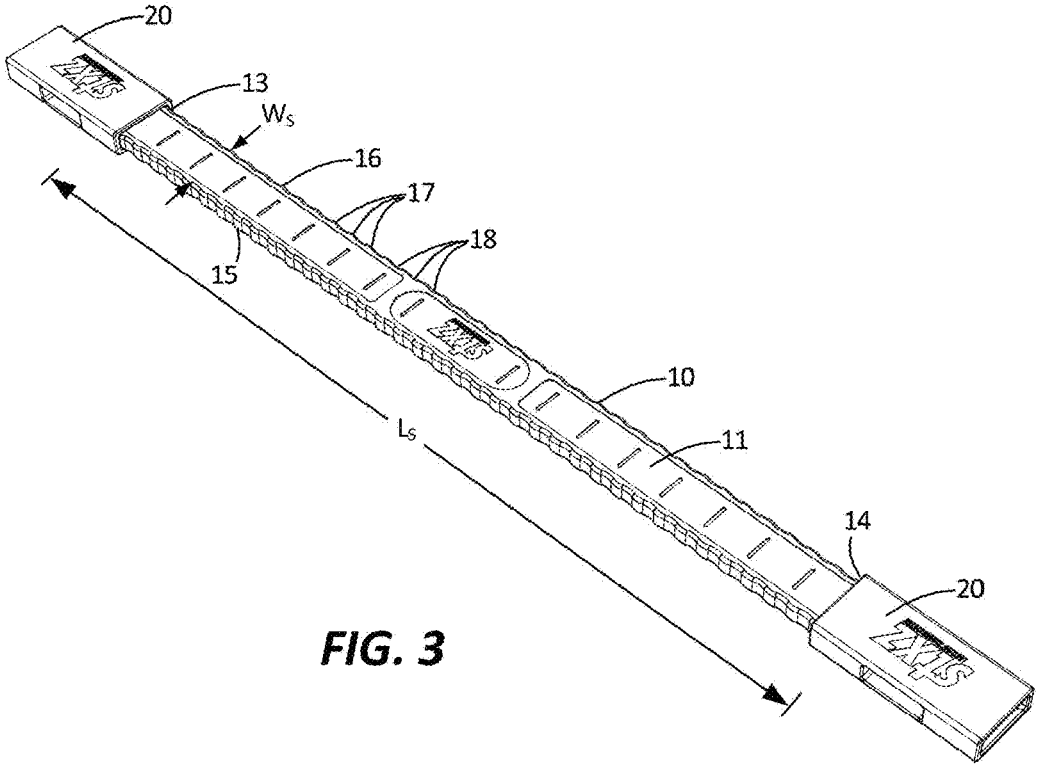
FIG. 3 is a perspective view of exemplary agility ladder components of the present invention, namely, a single agility ladder ground strip with agility ladder strip connectors on each end of the single agility ladder ground strip.
Figure 4:
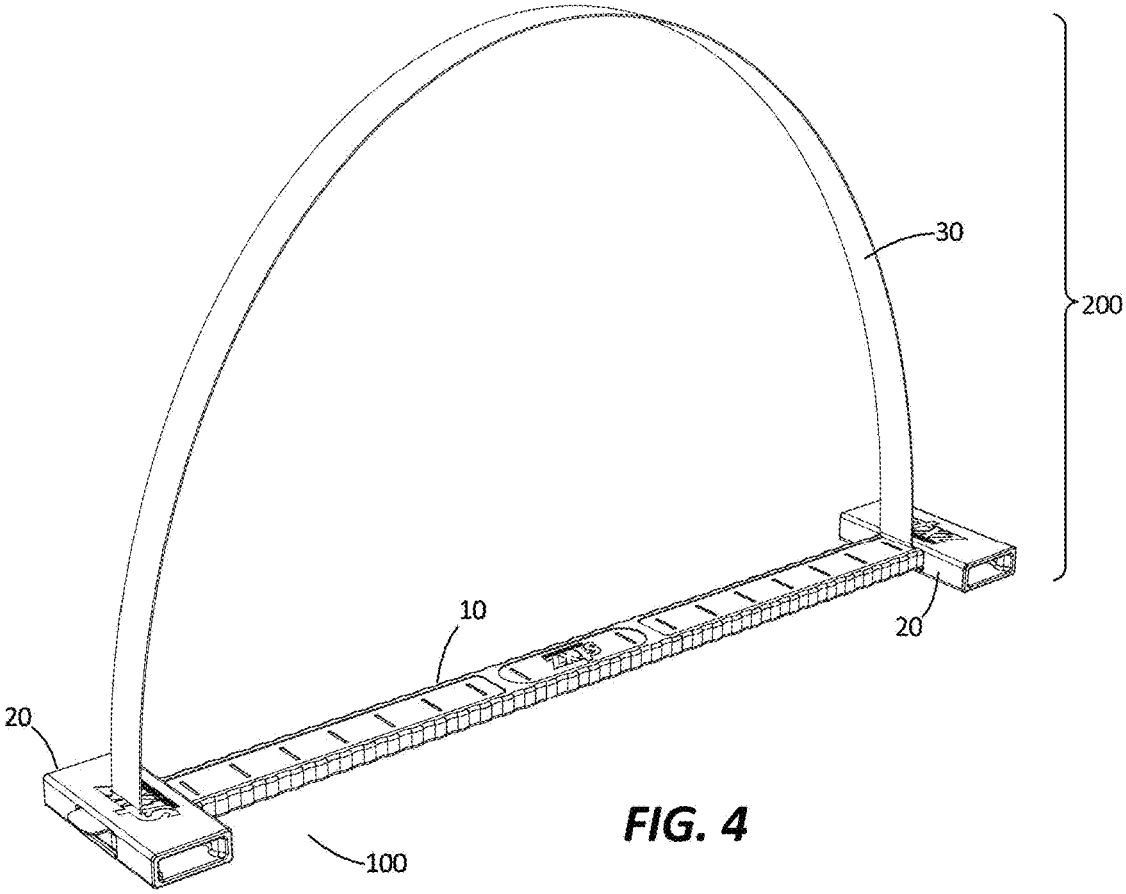
FIG. 4 is a perspective view of exemplary agility ladder components of the present invention, namely, (i) a single agility ladder ground strip with (ii) agility ladder strip connectors on each end of the single agility ladder ground strip, and (iii) a hurdle strip component extending from one agility ladder strip connector to the other agility ladder strip connector above the single agility ladder ground strip.

As shown in FIG. 4, in some embodiments, exemplary agility ladders 100, agility ladder components 10/20/30, and agility ladder kits 200 of the present invention may comprise a hurdle strip component 30 extending from one agility ladder strip connector 20 to another agility ladder strip connector 20 above an agility ladder ground strip 10.

As shown in FIGS. 3, 5A-7C, and 36-38A, in some embodiments, agility ladder ground strips 10/10' of the present invention may comprise an upper strip major surface 11, a lower strip major surface 12 opposite the upper strip major surface 11, opposite strip ends 13/14 separated by a strip length Ls, and opposite strip side edges 15/16 separated by a strip width Ws. As shown in FIGS. 3, and 5A-7C, in some embodiments, each of the opposite strip side edges 15/16 comprises alternating edge hills 17 and edge valleys 18 such that the strip width Ws varies along the strip length Ls. The alternating edge hills 17 and edge valleys 18 may be along one or more portions of the strip length Ls, or along a complete length of the strip length Ls.

In some embodiments, agility ladder ground strips 10 of the present invention comprise opposite strip side edges 15/16 having a wavy edge configuration with alternating edge hills 17 and edge valleys 18 such that the strip width Ws alternates from (i) a larger strip width $Ws_L$ to (ii) a smaller strip width $Ws_S$ to (iii) the larger strip width $Ws_L$ to (iv) the smaller strip width $Ws_S$, etc. along the strip length Ls. See again, for example, FIGS. 5B and 7A.

Figure 5A:
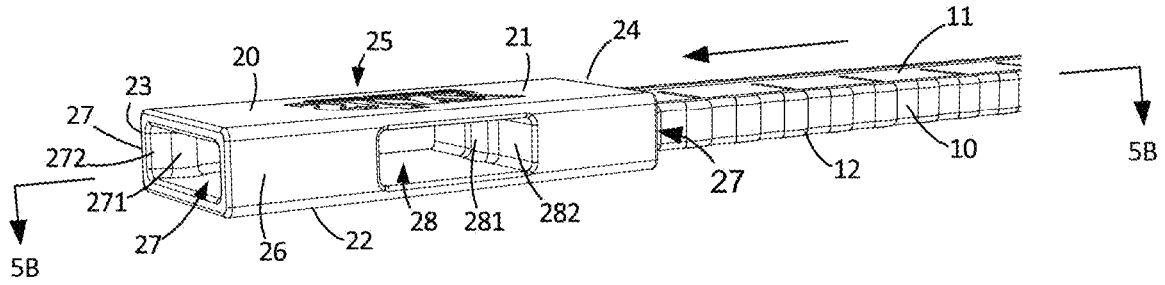
FIG. 5A is a close-up view of an exemplary agility ladder strip connector of the present invention with as agility ladder ground strip connected thereto.
Figure 5B:
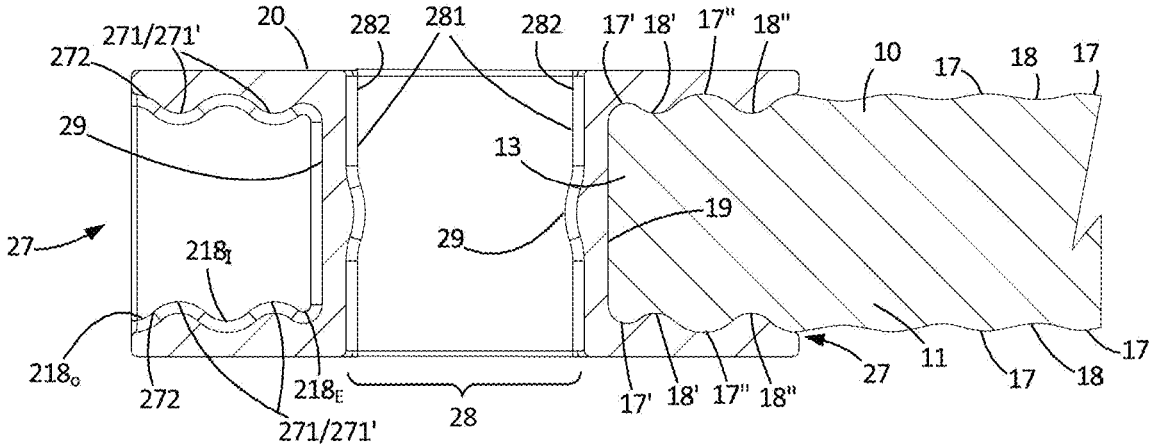
FIG. 5B is a cross-sectional view of the exemplary agility ladder strip connector shown in FIG. 5A as viewed along line 5B-5B in FIG. 5A showing (i) an exemplary strip end of an exemplary agility ladder ground strip positioned within (ii) an exemplary strip receiving opening of the exemplary agility ladder strip connector.
Figure 6A:
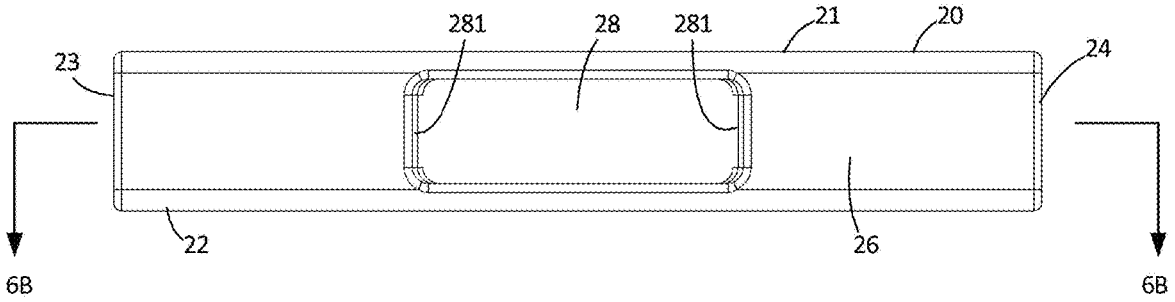
FIG. 6A is a side view of the exemplary agility ladder strip connector shown in FIG. 5A without the agility ladder ground strip.
Figure 6B:
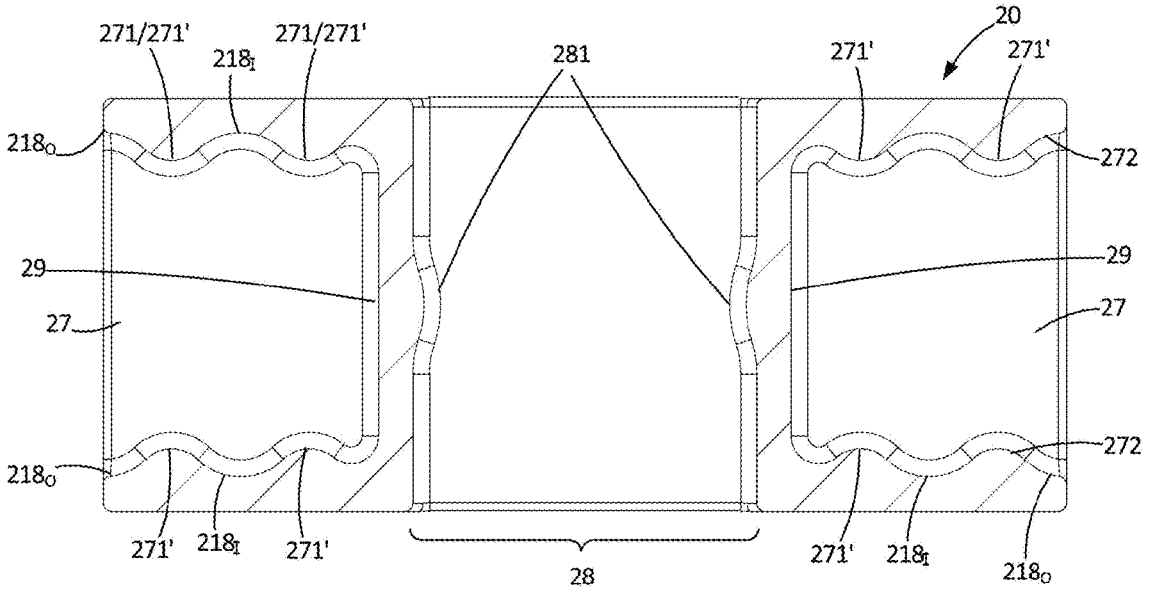
FIG. 6B is a cross-sectional view of the exemplary agility ladder strip connector shown in FIG. 6A as viewed along line 6B-6B in FIG. 6A.
Figure 7A:
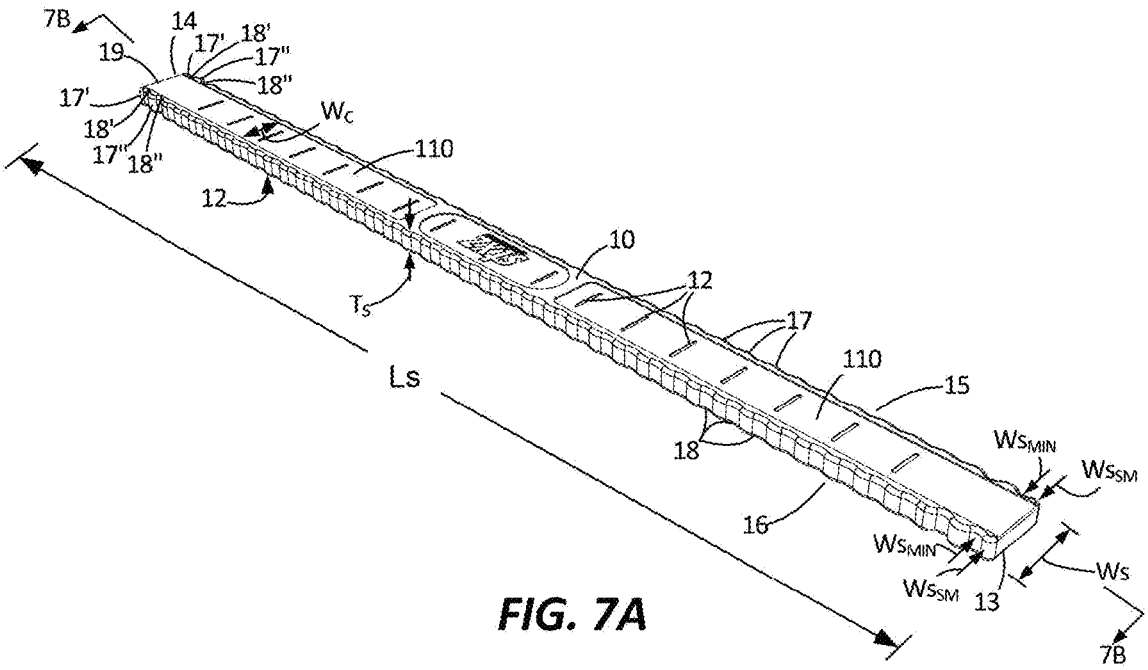
FIG. 7A is a perspective view of an exemplary agility ladder ground strip suitable for use in the agility ladders and agility ladder kits of the present invention.
Figure 7B:
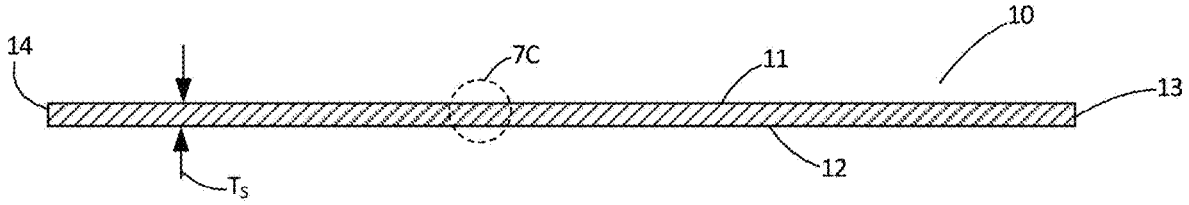
FIG. 7B is a cross-sectional view of the exemplary agility ladder ground strip shown in FIG. 7A as viewed along line 7B-7B in FIG. 7A.

As further shown in FIGS. 5B and 7A, in some embodiments, opposite strip ends 13/14 of a given agility ladder ground strip 10/10' may comprise alternating edge hills 17 and edge valleys 18, as discussed above, and also comprise a relatively straight end edge 19 bound by strip end edge hills 17'. As one moves away from relatively straight end edge 19 along opposite strip side edges 15/16, each strip end edge hill 17' is followed by a first edge valley 18' and then a second strip edge hill 17", followed by a second edge valley 18', and so on. In this embodiment, exemplary agility ladder ground strip 10/10' has an overall strip width Ws that becomes smaller towards each strip end 13/14 (i.e., towards relatively straight end edge 19). Exemplary agility ladder ground strip 10/10' has a minimum strip width $Ws_{MIN}$ across exemplary agility ladder ground strip 10/10' at corresponding first edge valleys 18', and typically the strip width Ws is slightly greater across exemplary agility ladder ground strip 10/10' at corresponding second edge valleys 18". Typically, the strip width Ws across exemplary agility ladder ground strip 10/10' at the remaining corresponding edge valley 18, along the strip length Ls is greater than (i) the minimum strip width $Ws_{MIN}$ across exemplary agility ladder ground strip 10/10' at corresponding first edge valleys 18', and (ii) the strip width Ws across exemplary agility ladder ground strip 10 at corresponding second edge valleys 18". See again, FIGS. 5B and 7A.

As shown in FIGS. 36-38A, in some embodiments, agility ladder ground strips 10 of the present invention comprise opposite strip side edges 15/16 having a straight, parallel configuration such that the strip width Ws is substantially constant or constant along at least a portion of the strip length Ls. As used herein, the term "substantially constant" means that the strip width Ws may vary plus or minus up to 0.125 inch (in)(3.17 mm), more desirably, less than 0.063 in (1.59 mm) from a desired strip width Ws (e.g., a strip width Ws of 2.00 in). Typically, in embodiments wherein opposite strip side edges 15/16 have a straight, parallel configuration, the strip width Ws is substantially constant or constant along a majority of the strip length Ls (i.e., greater than 50% of the strip length Ls). See again, for example, FIGS. 36 and 38A. In some embodiments wherein opposite strip side edges 15/16 have a straight, parallel configuration, the strip width Ws is substantially constant or constant along all of the strip length Ls (i.e., 100% of the strip length Ls). See again, for example, FIG. 36.

As further shown in FIGS. 3, 5A-7C, and 36-38A, the agility ladder ground strips 10 of the present invention may comprise a variety of overall shapes and cross-sectional configurations. Each independent overall shape provides one or more connecting properties (e.g., strip contact points 102 that come into contact with corresponding contact points 272' or 282' of a given connector 20) for a given agility ladder ground strip 10/10'. Each independent cross-sectional configuration provides one or more strip properties such as overall strip weight, strip rigidity, strip resiliency, etc. to a given agility ladder ground strip 10/10'. As shown, for example, in FIGS. 5A-6B, and 39-43J, for each independent overall shape and cross-sectional configuration of a given agility ladder ground strip 10/10', the present invention further comprises an agility ladder strip connector 20 that is connectable with three of more agility ladder strips 10 (i.e., provides contact points 272' or 282' of given connector 20 for contact with strip contact points 102 of three of more agility ladder strips 10).

As shown in FIGS. 5A-6B, and 39-43J, in some embodiments, agility ladder strip connectors 20 of the present invention may comprise (i) an upper connector major surface 21, (ii) a lower connector major surface 22 opposite the upper connector major surface 21, (iii) opposite connector ends 23/24 separated by a connector length Lc, (iv) a first connector side edge 25 extending between the opposite connector ends 23/24, (v) a second connector side edge 26 opposite the first connector side edge 23/24, and being separated from the first connector side edge 25 by a connector width Wc, (vi) a strip receiving opening 27 within each of the opposite connector ends 23/24 with each strip receiving opening 27 sized to receive a strip end 13/14 of a given agility ladder ground strip 10/10', and (vii) a connector channel 28 extending from the first connector side edge 25 to the second connector side edge 26.

In some embodiments, the agility ladder strip connector comprises (i) a strip end stop 29 within each of the strip receiving openings 27 so that a given agility ladder ground strip end 13/14 extends a desired length into a given strip receiving opening 27, and/or (ii) one or more opening strip engagement members 271 within each strip receiving opening 27 so as to engage with strip end 13/14 of a given agility ladder ground strip 10/10' extending into a given strip receiving opening 27, and/or (iii) one or more channel strip engagement members 281 within the connector channel 28 so as to engage with opposite strip side edges 15/16 of a given agility ladder ground strip 10/10' extending through the connector channel 28. See again, FIGS. 5A-6B.

As shown in FIGS. 39-43J, in some embodiments, agility ladder strip connectors 20 of the present invention may comprise (i) an upper connector major surface 21, (ii) a lower connector major surface 22 opposite the upper connector major surface 21, (iii) opposite connector ends 23/24 separated by a connector length Lc, (iv) a first connector side edge 25 extending between the opposite connector ends 23/24, (v) a second connector side edge 26 opposite the first connector side edge 23/24, and being separated from the first connector side edge 25 by a connector width Wc, (vi) a strip receiving opening 27 within each of the opposite connector ends 23/24 with each strip receiving opening 27 sized to receive a strip end 13/14 of a given agility ladder ground strip 10/10', and (vii) a width-extending connector channel 28 extending from the first connector side edge 25 to the second connector side edge 26, wherein each strip receiving opening 27 connects with a corresponding strip receiving opening 27 to form a length-extending connector channel 270 extending from a first connector end 23 of said opposite connector ends 23/24 to a second connector end 24 of said opposite connector ends 23/24.

As shown in FIGS. 10A-10F, exemplary agility ladder strip connectors 20 may comprise (i) multiple strip receiving openings 27, and/or (ii) multiple connector channels 28 extending from the first connector side edge 25 to the second connector side edge 26. Typically, agility ladder strip connectors 20 of the present invention comprise (i) from two to about twelve (12) strip receiving openings 27, more typically, from about two to six strip receiving openings 27, and (ii) one to about five connector channels 28 extending from the first connector side edge 25 to the second connector side edge 26. Such agility ladder strip connectors 20 are capable of connecting up to about a dozen agility ladder ground strips 10/10' to one another to form an agility ladder 100 configuration.

In addition, it should be noted that although all of (A) the strip receiving openings 27, and (B) the one or more connector channels 28 are shown oriented perpendicularly to one another, the strip receiving openings 27 may be oriented relative to the one or more connector channels 28 at an angle other than 90 degrees (°). For example, strip receiving openings 27 could be oriented relative to the one or more connector channels 28 at an angle ranging from about 45° to about 135°, or any angle therebetween.

As shown in FIGS. 13A-16, in some embodiments, agility ladder strip connectors 20' are positioned along outer edges 15/16 of a given agility ladder ground strip 10'. In these embodiments, agility ladder ground strip 10' comprises an upper strip major surface 11, a lower strip major surface 12 opposite the upper strip major surface 11, opposite strip ends 13/14 separated by a strip length Ls, and opposite strip side edges 15/16 separated by a strip width Ws, wherein each of the opposite strip side edges 15/16 comprises one or more agility ladder strip connectors 20' extending thereon, each agility ladder strip connector 20' being capable of connecting to two or more additional agility ladder ground strips 10'.

A variety of agility ladders 100, agility ladder components 10/10'/20/20'/30/30', and agility ladder kits 200, methods of making agility ladders 100, agility ladder components 10/10'/20/20'/30/30', and agility ladder kits 200, and methods of using agility ladders 100, agility ladder components 10/10'/20/20'/30/30', and agility ladder kits 200 are further described below in the following additional embodiments.

ADDITIONAL EMBODIMENTS

Agility Ladders

1. An agility ladder 100 comprising: one or more agility ladder ground strips 10/10', and one or more agility ladder strip connectors 20/20', wherein each agility ladder strip connector 20/20' is capable of connecting three or more agility ladder ground strips 10/10' to one another, wherein the one or more agility ladder ground strips 10/10' are connected to the one or more agility ladder strip connectors 20/20' to form an agility ladder 100 configuration. See, for example, the exemplary agility ladder 100 configurations shown in FIGS. 1-5B, 12A-12F, 14A-14B, and 36-40

2. The agility ladder 100 of embodiment 1, wherein the agility ladder 100 configuration comprises a straight line of three or more agility ladder ground strips 10/10', and two or more agility ladder strip connectors 20/20'.

3. The agility ladder 100 of embodiment 1 or 2, wherein the agility ladder 100 configuration comprises a zig-zag shaped line of three or more agility ladder ground strips 10/10', and two or more agility ladder strip connectors 20/20'.

4. The agility ladder 100 of any one of embodiments 1 to 3, wherein the agility ladder 100 configuration comprises two or more parallel lines with each line comprising three or more agility ladder ground strips 10/10', and two or more agility ladder strip connectors 20/20'.

5. The agility ladder 100 of any one of embodiments 1 to 4, wherein the agility ladder 100 configuration comprises three or more parallel lines with each line comprising three or more agility ladder ground strips 10/10', and two or more agility ladder strip connectors 20/20'. It should be understood that any number of parallel lines could be formed (e.g., from 3 to 50 parallel lines) using any number of agility ladder ground strips 10/10' (e.g., from 6 to 500 agility ladder ground strips 10/10'), and any number of agility ladder strip connectors 20/20' (e.g., from 2 to 500 agility ladder strip connectors 20/20').

6. The agility ladder 100 of any one of embodiments 1 to 5, wherein the agility ladder 100 configuration comprises a grid of agility ladder ground strips 10/10', and agility ladder strip connectors 20/20', and the grid comprises two or more rows and one or more columns.

7. The agility ladder 100 of any one of embodiments 1 to 6, wherein the agility ladder 100 configuration comprises a grid of agility ladder ground strips 10/10', and agility ladder strip connectors 20/20', and the grid comprises two or more rows and two or more columns. It should be understood that any number of rows (e.g., from 2 to 50 rows) and any number of columns (e.g., from 2 to 50 columns) can be formed using any number of agility ladder ground strips 10/10' (e.g., from 6 to 500 agility ladder ground strips 10/10'), and any number of agility ladder strip connectors 20/20' (e.g., from 2 to 1000 agility ladder strip connectors 20/20').

8. The agility ladder 100 of any one of embodiments 1 to 7, wherein the agility ladder 100 configuration comprises from 6 to 500 agility ladder ground strips 10/10', and from 2 to 1000 agility ladder strip connectors 20/20'.

9. The agility ladder 100 of any one of embodiments 1 to 8, wherein each of the one or more agility ladder ground strips 10 comprises an upper strip major surface 11, a lower strip major surface 12 opposite the upper strip major surface 11, opposite strip ends 13/14 separated by a strip length Ls, and opposite strip side edges 15/16 separated by a strip width Ws.

10. The agility ladder 100 of any one of embodiments 1 to 9, wherein at least one of (i) upper strip edge features along the upper strip major surface 11, (ii) lower strip edge features along the lower strip major surface 12, and (iii) opposite strip side edge features along the opposite strip side edges 15/16, when present, (a) extends along at least a portion of the strip length Ls (or all of the strip length Ls), and (b) has (i) some amount of curvature therein (e.g., curvature extending along and within a side edge, such as the wavy edge configuration or the curved profile configuration, or extending along upper and/or lower surfaces, such as the opposing curved profiles along the upper and/or lower surfaces discussed below in references to FIGS. 36-38A), and/or (ii) a combination of the upper strip major surface 11, the lower strip major surface 12, and the opposite strip side edges 15/16 either (a) separated from one another by angles other than 90° (see, FIGS. 37A and 37D), or (b) separated from one another by more than four 90° angles (see, FIG. 37E, which depicts a cross-sectional configuration with 12 90° angles therein). The (i) upper strip edge features along the upper strip major surface 11, (ii) lower strip edge features along the lower strip major surface 12, and/or (iii) opposite strip side edge features along the opposite strip side edges 15/16, when present, may also provide one or more connector channel surface contact points 102 along at least a portion of the strip length Ls (or all of the strip length Ls)(i.e., points that contact surfaces 272' and 282', discussed below, within channel 28 or channel 270).

11. The agility ladder 100 of any one of embodiments 1 to 10, wherein opposite strip side edge features along the opposite strip side edges 15/16 are present, and (a) extend along at least a portion of the strip length Ls (or all of the strip length Ls), and (b) have (i) some amount of curvature therein (e.g., curvature extending along and within a side edge, such as the wavy edge configuration or the curved profile configuration, or extending along upper and/or lower surfaces, such as the opposing curved profiles along the upper and/or lower surfaces discussed below in references to FIGS. 36-38A).

12. The agility ladder 100 of any one of embodiments 9 to 11, wherein each of the opposite strip side edges 15/16 comprises alternating edge hills 17 and edge valleys 18 such that the strip width Ws varies along the strip length Ls.

13. The agility ladder 100 of any one of embodiments 9 to 12, wherein the opposite strip side edges 15/16 comprise a wavy edge configuration with alternating edge hills 17 and edge valleys 18 such that the strip width Ws alternates from (i) a larger strip width $Ws_L$ to (ii) a smaller strip width $Ws_S$ to (iii) the larger strip width $Ws_L$ to (iv) the smaller strip width $Ws_S$, etc. along the strip length Ls. See again, for example, FIGS. 5B and 7A. It should be noted that the herein described "wavy edge configuration" with alternating edge hills 17 and edge valleys 18 along the strip length Ls is one preferred configuration for opposite strip side edges 15/16. However, other possible configurations for opposite strip side edges 15/16 could be used instead. For example, opposite strip side edges 15/16 could have a saw-tooth configuration with triangular shaped alternating edge hills 17 and edge valleys 18 instead of the smooth curves of the alternating edge hills 17 and edge valleys 18 as shown, for example, in FIG. 5B. Other alternating edge hills 17 and edge valleys 18" shapes/configurations including, but not limited to, those shown in FIGS. 17A-17D, could be used in the present invention. In yet further possible configurations, opposite strip side edges 15/16 could have a straight, parallel configuration such that the strip width Ws is substantially constant or constant along the strip length Ls. See, for example, exemplary agility ladder ground strip 10 shown in FIG. 36.

14. The agility ladder 100 of any one of embodiments 9 to 12, wherein the opposite strip side edges 15/16 comprise a saw-tooth configuration with triangular shaped alternating edge hills 17 and edge valleys 18 such that the strip width Ws alternates from (i) a larger strip width $Ws_L$ to (ii) a smaller strip width $Ws_S$ to (iii) the larger strip width $Ws_L$ to (iv) the smaller strip width $Ws_S$, etc. along the strip length Ls. See, for example, in FIG. 17A.

15. The agility ladder 100 of any one of embodiments 12 to 14, wherein the alternating edge hills 17 and edge valleys 18 extend along one or more portions of each of the opposite strip side edges 15/16.

16. The agility ladder 100 of any one of embodiments 12 to 15, wherein the alternating edge hills 17 and edge valleys 18 extend along a complete length Ls of each of the opposite strip side edges 15/16.

17. The agility ladder 100 of any one of embodiments 12 to 16, wherein each of the one or more agility ladder ground strips 10 has an overall strip width Ws that becomes smaller towards each strip end 13/14 (i.e., towards end edge 19). For example, one agility ladder ground strip 10 might have an overall strip width Ws (as measured along the alternating edge hills 17) of about 3.17 centimeters (cm) (1.25 inches (in)), and an overall strip width Ws at strip end 13/14 (i.e., along end edge 19) of about 2.67 cm (1.05 in). See, for example, exemplary agility ladder ground strip 10 shown in FIG. 7A.

18. The agility ladder 100 of any one of embodiments 9 to 17, wherein each of the one or more agility ladder ground strips 10 further comprise opposite strip side edges 15/16 extending from an end edge 19 at opposite strip ends 13/14 that each comprise (i) a first strip end edge hill 17' adjacent the end edge 19, followed by a first edge valley 18' and then a second strip edge hill 17", followed by a second edge valley 18', and then alternating edge hills 17 and edge valleys 18 (as discussed above) to a midpoint along the strip length Ls of a given agility ladder ground strip 10.

19. The agility ladder 100 of embodiment 18, wherein each of the one or more agility ladder ground strips 10 has a minimum strip width $Ws_{MIN}$ between opposite side edges 13/14 at opposing first edge valleys 18' (i.e., at a position along a given agility ladder ground strip 10 that is separated from end edge 19 by first strip end edge hill 17'). For example, a given agility ladder ground strip 10 might have an overall strip width Ws (as measured along the alternating edge hills 17) of about 3.7 cm (1.25 in), an overall strip width Ws at strip end 13/14 (i.e., along end edge 19) of about 2.67 cm (1.05 in), and a minimum strip width $Ws_{MIN}$ between opposite side edges 15/16 at opposing first edge valleys 18' of about 2.60 cm (1.02 in).

20. The agility ladder 100 of embodiment 18 or 19, wherein each of the one or more agility ladder ground strips 10 has a strip width $Ws_{SM}$ between opposite side edges 13/14 at opposing first edge hills 17' (i.e., at a position along a given agility ladder ground strip 10 adjacent end edge 19) that represents a smallest strip width $Ws_{SM}$ between any two opposing first edge hills 17' along opposite side edges 13/14. For example, a given agility ladder ground strip 10 might have an overall strip width Ws (as measured along the alternating edge hills 17) of about 3.17 cm (1.25 in), an overall strip width Ws at strip end 13/14 (i.e., along end edge 19) of about 2.67 cm (1.05 in), a minimum strip width $Ws_{MIN}$ between opposite side edges 13/14 at opposing first edge valleys 18' of about 2.60 cm (1.02 in) and typically the strip width Ws is slightly greater across exemplary agility ladder ground strip 10 at corresponding second edge valleys 18", and a strip width $Ws_{SM}$ between opposite side edges 13/14 at opposing first edge hills 17' of about 2.63 cm (1.035 in). See again, FIGS. 5B and 7A.

21. The agility ladder 100 of any one of embodiments 1 to 9, wherein each of the one or more agility ladder ground strips 10' comprises an upper strip major surface 11, a lower strip major surface 12 opposite the upper strip major surface 11, opposite strip ends 13/14 separated by a strip length Ls, and opposite strip side edges 15/16 separated by a strip width Ws, wherein each of the opposite strip side edges 15/16 comprises one or more agility ladder strip connectors 20' extending thereon, each agility ladder strip connector 20' being capable of connecting to two or more additional agility ladder ground strips 10'.

22. The agility ladder 100 of embodiment 21, wherein the one or more agility ladder strip connectors 20' extend along one or more portions of each of the opposite strip side edges 15/16.

23. The agility ladder 100 of embodiment 21 or 22, wherein the one or more agility ladder strip connectors 20' extend along a complete length Ls of the opposite strip side edges 15/16.

24. The agility ladder 100 of any one of embodiments 21 to 23, wherein the one or more agility ladder strip connectors 20' extend along at least one of strip ends 13/14.

25. The agility ladder 100 of any one of embodiments 21 to 24, wherein the one or more agility ladder strip connectors 20' extend along both of strip ends 13/14.

26. The agility ladder 100 of any one of embodiments 21 to 24, wherein the agility ladder ground strip 10' further comprises a connecting member 130 at one of strip ends 13/14.

27. The agility ladder 100 of any one of embodiments 21 to 24 and 26, wherein the agility ladder ground strip 10' further comprises a connecting member 130 at one of strip ends 13/14, the connecting member 130 comprising (i) a connecting member base 131, and (ii) a male or female connecting end 132 extending from the connecting member base 131. See, for example, FIG. 13A. As used herein, the terms "male" and "female" connecting end or "male" and "female" connector components refers to a connecting end or connector component that either comprises (1) a connecting component (i.e., a male connection component) that extends outward and is shaped to be received by a corresponding connecting component, or (2) a connecting component (i.e., a female connection component) that is designed to receive a corresponding connecting member that extends outward from an object, such as connecting member base 131.

28. The agility ladder 100 of any one of embodiments 21 to 24 and 26 to 27, wherein the agility ladder ground strip 10' further comprises a connecting member 130 at one of strip ends 13/14, the connecting member 130 comprising (i) a connecting member base 131, and (ii) a male connecting end 132 extending from the connecting member base 131. See again, for example, FIG. 13A.

29. The agility ladder 100 of any one of embodiments 26 to 28, wherein the connecting member 130 is integrally connected to the agility ladder ground strip 10'.

30. The agility ladder 100 of any one of embodiments 26 to 28, wherein the connecting member 130 is removable from and attachable to the agility ladder ground strip 10'.

31. The agility ladder 100 of any one of embodiments 21 to 30, wherein each of the one or more agility ladder strip connectors 20' has a male or female connecting configuration.

32. The agility ladder 100 of any one of embodiments 21 to 31, wherein each of the one or more agility ladder strip connectors 20' has a female connecting configuration.

33. The agility ladder 100 of any one of embodiments 21 to 32, wherein each of the one or more agility ladder strip connectors 20' has a female connecting configuration comprising (i) an upper connecting member 25' extending outward along opposite side edges 15/16 and/or at least one of strip ends 13/14, (ii) a lower connecting member 25" extending outward along opposite side edges 15/16 and/or at least one of strip ends 13/14, and (iii) a gap 28' between the upper connecting member and the lower connecting member. See, for example, FIGS. 13A-13D. Gap 28' might have a gap length (i.e., a distance between the upper connecting member and the lower connecting member) of from about 0.3 cm (0.118 in) to about 1.0 cm (1.0 in), typically about 0.5 cm (0.20 in).

34. The agility ladder 100 of any one of embodiments 21 to 33, wherein the one or more agility ladder strip connectors 20' of a single agility ladder ground strip 10' are capable of connecting to from 2 to 52 additional agility ladder ground strips 10'. It should be understood that a given agility ladder ground strips 10' may have a strip length Ls (e.g., 20 to 30 in) that enables attachment of numerous (e.g., 12 to 25) additional agility ladder ground strips 10' on opposite side edges 15/16.

35. The agility ladder 100 of any one of embodiments 1 to 11, wherein opposite strip side edges 15/16 have a straight, parallel configuration such that the strip width Ws is substantially constant or constant along at least a portion of the strip length Ls (e.g., along from 10% to up to 100% of the strip length Ls). The term "substantially constant" as used herein is used to capture/include agility ladder ground strips 10/10' having a strip width Ws that varies slightly (i.e., less than 5.0% of a desired strip width Ws, desirably, less than 1.0% of a desired strip width Ws) along a strip length Ls. See again, for example, exemplary agility ladder ground strip 10 shown in FIG. 36.

36. The agility ladder 100 of any one of embodiments 1 to 35, wherein each of the one or more agility ladder ground strips 10/10' further comprise an end edge 19 that extends along the strip width Ws at each of strip ends 13/14.

37. The agility ladder 100 of embodiment 36, wherein the end edge 19 comprises a straight end edge 19 that extends along the strip width Ws and is perpendicular to the strip length Ls.

38. The agility ladder 100 of any one of embodiments 9 to 37, wherein each of the one or more agility ladder ground strips 10/10' has a strip thickness Ts between the upper strip major surface 11 and the lower strip major surface 12, and the strip thickness Ts varies along the strip width Ws. See, FIGS. 7A-7C, 13A-13D, and 36A-38A.

39. The agility ladder 100 of any one of embodiments 9 to 38, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16.

Figure 7C:
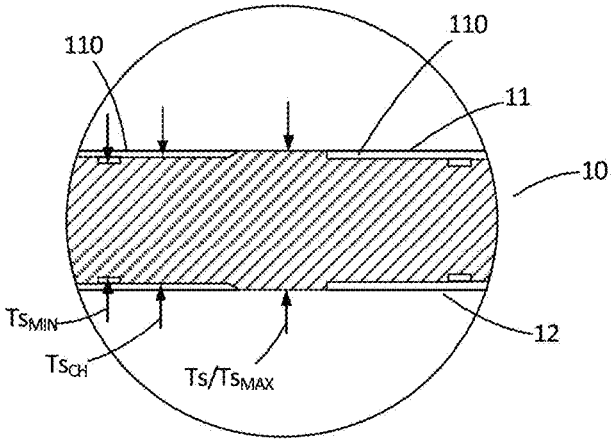
FIG. 7C is a close-up view of the circled portion 7C of the cross-sectional view shown in FIG. 7B.
Figure 8:
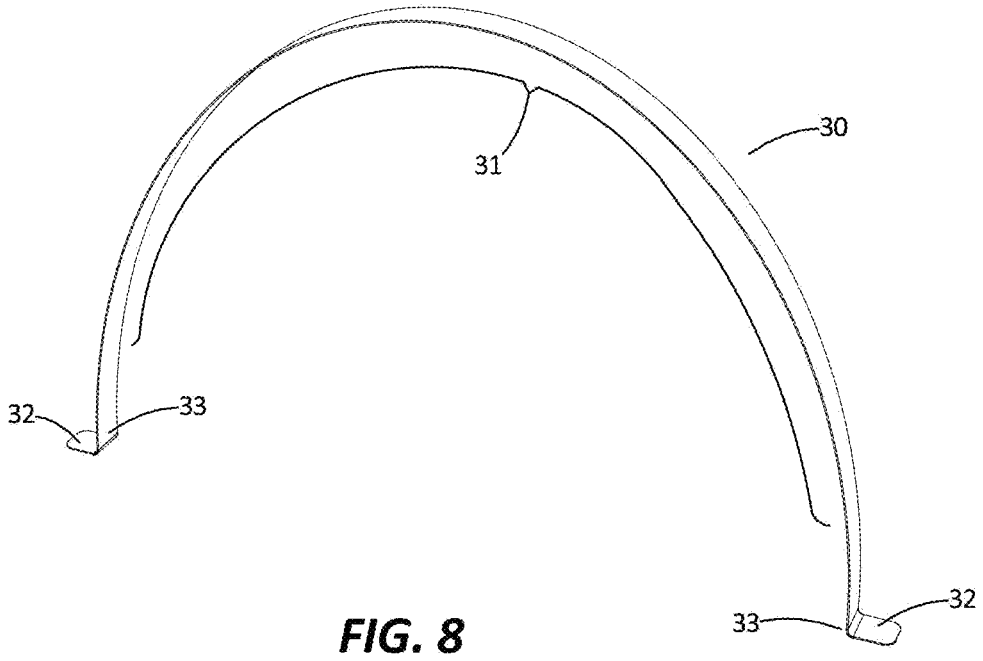
FIG. 8 is a perspective view of an exemplary hurdle strip component suitable for use in the agility ladders and agility ladder kits of the present invention.
Figure 9:
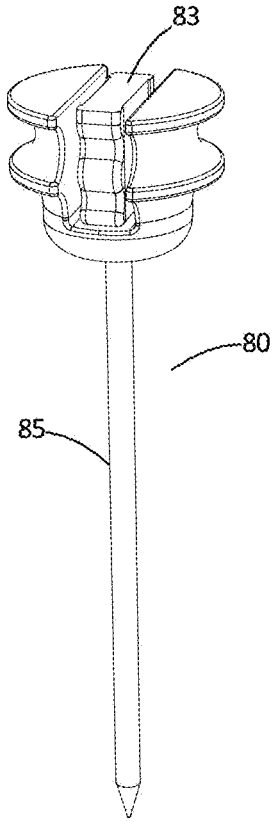
FIG. 9 is a perspective view of an exemplary spike component suitable for use in the agility ladders and agility ladder kits of the present invention.
Figure 10A:
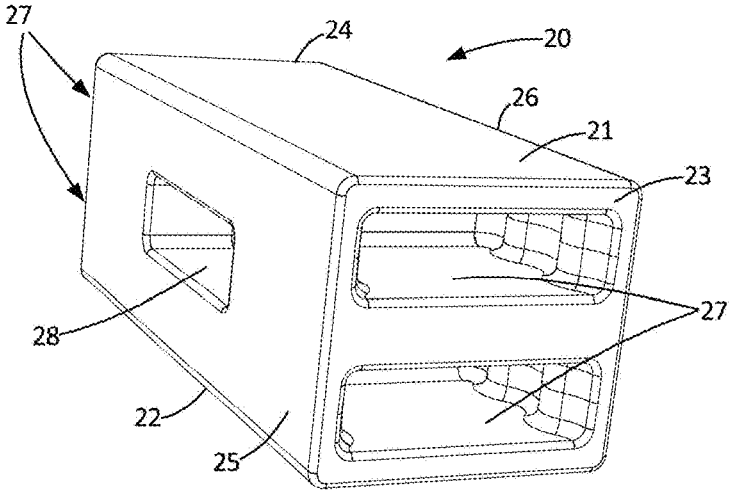
FIG. 10A is a perspective view of another exemplary agility ladder strip connector suitable for use in the agility ladders and agility ladder kits of the present invention.
Figure 10B:
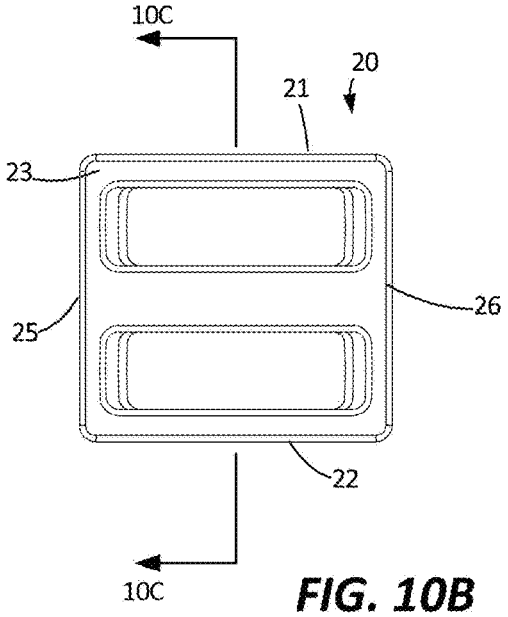
FIG. 10B is an end view of the exemplary agility ladder strip connector shown in FIG. 10A.
Figure 10C:
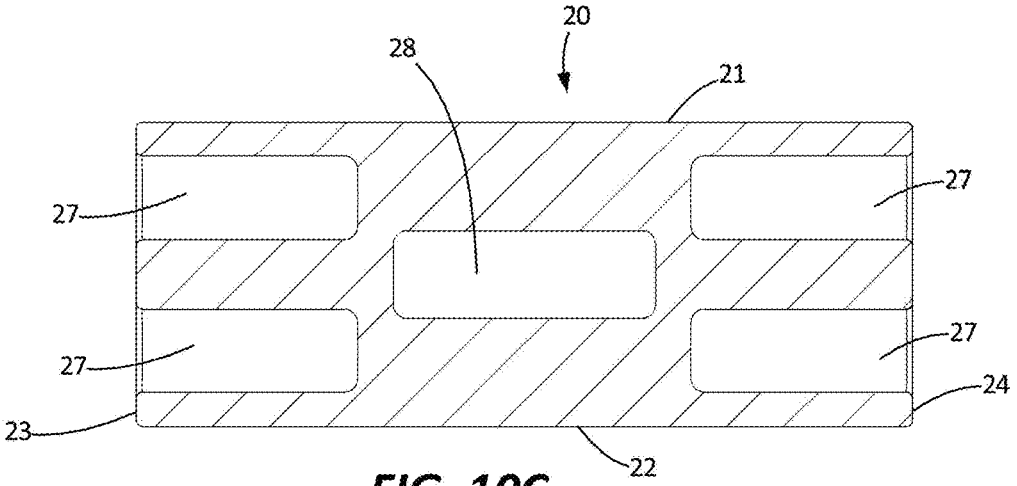
FIG. 10C is a cross-sectional view of the exemplary agility ladder strip connector shown in FIG. 10B as viewed along line 10C-10C in FIG. 10B.
Figure 10D:
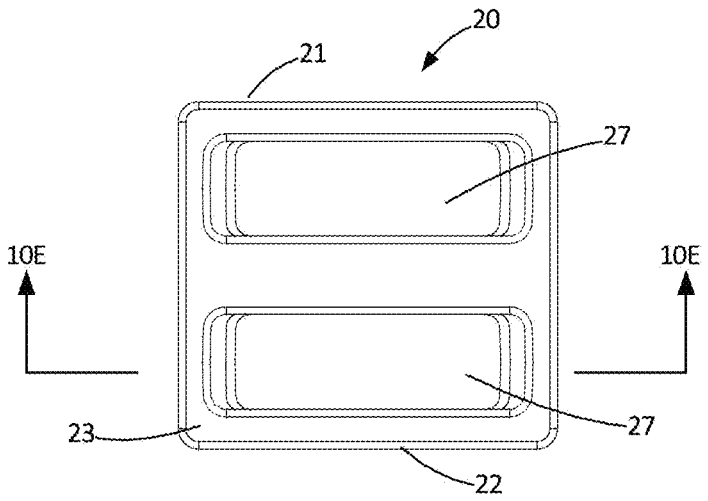
FIG. 10D is a side view of the exemplary agility ladder strip connector shown in FIG. 10A.
Figure 10E:
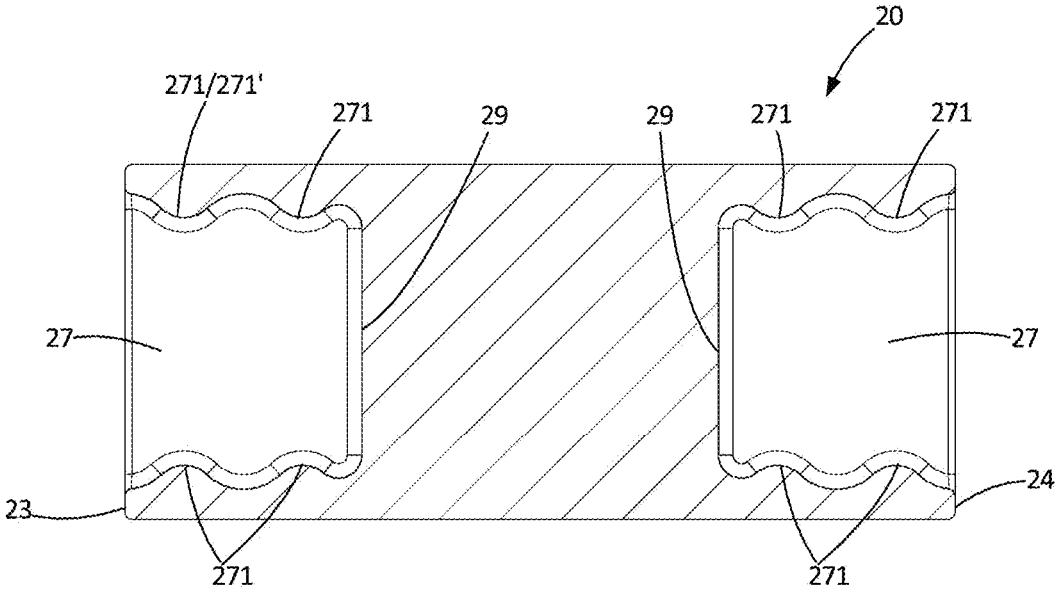
FIG. 10E is a cross-sectional view of the exemplary agility ladder strip connector shown in FIG. 10D as viewed along line 10E-10E in FIG. 10D.
Figure 10F:
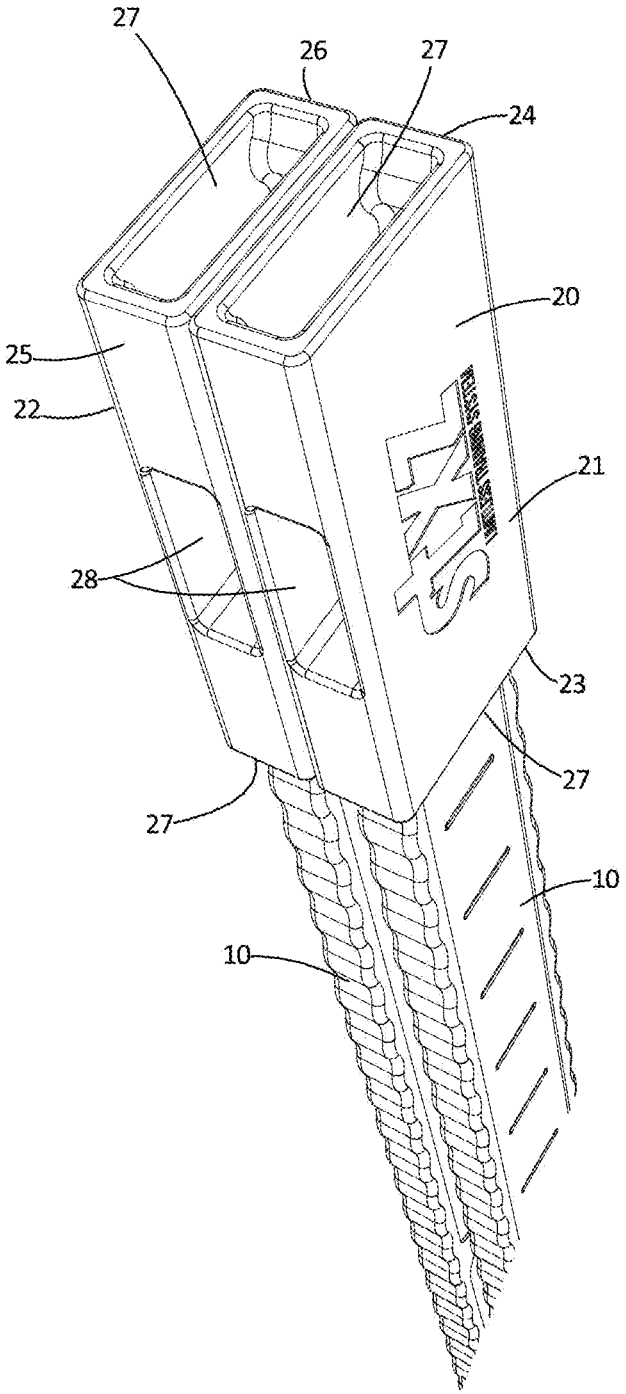
FIG. 10F is a close-up view of another exemplary agility ladder strip connector of the present invention suitable for use in the agility ladders and agility ladder kits of the present invention.

40. The agility ladder 100 of any one of embodiments 9 to 39, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16, and a minimum strip thickness $Ts_{MIN}$ along at least a portion of the upper strip major surface 11 between the opposite side edges 15/16. As shown in FIG. 7C, exemplary agility ladder ground strip 10 has a minimum strip thickness $Ts_{MIN}$ at visual markers 112 along the upper strip major surface 11 between the opposite side edges 15/16. As further shown in FIGS. 36A-38A, exemplary agility ladder ground strip 10 has a minimum strip thickness $Ts_{MIN}$ (i) centrally located along the upper strip major surface 11 between the opposite side edges 15/16, (ii) and extending along a majority of the strip width Ws along the upper strip major surface 11 and the lower strip major surface 12 between the opposite side edges 15/16.

41. The agility ladder 100 of any one of embodiments 9 to 40, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16, and a channel strip thickness $Ts_{CH}$ along an upper surface channel 110 along the upper strip major surface 11, extending between the opposite side edges 15/16 along at least a portion of the strip length Ls. See, FIGS. 7A-7C, FIGS. 13A-13D, and 36A-38A.

42. The agility ladder 100 of any one of embodiments 9 to 41, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16, and a channel strip thickness $Ts_{CH}$ along an upper surface channel 110 along the upper strip major surface 11, extending between the opposite side edges 15/16 along at least a portion of the strip length Ls, wherein the upper surface channel 110 has a surface channel width Wc that remains constant along at least a portion of the strip length Ls.

43. The agility ladder 100 of any one of embodiments 9 to 42, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16, and a channel strip thickness $Ts_{CH}$ along an upper surface channel 110 along the upper strip major surface 11, extending between the opposite side edges 15/16 along at least a portion of the strip length Ls proximate opposite end edges 19, wherein the upper surface channel 110 has a surface channel width Wc that remains constant along a majority of the strip length Ls (i.e., greater than 50% up to 100% of the strip length Ls).

44. The agility ladder 100 of any one of embodiments 9 and 35 to 43, wherein each of the one or more agility ladder ground strips 10/10' has a maximum strip thickness $Ts_{MAX}$ along or proximate (i.e., positioned within up to about 0.50 inch from, more typically, from about 0.10 to about 0.25 inch from) the opposite side edges 15/16, and a channel strip thickness $Ts_{CH}$ along an upper surface channel 110 along the upper strip major surface 11, extending between the opposite side edges 15/16 along the strip length Ls between end edges 19, wherein the upper surface channel 110 has a surface channel width Wc that remains constant along the strip length Ls (i.e., 100% of the strip length Ls).

45. The agility ladder 100 of any one of embodiments 41 to 44, wherein each of the one or more agility ladder ground strips 10/10' further comprises a lower surface channel 120 extending between the opposite side edges 15/16 along at least a portion of the strip length Ls along the lower strip major surface 12. See, FIGS. 36-37.

46. The agility ladder 100 of any one of embodiments 41 to 45, wherein each of the one or more agility ladder ground strips 10/10' further comprises a lower surface channel 120 extending between the opposite side edges 15/16 along a majority of the strip length Ls (i.e., greater than 50% of the strip length Ls) along the lower strip major surface 12. See again, FIGS. 36-38.

47. The agility ladder 100 of any one of embodiments 41 to 46, wherein each of the one or more agility ladder ground strips 10/10' further comprises a lower surface channel 120 extending between the opposite side edges 15/16 along all of the strip length Ls (i.e., 100% of the strip length Ls) along the lower strip major surface 12. See again, FIGS. 36-36B, and 38-38A.

48. The agility ladder 100 of any one of embodiments 41 to 47, wherein the channel strip thickness $Ts_{CH}$ represents the minimum strip thickness $Ts_{MIN}$.

49. The agility ladder 100 of any one of embodiments 9 and 35 to 48, wherein each of the opposite side edges 15/16 has an outer curved profile extending (a) between (i) the upper strip major surface 11, and (ii) the lower strip major surface 12, and (b) along the strip length Ls between end edges 19.

50. The agility ladder 100 of any one of embodiments 9 and 35 to 49, wherein each of the opposite side edges 15/16 has an outer convex curved profile extending (a) between (i) the upper strip major surface 11, and (ii) the lower strip major surface 12, and (b) along the strip length Ls between end edges 19.

51. The agility ladder 100 of any one of embodiments 9 and 35 to 50, wherein each of the opposite side edges 15/16 has an outer curved profile extending (a) between (i) the upper strip major surface 11, and (ii) the lower strip major surface 12, and (b) along the strip length Ls between end edges 19, the outer curved profile comprising an outer arc of curvature of up to about 210°.

52. The agility ladder 100 of any one of embodiments 9 and 35 to 51, wherein each of the opposite side edges 15/16 has an outer curved profile extending (a) between (i) the upper strip major surface 11, and (ii) the lower strip major surface 12, and (b) along the strip length Ls between end edges 19, the outer curved profile comprising an outer arc of curvature of from about 90° to 180°.

53. The agility ladder 100 of any one of embodiments 9 and 35 to 52, wherein each of the opposite side edges 15/16 has an outer curved profile extending (a) between (i) the upper strip major surface 11, and (ii) the lower strip major surface 12, and (b) along the strip length Ls between end edges 19, the outer curved profile comprising an outer arc of curvature of from about 90° to 180°.

54. The agility ladder 100 of any one of embodiments 49 to 53, wherein the outer curved profile extends (a) between (i) the upper strip major surface 11, and (ii) the lower strip major surface 12 at the maximum strip thickness $Ts_{MAX}$ of a given agility ladder ground strip 10.

55. The agility ladder 100 of any one of embodiments 9 and 35 to 54, wherein each of the one or more agility ladder ground strips 10 has a cross-sectional configuration such that the cross-sectional configuration comprises (A) a maximum strip thickness $Ts_{MAX}$ at (a) a first location 151 along or proximate (i.e., positioned within up to about 0.50 inch from, more typically, from about 0.10 to about 0.25 inch from) opposite side edge 15, and (b) a second location 161 along or proximate (i.e., positioned within up to about 0.50 inch from, more typically, from about 0.10 to about 0.25 inch from) opposite side edge 16, (B) a strip thickness Ts that is less than the maximum strip thickness $Ts_{MAX}$ between (i) the first location 151 and (ii) the second location 161, and (C) opposing outer curved profiles extending between (a)(i) the upper strip major surface 11, and (ii) the lower strip major surface 12 at the first location 151, and (b)(i) the upper strip major surface 11, and (ii) the lower strip major surface 12 at the second location 161, along the strip length Ls between end edges 19.

56. The agility ladder 100 of embodiment 55, wherein each of the outer opposing curved profiles comprises the outer curved profile described in any one of embodiments 46 to 51.

57. The agility ladder 100 of embodiment 55 or 56, wherein the strip thickness Ts between (i) the first location 151 and (ii) the second location 161 equals a minimum strip thickness $Ts_{MIN}$ of the agility ladder ground strip 10 along at least a portion of the strip width Ws (i.e., channel 110) between (i) the first location 151 and (ii) the second location 161.

58. The agility ladder 100 of any one of embodiments 55 to 57, wherein the strip thickness Ts between (i) the first location 151 and (ii) the second location 161 equals a minimum strip thickness $Ts_{MIN}$ of the agility ladder ground strip 10 along a majority (i.e., greater than 50%) of the strip width Ws (i.e., channel 110) between (i) the first location 151 and (ii) the second location 161.

59. The agility ladder 100 of any one of embodiments 55 to 58, wherein each of the one or more agility ladder ground strips 10 further comprises upper opposing inner curved profiled surfaces 175 extending along the strip length Ls (a)(i) from the first location 151 to a minimum strip thickness $Ts_{MIN}$ along the upper strip major surface 11 of the agility ladder ground strip 10 along the strip width Ws (i.e., channel 110) between (i) the first location 151 and (ii) the second location 161, and (b)(i) from the second location 161 to a minimum strip thickness $Ts_{MIN}$ along the upper strip major surface 11 of the agility ladder ground strip 10 along the strip width Ws (i.e., channel 110) between (i) the first location 151 and (ii) the second location 161. See, for example, FIG. 38A.

60. The agility ladder 100 of embodiment 59, wherein the upper opposing inner curved profiled surfaces 175 each have a concave curved profiled surface.

61. The agility ladder 100 of any one of embodiments 55 to 60, wherein each of the one or more agility ladder ground strips 10 further comprises lower opposing inner curved profiled surfaces 176 extending along the strip length Ls (a)(i) from the first location 151 to a minimum strip thickness $Ts_{MIN}$ along the lower strip major surface 12 of the agility ladder ground strip 10 along the strip width Ws (i.e., channel 120) between (i) the first location 151 and (ii) the second location 161, and (b)(i) from the second location 161 to a minimum strip thickness $Ts_{MIN}$ along the lower strip major surface 12 of the agility ladder ground strip 10 along the strip width Ws (i.e., channel 120) between (i) the first location 151 and (ii) the second location 161. See again, for example, FIG. 38A.

62. The agility ladder 100 of embodiment 61, wherein the lower opposing inner curved profiled surfaces 176 each have a concave curved profiled surface.

63. The agility ladder 100 of embodiment 61 or 62, wherein the upper opposing inner curved profiled surfaces 175, and the lower opposing inner curved profiled surfaces 176 each independently has an inner arc of curvature of up to about 270°.

64. The agility ladder 100 of any one of embodiments 61 to 63, wherein the upper opposing inner curved profiled surfaces 175, and the lower opposing inner curved profiled surfaces 176 each independently has an inner arc of curvature of from about 90° to 150°.

65. The agility ladder 100 of any one of embodiments 61 to 64, wherein the upper opposing inner curved profiled surfaces 175, and the lower opposing inner curved profiled surfaces 176 each independently has an inner arc of curvature of from about 90° to 180°.

66. The agility ladder 100 of any one of embodiments 9 to 11, and 35 to 65, wherein upper strip edge features along the upper strip major surface 11 are present, and (a) extend along at least a portion of the strip length Ls (or all of the strip length Ls), and (b) have (i) some amount of curvature therein (e.g., curvature extending along upper and/or lower surfaces 11/12, such as the opposing curved profiles along the upper and/or lower surfaces 11/12 shown in FIGS. 36-38A).

67. The agility ladder 100 of embodiment 66, wherein the upper strip edge features comprise one or more upper peaks 115 extending along the upper strip major surface 11 along at least a portion of the strip length Ls (or all of the strip length Ls). See, for example, FIGS. 37B-37E, 37G-37H, and 37J). As shown in FIGS. 37B-37E, 37G-37H, and 37J, upper peaks 115 may also represent strip contact points 102 along at least a portion of the strip length Ls (or all of the strip length Ls), namely, points along strip 10 that come into contact with surfaces 272' and/or 282' within channel 270 and/or channel 28 respectively).

68. The agility ladder 100 of embodiment 66 or 67, wherein the upper strip edge features comprise one or more upper peaks 115 extending along the upper strip major surface 11 along all of the strip length Ls. See again, for example, FIGS. 37B-37E, 37G-37H, and 37J).

69. The agility ladder 100 of any one of embodiments 9 to 11, and 35 to 68, wherein lower strip edge features along the lower strip major surface 12 are present, and (a) extend along at least a portion of the strip length Ls (or all of the strip length Ls), and (b) have (i) some amount of curvature therein (e.g., curvature extending along upper and/or lower surfaces 11/12, such as the opposing curved profiles along the upper and/or lower surfaces 11/12 shown in FIGS. 36-38A).

70. The agility ladder 100 of embodiment 69, wherein the lower strip edge features comprise one or more lower peaks 125 extending along the lower strip major surface 12 along at least a portion of the strip length Ls (or all of the strip length Ls). See, for example, FIGS. 37C-37E, 37G, and 37J). As shown in FIGS. 37C-37E, 37G, and 37J, lower peaks 125 may also represent strip contact points 102 along at least a portion of the strip length Ls (or all of the strip length Ls), namely, points along strip 10 that come into contact with surfaces 272' and/or 282' within channel 270 and/or channel 28 respectively).

71. The agility ladder 100 of embodiment 69 or 70, wherein the lower strip edge features comprise one or more lower peaks 125 extending along the lower strip major surface 12 along all of the strip length Ls. See again, for example, FIGS. 37C-37E, 37G, and 37J).

72. The agility ladder 100 of any one of embodiments 9 and 35 to 71, wherein each of the one or more agility ladder ground strips 10 has a cross-sectional configuration such that when dissected along a centrally located vertically-extending plane $P_V$, the cross-sectional configuration comprise two mirror images of each other (i.e., two strip halves, namely, a left-side portion and a right-side portion that are mirror images of each other). See, for example, FIGS. 36A-36B, and 38-38A. See also, exemplary compatible agility ladder strip connectors 20 with channels 28/270 therein shown in FIGS. 43A-43J.

73. The agility ladder 100 of any one of embodiments 9 and 35 to 72, wherein each of the one or more agility ladder ground strips 10 has a cross-sectional configuration such that when dissected along a centrally located horizontally-extending plane $P_H$, the cross-sectional configuration comprise two mirror images of each other (i.e., two strip halves, namely, an upper-side portion and a lower-side portion that are mirror images of each other). FIGS. 36A-36B, and 38-38A. See also, exemplary compatible agility ladder strip connectors 20 with channels 28/270 therein shown in FIGS. 43D-43F, and 43I-43J.

74. The agility ladder 100 of any one of embodiments 1 to 73, wherein each of the one or more agility ladder ground strips 10/10' has a straight, linear configuration. See, for example, the exemplary agility ladder ground strips 10/10' shown in FIGS. 1, 3, 7A, 18, 21 and 36.

75. The agility ladder 100 of any one of embodiments 1 to 74, wherein one or more of the one or more agility ladder ground strips 10/10' has a curved configuration. See, for example, the exemplary agility ladder ground strip 10 shown in FIG. 38.

76. The agility ladder 100 of any one of embodiments 1 to 73 and 75, wherein one or more of the one or more agility ladder ground strips 10/10' has a curved configuration such that opposite ends 13/14 of the agility ladder ground strip 10/10' are oriented at an angle A to one another. See again, for example, the exemplary agility ladder ground strip 10 shown in FIG. 38.

77. The agility ladder 100 of embodiment 76, wherein angle A is less than 180°.

78. The agility ladder 100 of embodiment 76 or 77, wherein angle A ranges from about 300 to about 150°.

79. The agility ladder 100 of any one of embodiments 76 to 78, wherein angle A ranges from about 300 to about 90°.

80. The agility ladder 100 of any one of embodiments 76 to 79, wherein angle A ranges from about 450 to about 60°.

81. The agility ladder 100 of any one of embodiments 1 to 80, wherein each of the one or more agility ladder ground strips 10/10' independently has a strip length Ls of from about 5.0 in (12.70 cm) to about 28.0 in (71.12 cm), a strip width Ws of from about 0.8 in (2.03 cm) to about 3.0 in (7.62 cm), and a strip thickness Ts of from about 0.062 in (0.16 cm) to about 1.00 in (2.54 cm). It should be noted that the strip length Ls is an overall length of a given strip between opposite ends 13/14. For an agility ladder ground strip 10/10' having a curved configuration, the strip length Ls is the overall length extending from one end 13, to the curved section, and then towards the second end 14. See again, FIG. 38.

82. The agility ladder 100 of any one of embodiments 1 to 81, wherein each of the one or more agility ladder ground strips 10/10' independently has a strip length Ls of from about 17.0 in (43.18 cm) to about 20.0 in (50.80 cm), a strip width Ws of from about 1.0 in (2.54 cm) to about 1.5 in (3.81 cm), and a strip thickness Ts of from about 0.125 in (0.32 cm) to about 0.80 in (2.03 cm). In one embodiment, each of the one or more agility ladder ground strips 10/10' independently has a strip length Ls of from about 17.0 in (43.18 cm) to about 20.0 in (50.80 cm), a strip width Ws of about 1.25 in (3.17 cm), and a strip thickness Ts of about 0.375 in (0.95 cm).

83. The agility ladder 100 of any one of embodiments 1 to 82, wherein each of the one or more agility ladder ground strips 10/10' independently comprises a polymeric material.

84. The agility ladder 100 of any one of embodiments 1 to 83, wherein each of the one or more agility ladder ground strips 10/10' independently comprises a fiber-reinforced polymeric material.

85. The agility ladder 100 of any one of embodiments 1 to 84, wherein each of the one or more agility ladder ground strips 10/10' independently comprises a polypropylene, a polyethylene, a high-density polyethylene, a polyvinyl chloride (PVC), a nylon, an acetal or polyacetal, a filler- or fiber-reinforced polymeric material (e.g., any of the polymers mentioned herein), or any combination thereof.

86. The agility ladder 100 of any one of embodiments 1 to 85, wherein each of the one or more agility ladder ground strips 10/10' independently comprises a polypropylene or a glass-filled polypropylene, or a polyvinyl chloride (PVC) or a glass-filled polyvinyl chloride (PVC).

87. The agility ladder 100 of any one of embodiments 9 to 86, wherein each of the one or more agility ladder ground strips 10/10' independently comprises one or more hollow sections 135 extending along the strip length Ls.

88. The agility ladder 100 of any one of embodiments 9 to 87, wherein said agility ladder ground strip 10 comprises one or more strip end openings 135 extending within one or more of opposite strip ends 13/14. See, for example, FIGS. 36A-36B, 37F, 37I, and 37J.

89. The agility ladder 100 of any one of embodiments 9 to 88, wherein said agility ladder ground strip 10 comprises one or more strip end openings 135 extending within each of opposite strip ends 13/14.

90. The agility ladder 100 of embodiment 88 or 89, wherein each of the one or more strip end openings 135 independently extends a strip opening distance $d_{SO}$ from opposite strip end 13/14 into said agility ladder ground strip 10 along the strip length Ls, wherein each strip opening distance $d_{SO}$ independently ranges from about 0.2 inch (in) to the entire strip length Ls. It should be understood that each strip opening distance $d_{SO}$ may independently have any length along the strip length Ls, for example, from 10% of the overall strip length Ls up to 100% of the overall strip length Ls.

91. The agility ladder 100 of any one of embodiments 88 to 90, wherein said agility ladder ground strip 10 comprises one or more strip end openings 135 extending within each of opposite strip ends 13/14, and each strip end opening 135 at strip end 13 connects with a corresponding strip end opening 135 at strip end 14 to form a length-extending strip channel 138 extending from strip end 13 of said agility ladder ground strip 10 to strip end 14 of said agility ladder ground strip 10.

92. The agility ladder 100 of any one of embodiments 88 to 91, wherein said one or more strip end openings 135 comprises from about one to eight strip end openings 135. In this case, the agility ladder ground strip 10 could have from about one to eight length-extending strip channels 138 extending from strip end 13 to strip end 14 of the agility ladder ground strip 10.

93. The agility ladder 100 of any one of embodiments 88 to 92, wherein said one or more strip end openings 135 comprises from about two to four strip end openings 135. See again, for example, (1) exemplary agility ladder ground strip 10 with four length-extending strip channels 138 (and four strip end openings 135) shown in FIG. 36A, and (2) exemplary agility ladder ground strip 10 with three length-extending strip channels 138 (and three strip end openings 135) shown in FIG. 36B, with a centrally-located circular length-extending strip channel 138 (and centrally-located circular strip end opening 135), and length-extending strip channels 138 (and strip end openings 135) on opposite sides of the centrally-located circular length-extending strip channel 138 (and centrally-located circular strip end opening 135).

94. The agility ladder 100 of any one of embodiments 88 to 93, wherein said one or more strip end openings 135 comprises three strip end openings 135, with a centrally-located circular strip end opening 135, and strip end openings 135 on opposite sides of the centrally-located circular strip end opening 135. See again, FIG. 36B.

95. The agility ladder 100 of any one of embodiments 1 to 20 and 35 to 94, wherein each of the one or more agility ladder strip connectors 20 comprises (i) an upper connector major surface 21, (ii) a lower connector major surface 22 opposite the upper connector major surface 21, (iii) opposite connector ends 23/24 separated by a connector length Lc, (iv) a first connector side edge 25 extending between the opposite connector ends 23/24, (v) a second connector side edge 26 opposite the first connector side edge 23/24, and being separated from the first connector side edge 25 by a connector width Wc, (vi) at least one strip receiving opening 27 within each of the opposite connector ends 23/24 with each strip receiving opening 27 sized to receive a strip end 13/14 of a given agility ladder ground strip 10, and (vii) at least one connector channel 28 extending from the first connector side edge 25 to the second connector side edge 26.

96. The agility ladder 100 of any one of embodiments 1 to 20 and 35 to 95, wherein each strip receiving opening 27 connects with a corresponding strip receiving opening 27 to form a length-extending connector channel 270 extending from a first connector end 23 of said opposite connector ends 23/24 to a second connector end 24 of said opposite connector ends 23/24.

97. The agility ladder 100 of any one of embodiments 1 to 20 and 35 to 96, wherein each of the one or more agility ladder strip connectors 20 comprises a single strip receiving opening 27 within each of the opposite connector ends 23/24.

98. The agility ladder 100 of any one of embodiments 1 to 20 and 35 to 96, wherein each of the one or more agility ladder strip connectors 20 comprises two or more strip receiving openings 27 within at least one of the opposite connector ends 23/24.

99. The agility ladder 100 of any one of embodiments 1 to 20 and 35 to 96, and 98, wherein each of the one or more agility ladder strip connectors 20 comprises two or more strip receiving openings 27 within each of the opposite connector ends 23/24. Typically, a given agility ladder strip connector 20 may comprise from one to six, more typically, two or three, strip receiving openings 27 within each of the opposite connector ends 23/24.

Figure 11A:
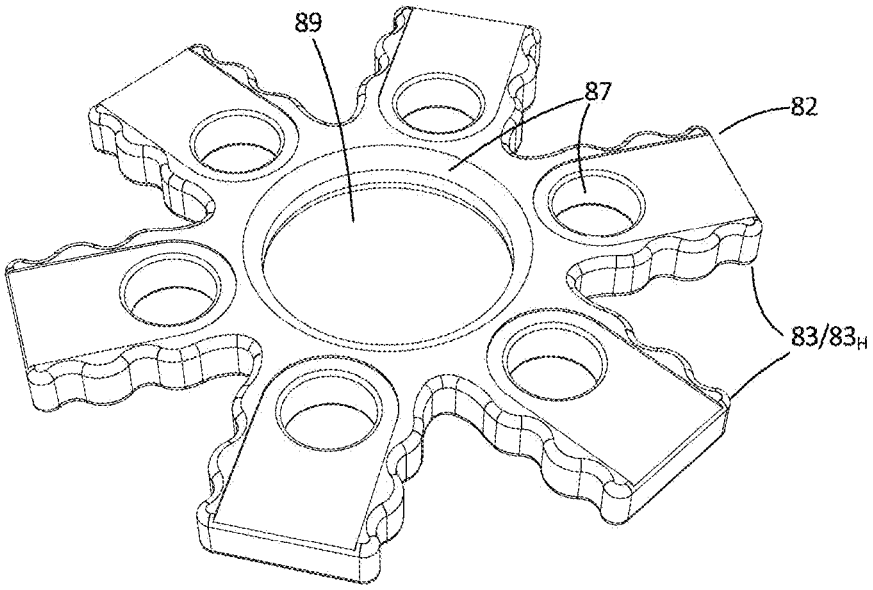
FIG. 11A is a perspective view of an exemplary six-connector component suitable for use in the agility ladders and agility ladder kits of the present invention.
Figure 11B:
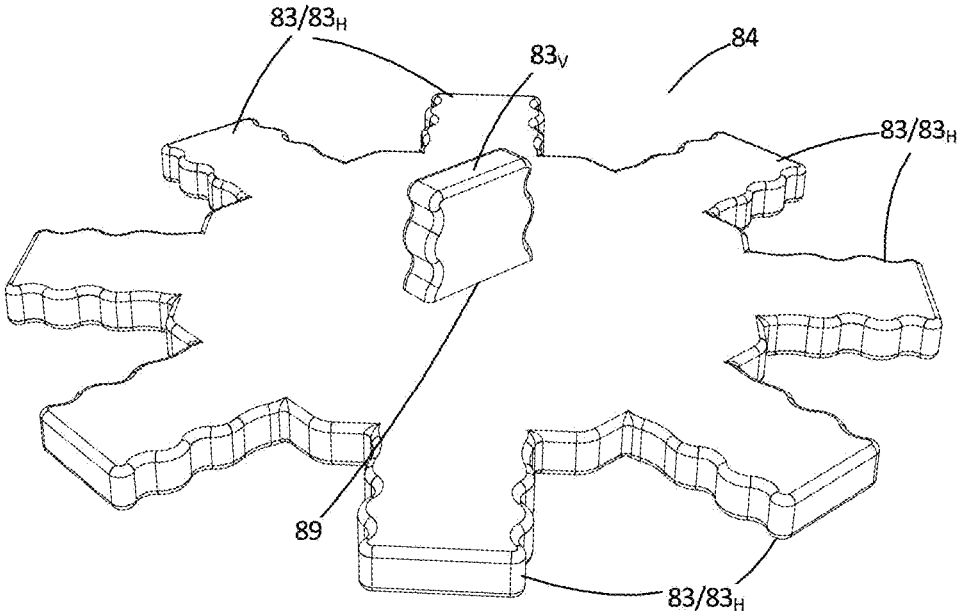
FIG. 11B is a perspective view of an exemplary nine-connector component suitable for use in the agility ladders and agility ladder kits of the present invention.
Figure 11C:
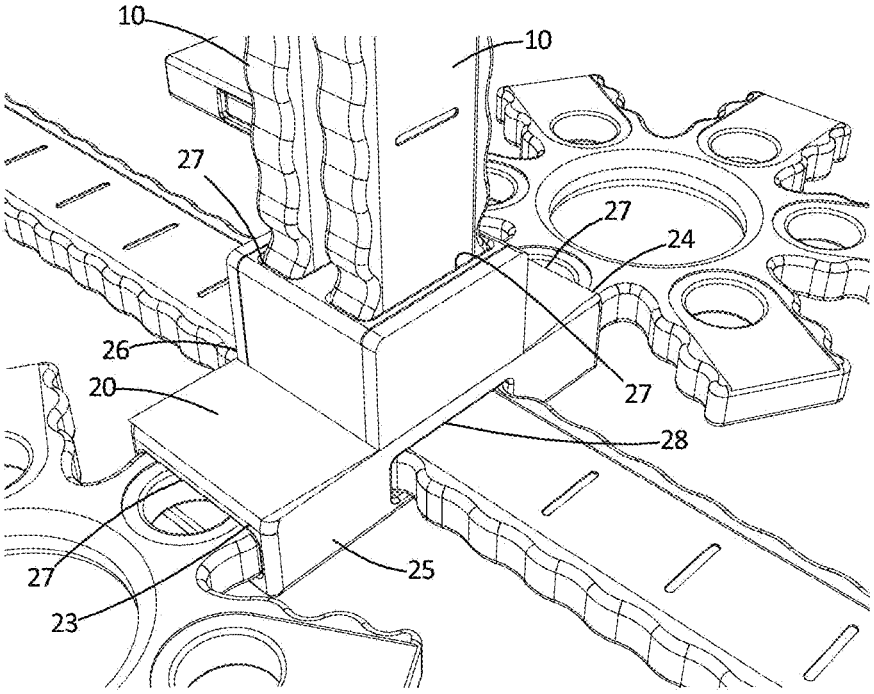
FIGS. 11C-11D provide perspective views of exemplary agility ladder strip connectors that enable connection of vertically-extending strips to horizontally-extending strips, and are suitable for use in the agility ladders and agility ladder kits of the present invention.
Figure 11D:
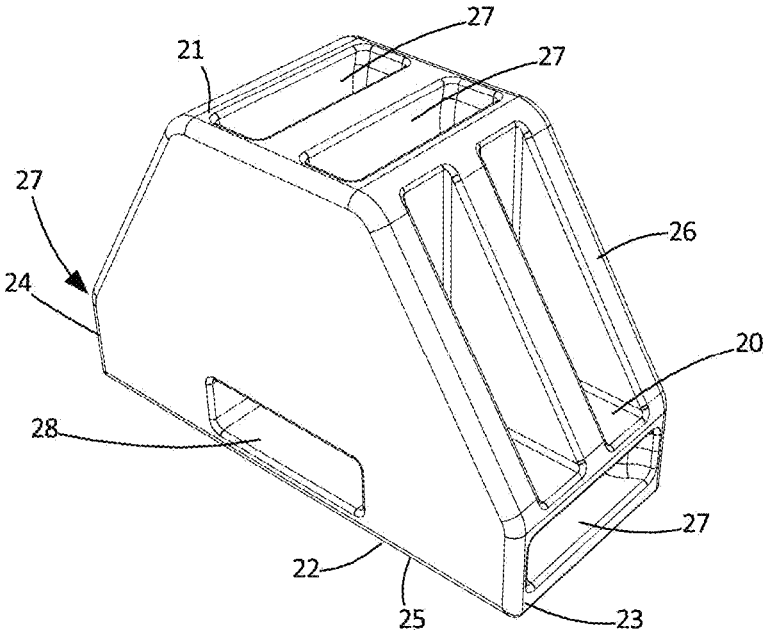
Figure 12A:
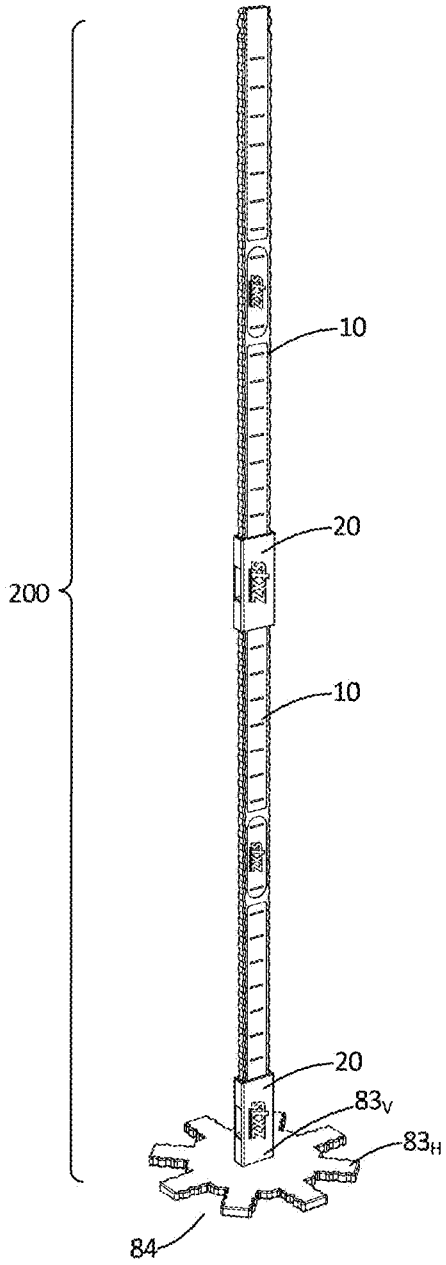
FIGS. 12A-12F depict various exemplary agility ladder component configurations suitable for use in the agility ladders and agility ladder kits of the present invention.
Figure 12B:
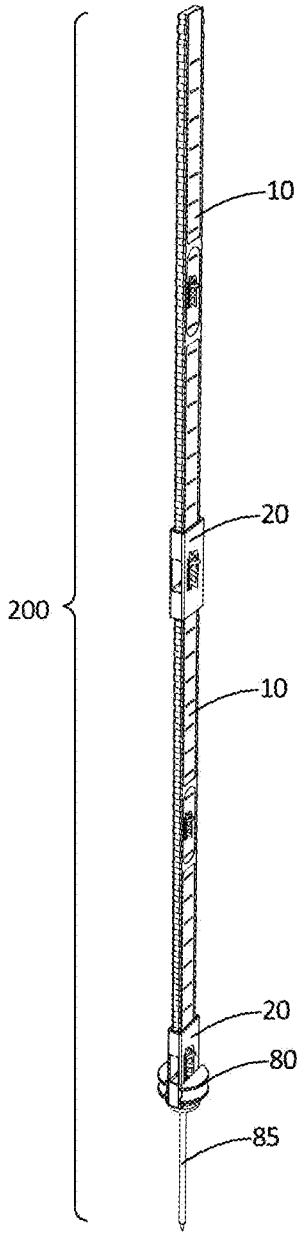
Figure 12C:
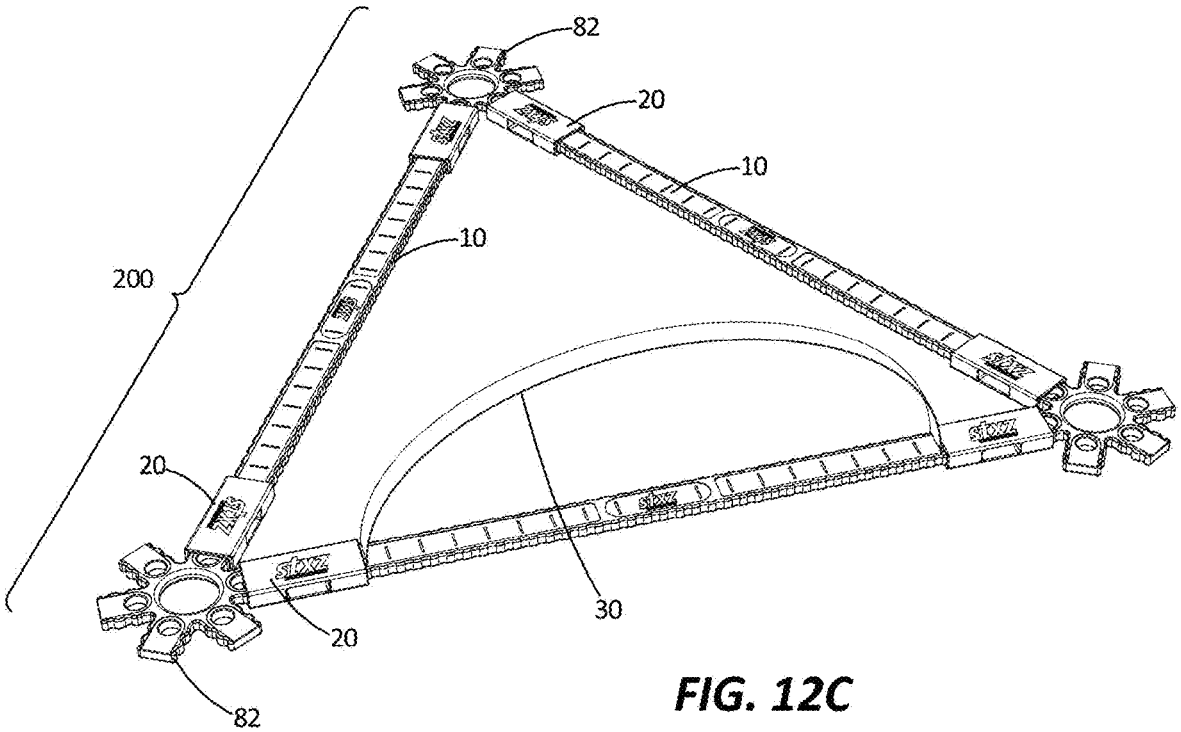
Figure 12D:
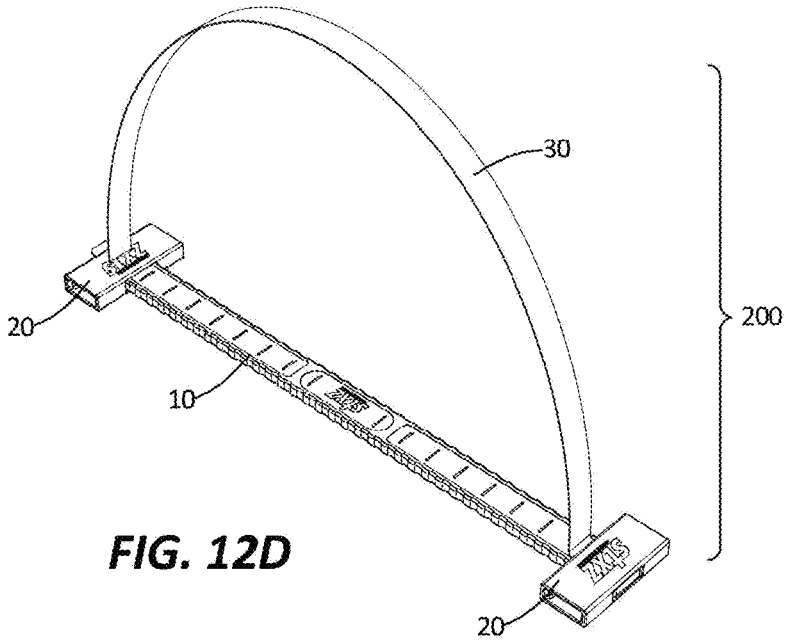
Figure 12E:
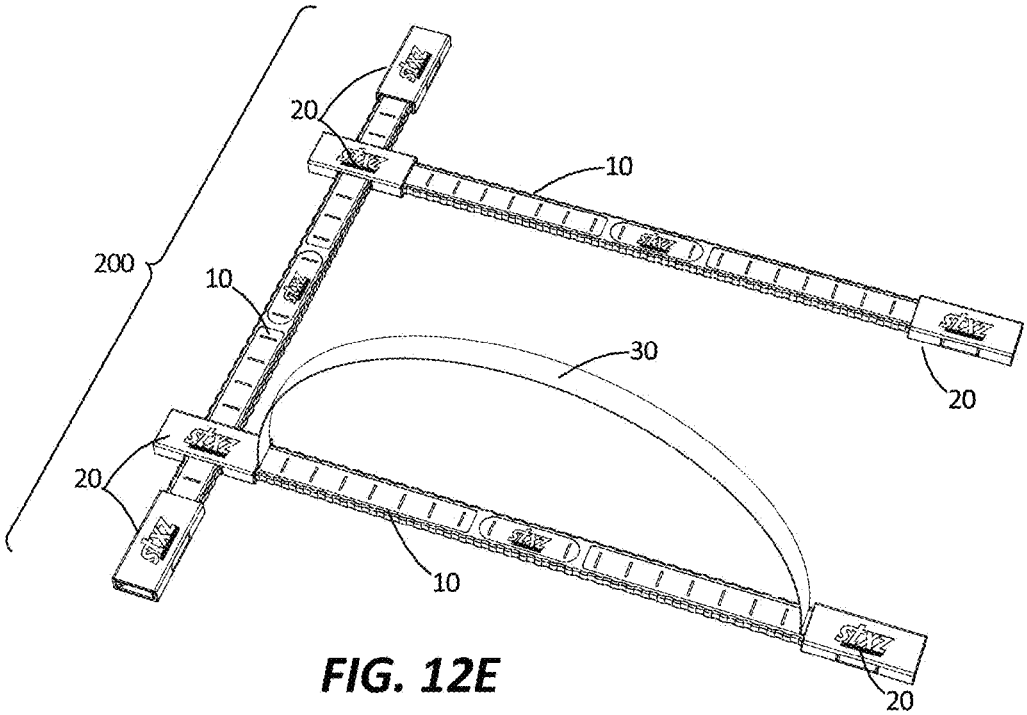
Figure 12F:
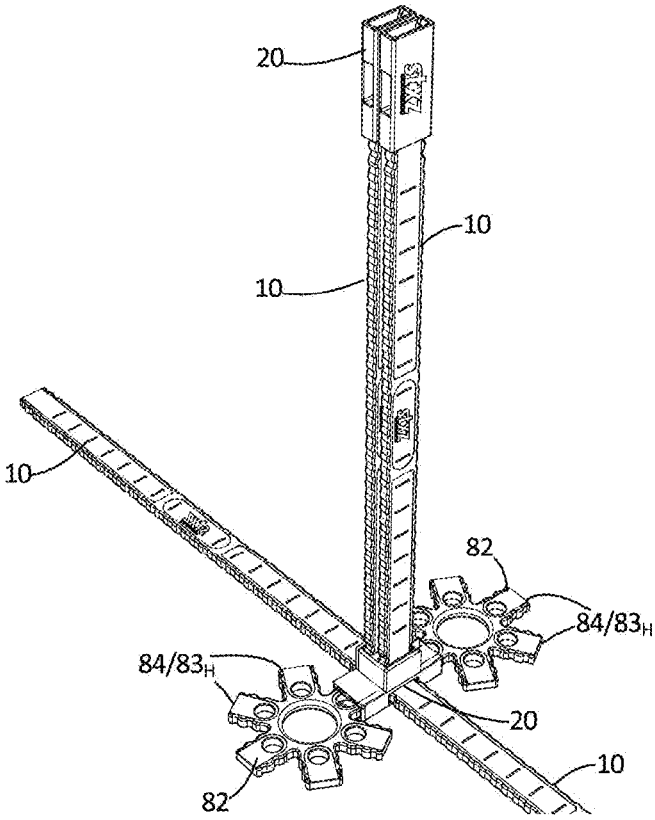
Figure 13A:
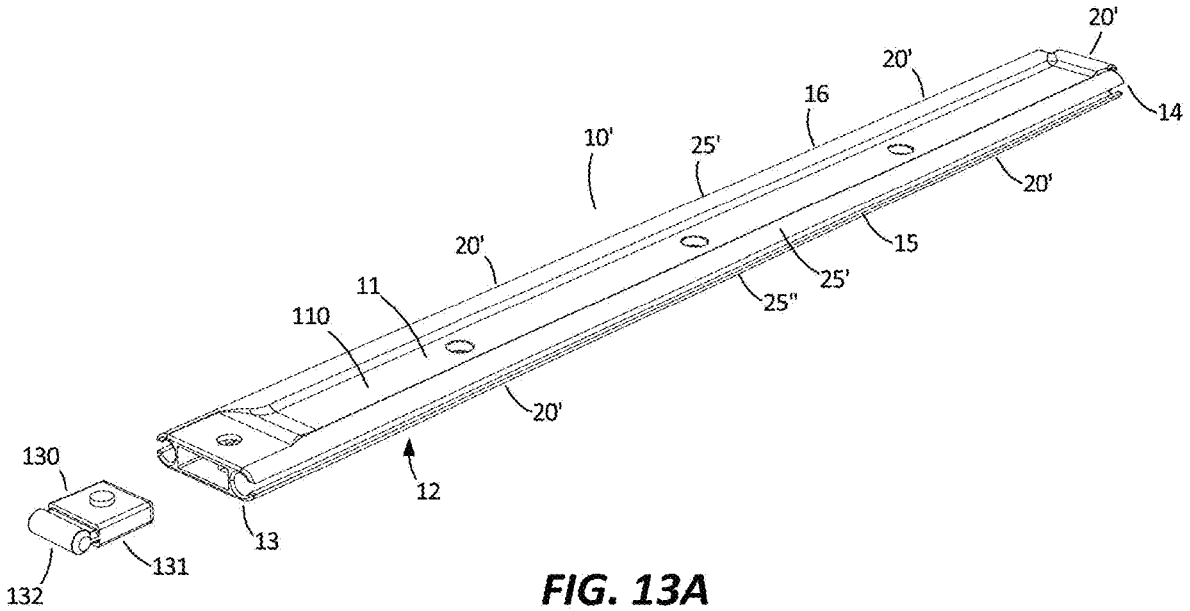
FIG. 13A is a perspective view of another exemplary agility ladder ground strip suitable for use in the agility ladders and agility ladder kits of the present invention.
Figure 13B:
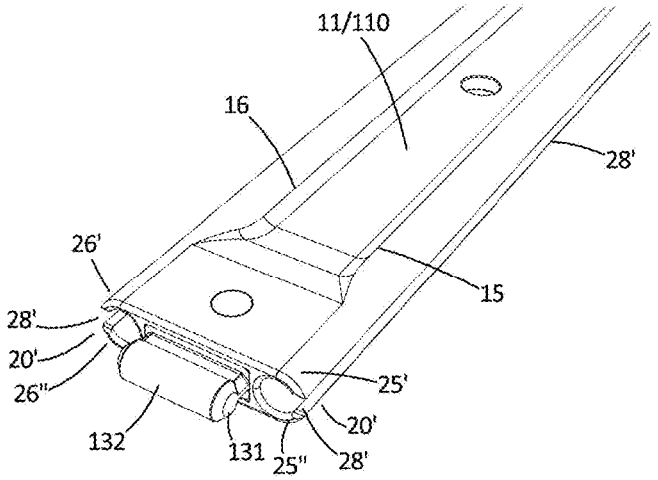
FIG. 13B is a close-up view of one end of the exemplary agility ladder ground strip shown in FIG. 13A.
Figure 13C:
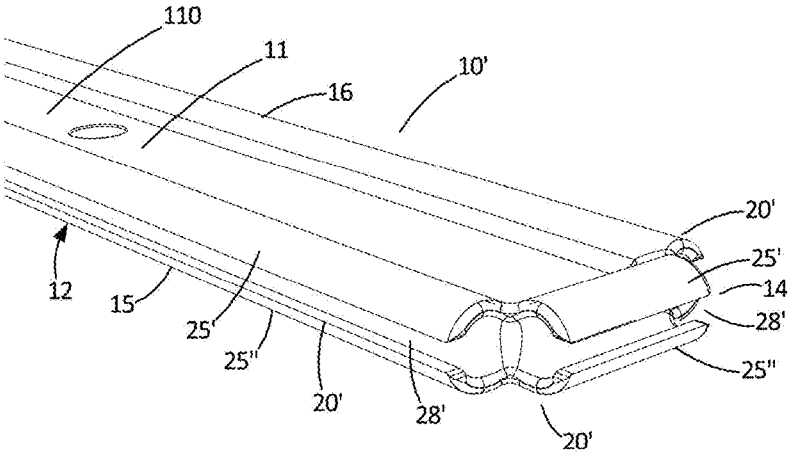
FIG. 13C is a close-up view of the opposite end of the exemplary agility ladder ground strip shown in FIG. 13A.
Figure 13D:
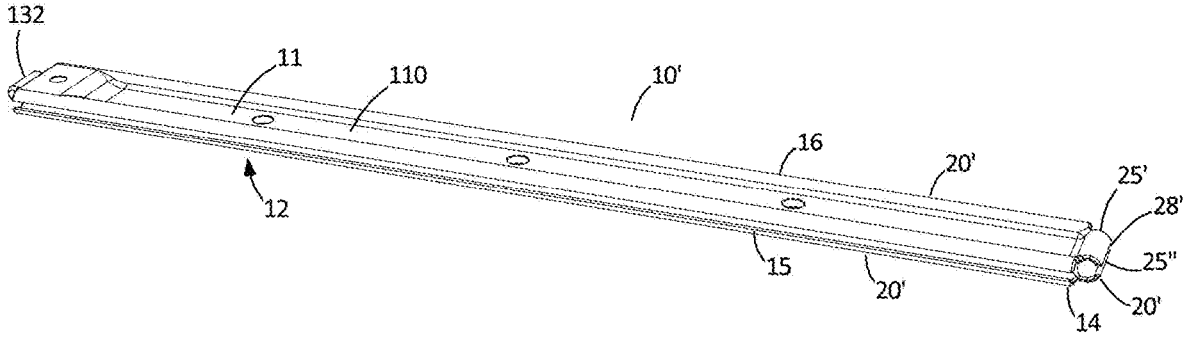
FIG. 13D is another perspective view of the exemplary agility ladder ground strip shown in FIG. 13A.
Figure 14A:
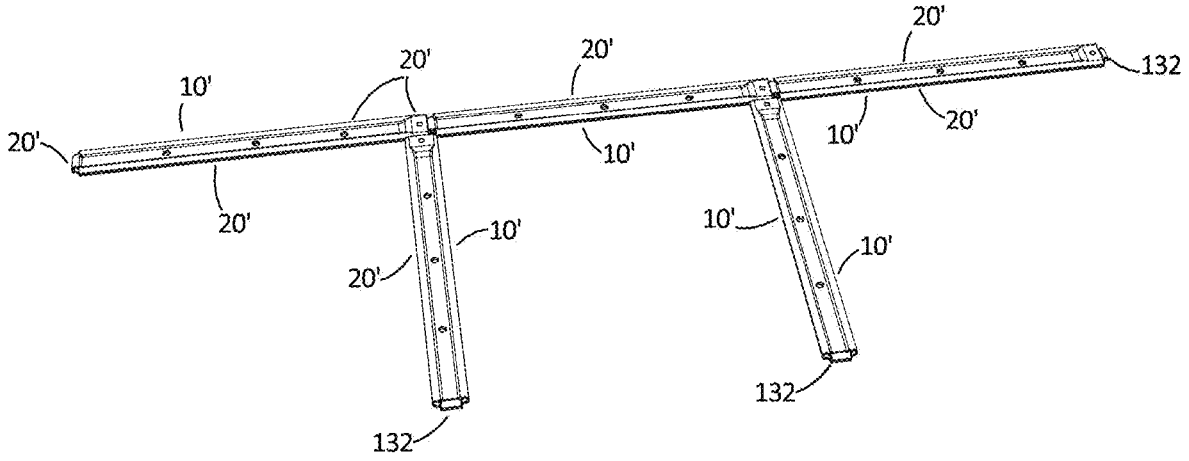
FIGS. 14A-14B depict various exemplary agility ladder configurations using the exemplary agility ladder ground strip shown in FIG. 13A.
Figure 14B:
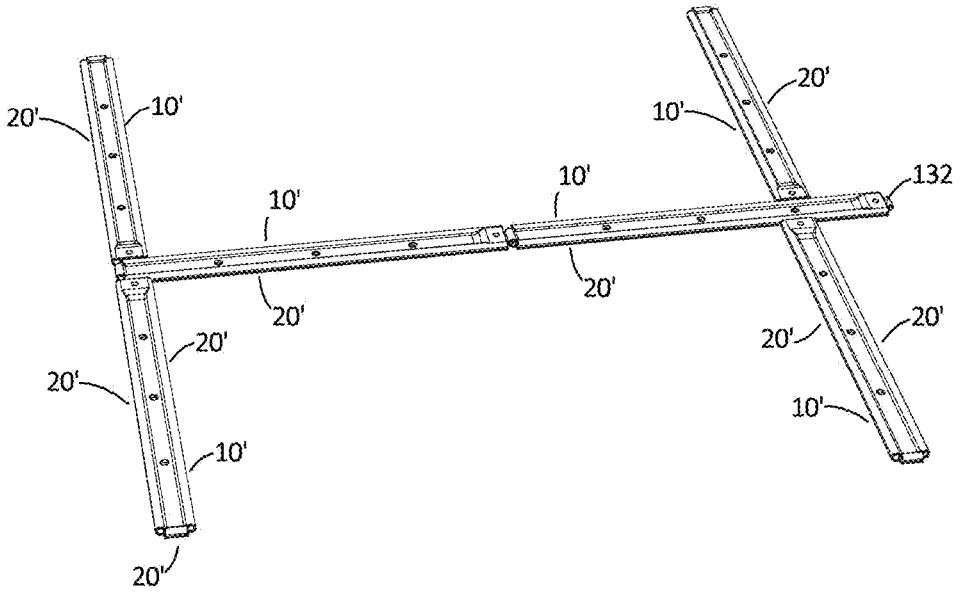
Figure 15:
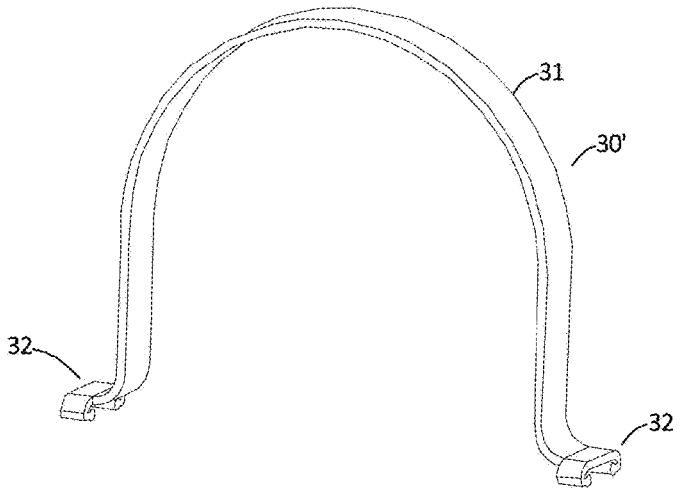
FIG. 15 is a perspective view of another exemplary hurdle strip component suitable for use in the agility ladders and agility ladder kits of the present invention.
Figure 16:
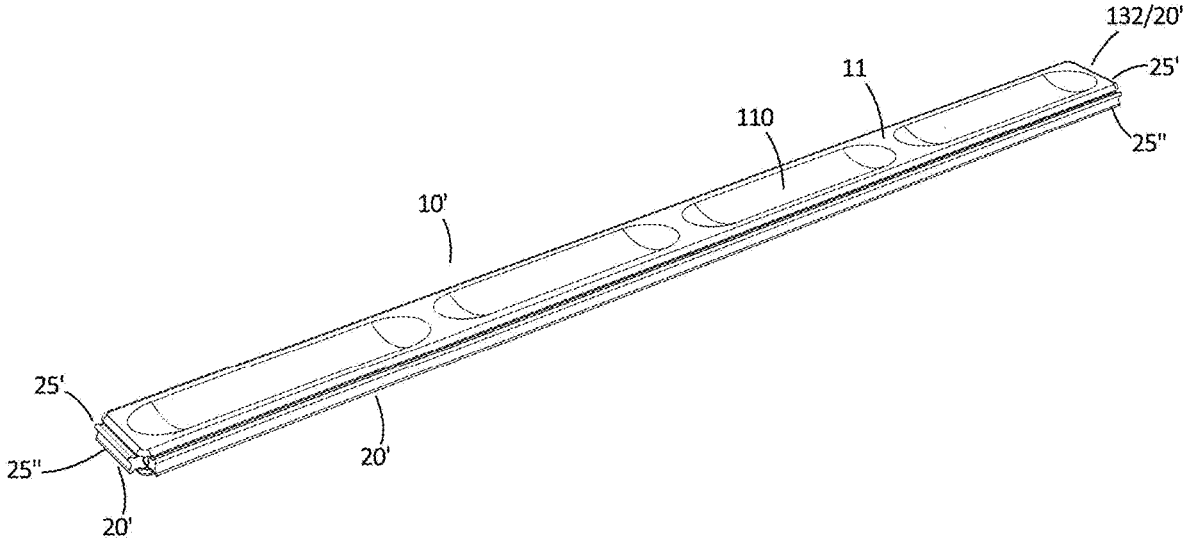
FIG. 16 is a perspective view of another exemplary agility ladder ground strip suitable for use in the agility ladders and agility ladder kits of the present invention.
Figure 17A:
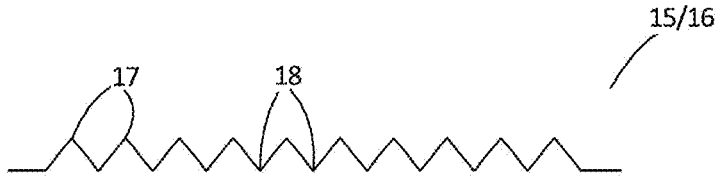
FIGS. 17A-17D depict various edge hills and edge valleys shapes/configurations suitable for use on outer edges of agility ladder ground strips of the present invention.
Figure 17B:
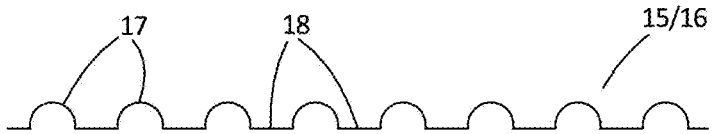
Figure 17C:
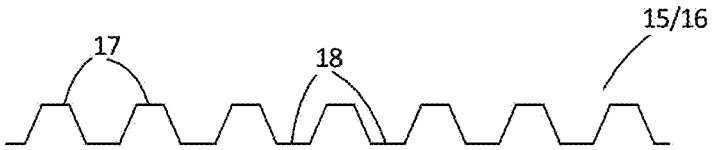
Figure 17D:
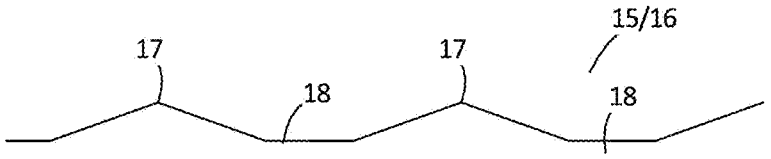

100. The agility ladder 100 of any one of embodiments 1 to 20 and 35 to 99, wherein each of the one or more agility ladder strip connectors 20 comprises one or more vertically-extending strip receiving openings 27. See, for example, exemplary agility ladder strip connectors 20 shown in FIGS. 11C-11D. Typically, when present, a given agility ladder strip connector 20 may comprise from one to eight, more typically, one, two or three vertically-extending strip receiving openings 27 extending upward along upper surface 21 of agility ladder strip connector 20. It should be noted that although the vertically-extending strip receiving openings 27 shown in FIGS. 11C-11D are oriented at a 90° angle to the horizontally-extending strip receiving openings 27 within exemplary agility ladder strip connectors 20 shown in FIGS. 11C-11D, each of the one or more vertically-extending strip receiving openings 27 may independently be oriented at any desired angle to the horizontally-extending strip receiving openings 27 (e.g., any angle of from about 100 to about 170°, in increments of 1.0°, such as 18°, and any range between about 100 and about 170°, in increments of 1.0°, such as from about 450 to about 135°.

101. The agility ladder 100 of any one of embodiments 1 to 20 and 35 to 100, wherein each of the one or more agility ladder strip connectors 20 comprises two or more vertically-extending strip receiving openings 27.

102. The agility ladder 100 of any one of embodiments 1 to 20 and 35 to 101, wherein each of the one or more agility ladder strip connectors 20 comprises two vertically-extending strip receiving openings 27.

103. The agility ladder 100 of any one of embodiments 1 to 20 and 35 to 102, wherein each of the one or more agility ladder strip connectors 20 comprises a single connector channel 28 extending from the first connector side edge 25 to the second connector side edge 26.

104. The agility ladder 100 of any one of embodiments 1 to 20 and 35 to 102, wherein each of the one or more agility ladder strip connectors 20 comprises two or more connector channels 28 extending from the first connector side edge 25 to the second connector side edge 26. Typically, a given agility ladder strip connector 20 may comprise from one to six, more typically, one or two connector channels 28 extending from the first connector side edge 25 to the second connector side edge 26. However, it is to be understood that a given agility ladder strip connector 20 may comprise any desired number of connector channels 28 extending from the first connector side edge 25 to the second connector side edge 26 depending on, for example, the overall size of the agility ladder strip connector 20.

105. The agility ladder 100 of any one of embodiments 1 to 20 and 35 to 102 and 104, wherein each of the one or more agility ladder strip connectors 20 comprises two connector channels 28 extending from the first connector side edge 25 to the second connector side edge 26.

106. The agility ladder 100 of any one of embodiments 1 to 20, 35 to 95, and 97 to 105, wherein each of the one or more agility ladder strip connectors 20 comprises a strip end stop 29 within each of the strip receiving openings 27 so that a given agility ladder ground strip end 13/14 extends a desired length into a given strip receiving opening 27.

107. The agility ladder 100 of any one of embodiments 1 to 20, 35 to 95, and 97 to 106, wherein each of the one or more agility ladder strip connectors 20 comprises a strip end stop 29 within each of the strip receiving openings 27 so that a given agility ladder ground strip end 13/14 extends into a given strip receiving opening 27 (i.e., an opening depth $O_D$) of from about 0.50 in (1.27 cm) to about 1.50 in (3.81 cm).

108. The agility ladder 100 of any one of embodiments 1 to 20, 35 to 95, and 97 to 107, wherein each of the one or more agility ladder strip connectors 20 comprises a strip end stop 29 within each of the strip receiving openings 27 so that a given agility ladder ground strip end 13/14 extends into a given strip receiving opening 27 (i.e., an opening depth $O_D$) of from about 0.6 in to about 1.4 in.

109. The agility ladder 100 of any one of embodiments 1 to 20, and 35 to 105, wherein each of the one or more agility ladder strip connectors 20 comprises one or more length-extending connector channels 270 extending from the first connector end 23 of said opposite connector ends 23/24 to the second connector end 24 of said opposite connector ends 23/24.

110. The agility ladder 100 of any one of embodiments 1 to 20, 35 to 105, and 109, wherein each of the one or more agility ladder strip connectors 20 comprises two or more length-extending connector channels 270 extending from the first connector end 23 of said opposite connector ends 23/24 to the second connector end 24 of said opposite connector ends 23/24. Typically, a given agility ladder strip connector 20 may comprise from one to six, more typically, one or two length-extending connector channels 270 extending from the first connector end 23 to the second connector end 24. However, it is to be understood that a given agility ladder strip connector 20 may comprise any desired number of length-extending connector channels 270 extending from the first connector end 23 to the second connector end 24 depending on, for example, the overall size of the agility ladder strip connector 20.

111. The agility ladder 100 of any one of embodiments 1 to 20, 35 to 105, and 109 to 110, wherein each of the one or more agility ladder strip connectors 20 comprises two or three length-extending connector channels 270 extending from the first connector end 23 of said opposite connector ends 23/24 to the second connector end 24 of said opposite connector ends 23/24.

112. The agility ladder 100 of any one of embodiments 1 to 20 and 35 to 111, wherein each of the one or more agility ladder strip connectors 20 comprises one or more opening strip engagement members 271 within each strip receiving opening 27, each of the one or more opening strip engagement members 271 being designed to engage with strip end 13/14 of a given agility ladder ground strip 10 extending into a given strip receiving opening 27.

113. The agility ladder 100 of any one of embodiments 1 to 20 and 35 to 112, wherein each of the one or more agility ladder strip connectors 20 comprises two or more opening strip engagement members 271 within each strip receiving opening 27.

114. The agility ladder 100 of any one of embodiments 1 to 20 and 35 to 113, wherein each of the one or more agility ladder strip connectors 20 comprises from two to six opening strip engagement members 271 within each strip receiving opening 27.

115. The agility ladder 100 of any one of embodiments 1 to 20 and 35 to 114, wherein each of the one or more agility ladder strip connectors 20 comprises four opening strip engagement members 271 within each strip receiving opening 27, with two opening strip engagement members 271 being along opposite opening side edges 272.

116. The agility ladder 100 of any one of embodiments 1 to 20, and 35 to 115, wherein each of the one or more agility ladder strip connectors 20 comprises four opening strip engagement members 271 within each strip receiving opening 27, with two opening strip engagement hill members 271' being along opposite opening side edges 272. As shown in FIG. 5B, each of opposite opening side edges 272 of strip receiving opening 27 comprises (i) two opening strip engagement hill members 271' separated by (ii) an intermediate sidewall valley $\mathbf{218}_I$, and bound by (iii) an opening intro valley $\mathbf{218}_O$, and (iv) an end sidewall valley $\mathbf{218}_E$ adjacent a strip end stop 29 of a given strip receiving opening 27. Such an opposite opening side edge configuration matches the hill 17/valley 18 wavy edge configuration at each of strip ends 13/14 to enable a strong, firm grip between an agility ladder ground strip 10 and a given connector opening 27. See again, FIG. 5B.

117. The agility ladder 100 of any one of embodiments 1 to 20, and 35 to 116, wherein each of the one or more agility ladder strip connectors 20 comprises one or more channel strip engagement members 281 within the at least one connector channel 28, each of the one or more channel strip engagement members 281 being designed to engage with opposite strip side edges 15/16 of a given agility ladder ground strip 10 extending through the connector channel 28. See again, FIGS. 5A-6B.

118. The agility ladder 100 of any one of embodiments 1 to 20, and 35 to 117, wherein each of the one or more agility ladder strip connectors 20 comprises two or more channel strip engagement members 281 within the connector channel 28, each of the two or more channel strip engagement members 281 being designed to engage with opposite strip side edges 15/16 of a given agility ladder ground strip 10 extending through the connector channel 28.

119. The agility ladder 100 of any one of embodiments 1 to 20, and 35 to 118, wherein each of the one or more agility ladder strip connectors 20 comprises from two to eight channel strip engagement members 281 within the connector channel 28, each of the two to eight channel strip engagement members 281 being designed to engage with opposite strip side edges 15/16 of a given agility ladder ground strip 10 extending through the connector channel 28.

120. The agility ladder 100 of any one of embodiments 1 to 20, and 35 to 119, wherein each of the one or more agility ladder strip connectors 20 comprises two channel strip engagement members 281 with a single channel strip engagement member 281 positioned along opposite channel sidewalls 282 within the connector channel 28, each of the two channel strip engagement members 281 being designed to engage with opposite strip side edges 15/16 of a given agility ladder ground strip 10 extending through the connector channel 28. See again, FIGS. 5A-6B.

Figure 39:
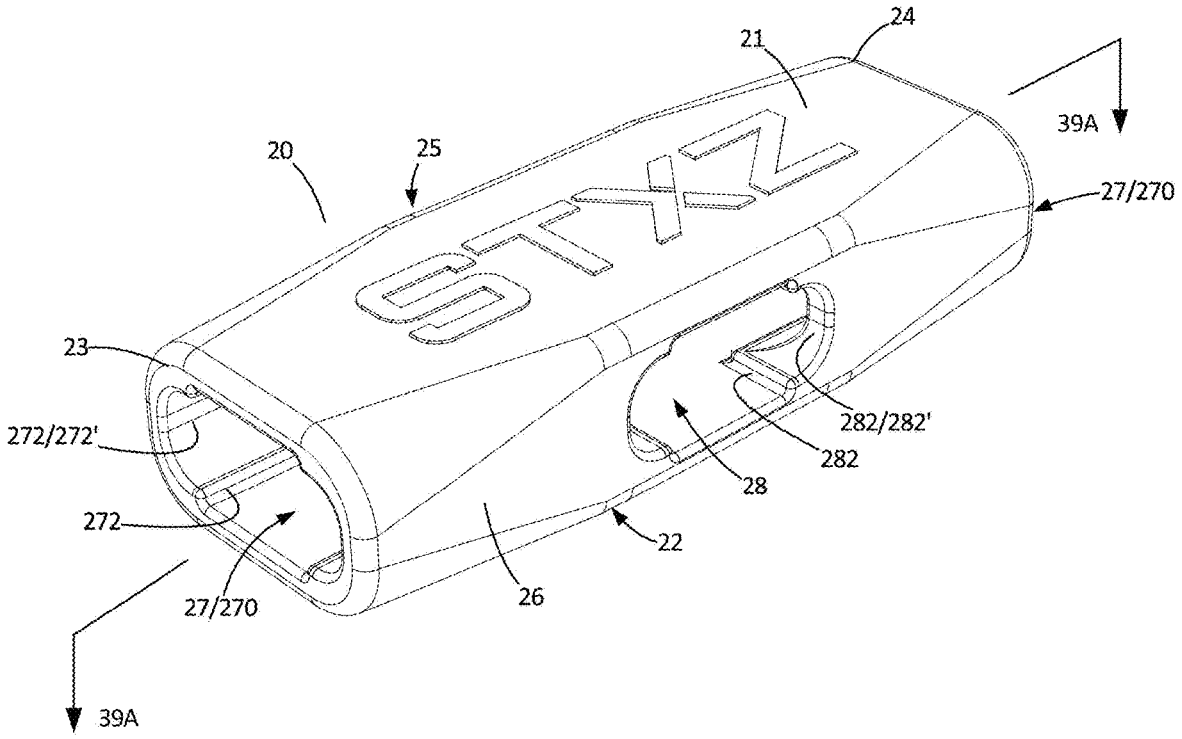
FIG. 39 is a perspective view of another exemplary agility ladder connector suitable for use in the agility ladders and agility ladder kits of the present invention.
Figure 39A:
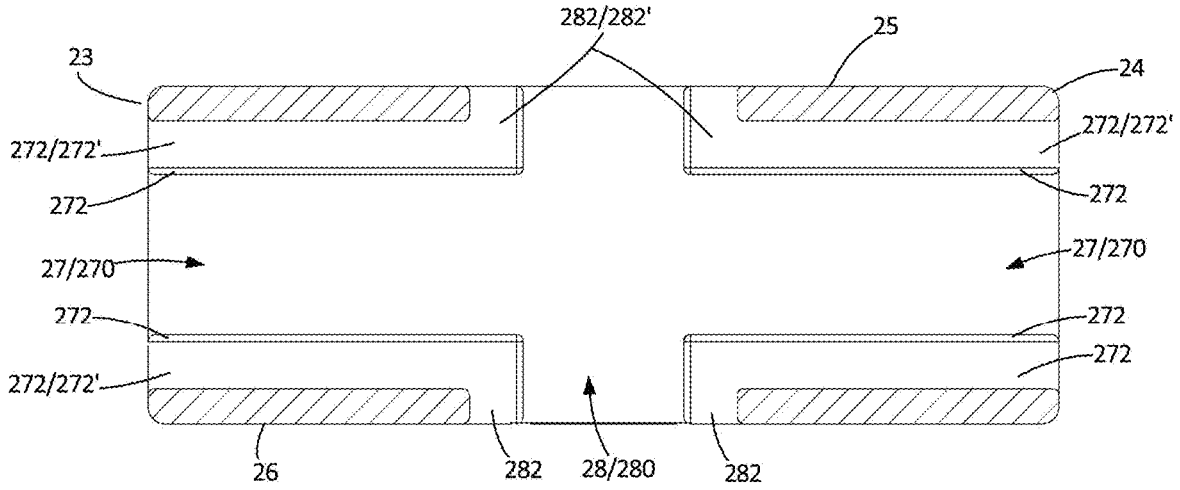
FIG. 39A is a cross-sectional view of the exemplary agility ladder connector shown in FIG. 39 as viewed along line 39A-39A in FIG. 39.
Figure 40:
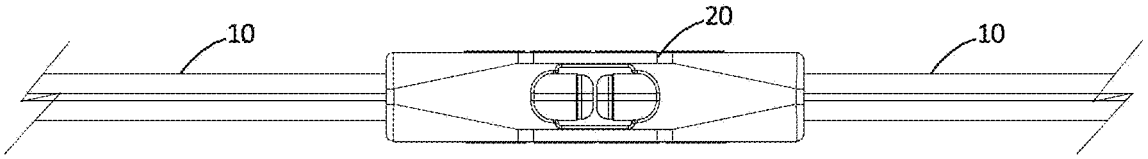
FIG. 40 is a side view of another exemplary agility ladder of the present invention formed by connecting two exemplary agility ladder ground strips shown in FIG. 36, connected to one another via the exemplary agility ladder connector shown in FIG. 39.

121. The agility ladder 100 of any one of embodiments 1 to 20, 35 to 105, and 109 to 120, wherein each of the one or more agility ladder strip connectors 20 comprises one or more length-extending connector channels 270 extending from the first connector end 23 of said opposite connector ends 23/24 to the second connector end 24 of said opposite connector ends 23/24, and each length-extending connector channel 270 comprises opposing channel side edge portions 272' that (i) extend along opposite side edges of the length-extending connector channel 270, and (ii) have opposing channel side edge profiles that mirror side edge profiles of the strip side edges 15/16 of a given agility ladder ground strip 10. See, for example, FIGS. 39-39A.

122. The agility ladder 100 of embodiment 121, wherein said opposing channel side edge portions 272' extend a complete length of each length-extending connector channel 270 except along a connector channel 28 extending through the agility ladder strip connector 20 and intersecting the length-extending connector channel 270. See, for example, FIG. 39A.

123. The agility ladder 100 of embodiment 121 or 122, wherein said opposing channel side edge portions 272' extend along from about 10.0% to 100% of a total side edge length of the side edge profiles of the length-extending connector channel 270. For example, in FIG. 39A, opposing channel side edge portions 272' extend along about 85% of a total side edge length of the side edge profile of the length-extending connector channel 270 shown in FIG. 39A.

124. The agility ladder 100 of any one of embodiments 121 to 123, wherein said opposing channel side edge portions 272' extend along from about 50.0% to 90% of a total side edge length of the side edge profile of the length-extending connector channel 270.

125. The agility ladder 100 of any one of embodiments 121 to 124, wherein said opposing channel side edge profiles comprise curved channel side edge profiles.

126. The agility ladder 100 of any one of embodiments 121 to 125, wherein said opposing channel side edge profiles comprise concave curved channel side edge profiles.

127. The agility ladder 100 of any one of embodiments 121 to 126, wherein the strip receiving openings 27 of each length-extending connector channel 270 have opening side edge profiles that mirror side edge profiles of the strip side edges 15/16 of a given agility ladder ground strip 10. See again, for example, FIGS. 38-38A.

128. The agility ladder 100 of any one of embodiments 121 to 127, wherein the strip receiving openings 27 of each length-extending connector channel 270 have (i) opening side edge profiles that mirror side edge profiles of the strip side edges 15/16 of a given agility ladder ground strip 10, and (ii) upper and lower edge profiles that do not mirror the upper strip major surface 11 and the lower strip major surface 12 of the agility ladder ground strip 10. See again, for example, FIGS. 38-38A.

129. The agility ladder 100 of any one of embodiments 121 to 128, wherein the strip receiving openings 27 of each length-extending connector channel 270 have (i) opening side edge profiles that mirror side edge profiles of the strip side edges 15/16 of a given agility ladder ground strip 10, and (ii) upper and lower edge profiles separated from one another by a maximum opening height $H_{MAXO}$ of each strip receiving opening 27. See again, for example, FIGS. 38-38A.

130. The agility ladder 100 of any one of embodiments 1 to 20, 35 to 105, and 109 to 129, wherein each of the one or more agility ladder strip connectors 20 comprises one or more width-extending connector channels 28 extending from the first connector side edge 25 to the second connector side edge 26, and each width-extending connector channel 28 comprises opposing channel side edge portions 282' that (i) extend along opposite side edges of the width-extending connector channels 28, and (ii) have opposing channel side edge profiles that mirror side edge profiles of the strip side edges 15/16 of a given agility ladder ground strip 10. See again, for example, FIGS. 39-39A.

131. The agility ladder 100 of embodiment 130, wherein said opposing channel side edge portions 282' extend a complete length of each width-extending connector channel 28 except along a length-extending connector channel 270 extending through the agility ladder strip connector 20 and intersecting the width-extending connector channels 28. See again, for example, FIG. 39A.

132. The agility ladder 100 of embodiment 130 or 131, wherein said opposing channel side edge portions 282' extend along from about 10.0% to 100% of a total side edge length of the side edge profile of the width-extending connector channel 28. For example, in FIG. 39A, opposing channel side edge portions 282' extend along about 50% of a total side edge length of the side edge profiles of the width-extending connector channel 28 shown in FIG. 39A.

133. The agility ladder 100 of any one of embodiments 130 to 132, wherein said opposing channel side edge portions 282' extend along from about 50.0% to 90% of a total side edge length of the side edge profile of the width-extending connector channel 28.

134. The agility ladder 100 of any one of embodiments 130 to 133, wherein said opposing channel side edge profiles of the width-extending connector channel 28 comprise curved channel side edge profiles.

135. The agility ladder 100 of any one of embodiments 130 to 134, wherein said opposing channel side edge profiles of the width-extending connector channel 28 comprise concave curved channel side edge profiles.

136. The agility ladder 100 of any one of embodiments 130 to 135, wherein the strip receiving openings 28' of each width-extending connector channel 28 have opening side edge profiles that mirror side edge profiles of the strip side edges 15/16 of a given agility ladder ground strip 10. See again, for example, FIGS. 38-38A.

137. The agility ladder 100 of any one of embodiments 130 to 136, wherein strip receiving openings 28' of each width-extending connector channel 28 have (i) opening side edge profiles that mirror side edge profiles of the strip side edges 15/16 of a given agility ladder ground strip 10, and (ii) upper and lower edge profiles that do not mirror the upper strip major surface 11 and the lower strip major surface 12 of the agility ladder ground strip 10. See again, for example, FIGS. 38-38A.

138. The agility ladder 100 of any one of embodiments 130 to 137, wherein the strip receiving openings 28' of each width-extending connector channel 28 have (i) opening side edge profiles that mirror side edge profiles of the strip side edges 15/16 of a given agility ladder ground strip 10, and (ii) upper and lower edge profiles separated from one another by a maximum opening height $H_{MAXO}$ of each strip receiving opening 28'. See again, for example, FIGS. 38-38A.

139. The agility ladder 100 of any one of embodiments 95 to 138, wherein each of (i) the upper connector major surface 21, (ii) the lower connector major surface 22, (iii) the opposite connector ends 23/24, (iv) the first connector side edge 25, and (v) the second connector side edge 26 independently has a rectangular shape. It should be understood that (i) the upper connector major surface 21, (ii) the lower connector major surface 22, (iii) the opposite connector ends 23/24, (iv) the first connector side edge 25, and (v) the second connector side edge 26 may independently have any desired shape (e.g., square, rectangular, planar (e.g., see upper surface 21 in FIG. 10A), non-planar (e.g., see upper surface 21 in FIGS. 11D and 39), etc.).

140. The agility ladder 100 of any one of embodiments 95 to 139, wherein each of the strip receiving openings 27 has a rectangular opening shape, and the connector channel 28 has a rectangular opening shape. It should be understood that the strip receiving openings 27 and the connector channel 28 may independently have any desired shape opening (e.g., square, rectangular, star-shaped, etc.) as long as the strip receiving openings 27 and the connector channel 28 have an opening shape that enables attachment of a given agility ladder ground strip 10 therein.

141. The agility ladder 100 of any one of embodiments 95 to 139, wherein each of the strip receiving openings 27 has a modified rectangular opening shape, and the connector channel 28 has a modified rectangular opening shape, wherein the modified rectangular opening shape comprises (i) opposing curve-containing side edges, and opposing upper and lower edges that are substantially flat and parallel to one another. See again, FIG. 39.

142. The agility ladder 100 of any one of embodiments 95 to 141, wherein each of the strip receiving openings 27 has a first opening shape that provides one or more connector contacting points/surfaces 272' for strip contact points 102 along a given agility ladder ground strip 10, and the connector channel 28 has a second opening shape that provides one or more connector contacting points/surfaces 282' for strip contact points 102 along the given agility ladder ground strip 10, wherein the first and second opening shapes independently comprise any shape that accepts a given agility ladder ground strip 10. See, for example, exemplary opening shapes for (i) strip receiving openings 27, and (ii) openings for connector channel 28 shown in FIGS. 43A-43J.

143. The agility ladder 100 of any one of embodiments 1 to 20 and 35 to 142, wherein each of the one or more agility ladder strip connectors 20 independently has a connector length $L_C$ of from about 2.5 in (6.35 cm) to about 6.0 in (15.24 cm), a connector width Wc of from about 1.0 in (2.54 cm) to about 3.5 in (8.89 cm), and a connector thickness Tc of from about 0.50 in (1.27 cm) to about 6.0 in (15.24 cm).

144. The agility ladder 100 of any one of embodiments 1 to 20 and 35 to 143, wherein each of the one or more agility ladder strip connectors 20 independently has a connector length $L_C$ of from about 3.0 in (7.62 cm) to about 4.0 in (10.16 cm), a connector width Wc of from about 1.25 in (3.17 cm) to about 2.0 in (5.08 cm), and a connector thickness Tc of from about 0.6 in (1.52 cm) to about 1.5 in 3.81 cm).

145. The agility ladder 100 of any one of embodiments 1 to 144, wherein each of the one or more agility ladder strip connectors 20/20' independently comprises a polymeric material, an elastomeric material, or any combination thereof.

146. The agility ladder 100 of any one of embodiments 1 to 145, wherein each of the one or more agility ladder strip connectors 20/20' independently comprises a fiber-reinforced polymeric material, a fiber-reinforced elastomeric material, or any combination thereof.

147. The agility ladder 100 of any one of embodiments 1 to 146, wherein each of the one or more agility ladder strip connectors 20/20' independently comprises a rubber. For example, a preferred rubber comprises an EPDM rubber (ethylene propylene diene monomer rubber).

148. The agility ladder 100 of any one of embodiments 1 to 147, wherein each of the one or more agility ladder strip connectors 20/20' provides anti-slip properties to the agility ladder. For example, when the one or more agility ladder strip connectors 20/20' independently comprise a rubber, the resulting agility ladder 100 remains fixed to a gym floor (or similar flooring) due to the anti-slip properties of the rubber.

149. The agility ladder 100 of any one of embodiments 1 to 9, 21 to 94, and 145 to 148, wherein each of the one or more agility ladder ground strips 10' comprises a first polymeric material, and each of the agility ladder strip connectors 20' comprises a second polymeric material.

150. The agility ladder 100 of embodiment 149, wherein the first polymeric material, and the second polymeric material are identical.

151. The agility ladder 100 of embodiment 149 or 150, wherein each of the agility ladder strip connectors 20' are integrally connected to the opposite side edges 15/16 of a given agility ladder ground strip 10'.

152. The agility ladder 100 of any one of embodiments 149 to 151, wherein the connecting member 130 comprises a third polymeric material or an elastomeric material.

153. The agility ladder 100 of any one of embodiments 149 to 152, wherein the connecting member 130 comprises an elastomeric material.

154. The agility ladder 100 of any one of embodiments 149 to 153, wherein the connecting member 130 comprises a rubber. For example, a preferred rubber comprises an EPDM rubber (ethylene propylene diene monome rubber).

155. The agility ladder 100 of any one of embodiments 1 to 9, 21 to 94, and 145 to 155, wherein each of the one or more agility ladder ground strips 10' comprises a first polymeric material, and each of the agility ladder strip connectors 20' comprises an elastomeric material.

156. The agility ladder 100 of embodiment 155, wherein the elastomeric material comprises a rubber. Again, a preferred rubber comprises an EPDM rubber (ethylene propylene diene monomer rubber).

157. The agility ladder 100 of any one of embodiments 1 to 156, wherein each of the one or more agility ladder strip connectors 20 contacts a ground surface, while the one or more agility ladder ground strips 10, are suspended above the ground surface via connection to the one or more agility ladder strip connectors 20.

158. The agility ladder 100 of any one of embodiments 1 to 157, further comprising one or more hurdle strip components 30, wherein each hurdle strip component 30 extends from one agility ladder strip connector 20 to another agility ladder strip connector 20 above an agility ladder ground strip 10.

159. The agility ladder 100 of any one of embodiments 1 to 158, further comprising from two to 50 hurdle strip components 30, wherein each hurdle strip component 30 extends from one agility ladder strip connector 20 to another agility ladder strip connector 20 above an agility ladder ground strip 10. It should be understood that a given agility ladder 100 may comprise any number of hurdle strip components 30.

160. The agility ladder 100 of embodiment 158 or 159, wherein each of the one or more hurdle strip components 30 comprises (i) a hurdle strip body 31, and (ii) hurdle connecting feet 32 extending angularly from each end 33 of the hurdle strip body 31. For example, the two hurdle connecting feet 32 may independently be angularly oriented to each end 33 of the hurdle strip body 31 by an angle ranging from about 30 degrees (°) to about 90° (or any other angle).

161. The agility ladder 100 of embodiment 160, wherein each of the two hurdle connecting feet 32 is angularly oriented to each end 33 of the hurdle strip body 31 by an angle of about 90°.

162. The agility ladder 100 of any one of embodiments 158 to 161, wherein each of the one or more hurdle strip components 30 independently has a hurdle strip component length $L_H$ of from about 12.0 in (30.48 cm) to about 48.0 in (121.92 cm), a hurdle strip component width $W_H$ of from about 0.5 in (1.27 cm) to about 3.0 in (7.62 cm), and a hurdle strip component thickness $T_H$ of from about 0.10 in (0.25 cm) to about 0.30 in (0.76 cm).

163. The agility ladder 100 of any one of embodiments 158 to 162, wherein each of the one or more hurdle strip components 30 independently has a hurdle strip component length $L_H$ of from about 18.0 in (45.72 cm) to about 24.0 in (60.96 cm), a hurdle strip component width $W_H$ of from about 0.5 in (1.27 cm) to about 1.0 in (2.54 cm), and a hurdle strip component thickness $T_H$ of from about 0.10 in (0.25 cm) to about 0.30 in (0.76 cm).

164. The agility ladder 100 of any one of embodiments 158 to 163, wherein each of the one or more hurdle strip components 30 independently comprises a polymeric material.

165. The agility ladder 100 of any one of embodiments 158 to 164, wherein each of the one or more hurdle strip components 30 independently comprises a fiber-reinforced polymeric material.

166. The agility ladder 100 of any one of embodiments 158 to 165, wherein each of the one or more hurdle strip components 30 independently comprises a polypropylene, a polyethylene, a high-density polyethylene, a polyvinyl chloride (PVC), a nylon, an acetal or polyacetal, or any combination thereof.

167. The agility ladder 100 of any one of embodiments 158 to 166, wherein each of the one or more hurdle strip components 30 independently comprises a polyethylene or a polyvinyl chloride (PVC).

168. The agility ladder 100 of any one of embodiments 1 to 167, further comprising any additional component that is attachable to (i) the one or more agility ladder ground strips 10/10', (ii) the one or more agility ladder strip connectors 20/20', or (iii) both (i) and (ii).

169. The agility ladder 100 of embodiment 168, wherein the any additional component comprises one or more of (a) a spike component, such as exemplary spike component 80 shown in FIG. 9 with (i) a connecting component 83 facing upward and away from (ii) a ground spike portion 85 of the exemplary spike component 80; (b) a six-connector component, such as exemplary six-connector component 82 shown in FIG. 11A, with six horizontally-extending connectors 83/83$_H$ extending outward from a center point 89, and various apertures 87 extending through the exemplary six-connector component 82; (c) a nine-connector component, such as exemplary nine-connector component 84 shown in FIG. 11B, with eight horizontally-extending connectors 83/83$_H$ extending outward from a center point 89, and a single vertically-extending connector 83/83$_V$ extending upward from the center point 89; (d) an agility ladder strip connector 20, such as exemplary agility ladder strip connector 20 shown in FIG. 11C, with two horizontally-extending strip receiving openings 27, two vertically-extending strip receiving openings 27, and a horizontally-extending connector channel 28 extending therethrough, wherein the horizontally-extending connector channel 28 is substantially (or exactly) perpendicular with the two vertically-extending strip receiving openings 27 (i.e., one or more strips 10 extend thru the horizontally-extending connector channel 28 in a direction that is perpendicular with a strip width Ws of one or more strips 10 within the two vertically-extending strip receiving openings 27); (e) a agility ladder strip connector 20, such as exemplary agility ladder strip connector 20 shown in FIG. 11D, with two horizontally-extending strip receiving openings 27, two vertically-extending strip receiving openings 27, and a horizontally-extending connector channel 28 extending therethrough, wherein the horizontally-extending connector channel 28 is substantially (or exactly) parallel with the two vertically-extending strip receiving openings 27 (i.e., one or more strips 10 extend thru the horizontally-extending connector channel 28 in a direction that is parallel with a strip width Ws of one or more strips 10 within the two vertically-extending strip receiving openings 27); (f) an agility ladder strip connector 20, such as exemplary agility ladder strip connector 20 shown in FIG. 10A, with two strip receiving openings 27 at each connector end 23/24, and a single connector channel 28 extending therethrough; (g) an agility ladder strip connector 20, such as exemplary agility ladder strip connector 20 shown in FIG. 10F, with two strip receiving openings 27 at each connector end 23/24, and two connector channels 28 extending therethrough; (h) a plug connecting component 821, such as exemplary plug connecting component 820 shown in FIG. 41; (i) a plug connector spike component 820, such as exemplary plug connector spike component 820 shown in FIG. 42A with (i) a plug connecting component 821 connecting to an end edge 19 of a strip 10, and (ii) a ground spike portion 85 connected to and extending from the plug connecting component 821, and (j) a spike component 828, such as exemplary spike component 828 shown in FIG. 42B comprising an exemplary ground spike portion 85 overmolded and integrally connected to one end 19 of an exemplary agility ladder ground strip 10. It should be further noted that each of the (i) horizontally-extending strip receiving openings 27, (ii) vertically-extending strip receiving openings 27, and (iii) horizontally-extending connector channels 28 shown in in FIGS. 10A-10F, 11C-11D, 40-40A, and 43A-43J may have features, configurations, and dimensions as discussed above, and as shown in FIGS. 5A-6B, 40-40A, and 43A-43J.

Agility Ladder Components

Agility Ladder Ground Strips 10

170. An agility ladder ground strip 10 suitable for use in an agility ladder 100, said agility ladder ground strip 10 comprising: an upper strip major surface 11, a lower strip major surface 12 opposite the upper strip major surface 11, opposite strip ends 13/14 separated by a strip length Ls, and opposite strip side edges 15/16 separated by a strip width Ws, wherein each of the opposite strip side edges 15/16 comprises alternating edge hills 17 and edge valleys 18 such that the strip width Ws varies along the strip length Ls.

171. The agility ladder ground strip 10 of embodiment 170, wherein said agility ladder ground strip 10 comprises one or more features recited in one or more of embodiments 9-20, 74-94, and 157.

172. An agility ladder ground strip 10 suitable for use in an agility ladder 100, said agility ladder ground strip 10 comprising: an upper strip major surface 11, a lower strip major surface 12 opposite the upper strip major surface 11, opposite strip ends 13/14 separated by a strip length Ls, and opposite strip side edges 15/16 separated by a strip width Ws, wherein opposite strip side edges 15/16 have a straight, parallel configuration such that the strip width Ws is substantially constant or constant along at least a portion of the strip length Ls (e.g., from 10% up to 100% of the strip length Ls). See again, FIG. 36.

173. The agility ladder ground strip 10 of embodiment 172, wherein at least one of (i) upper strip edge features along the upper strip major surface 11, (ii) lower strip edge features along the lower strip major surface 12, and (iii) opposite strip side edge features along the opposite strip side edges 15/16, when present, (a) extends along at least a portion of the strip length Ls (or all of the strip length Ls), and (b) has (i) some amount of curvature therein (e.g., curvature extending along and within a side edge, such as the wavy edge configuration or the curved profile configuration, or extending along upper and/or lower surfaces, such as the opposing curved profiles along the upper and/or lower surfaces discussed below in references to FIGS. 36-38), and/or (ii) a combination of the upper strip major surface 11, the lower strip major surface 12, and the opposite strip side edges 15/16 either (a) separated from one another by angles other than 90° (see, FIGS. 37A and 37D), or (b) separated from one another by more than four 90° angles (see, FIG. 37E, which depicts a cross-sectional configuration with 12 90° angles therein). As noted above, the (i) upper strip edge features along the upper strip major surface 11, (ii) lower strip edge features along the lower strip major surface 12, and/or (iii) opposite strip side edge features along the opposite strip side edges 15/16, when present, may also provide one or more connector channel surface contact points 102 along at least a portion of the strip length Ls (or all of the strip length Ls)(i.e., points that contact surfaces 272' and 282', discussed below, within channel 28 or channel 270).

174. An agility ladder ground strip 10 suitable for use in an agility ladder 100, said agility ladder ground strip 10 comprising: an upper strip major surface 11, a lower strip major surface 12 opposite the upper strip major surface 11, opposite strip ends 13/14 separated by a strip length Ls, and opposite strip side edges 15/16 separated by a strip width Ws, wherein opposite strip side edges 15/16 have a straight, parallel configuration such that the strip width Ws is substantially constant or constant along at least a portion of the strip length Ls (e.g., from 10% up to 100% of the strip length Ls), and wherein at least one of (i) upper strip edge features along the upper strip major surface 11, (ii) lower strip edge features along the lower strip major surface 12, and (iii) opposite strip side edge features along the opposite strip side edges 15/16, when present, (a) extends along at least a portion of the strip length Ls (e.g., from 10% up to 100% of the strip length Ls), and (b) has (i) some amount of curvature therein (e.g., curvature extending along and within a side edge, or extending along upper and/or lower surfaces, such as the opposing curved profiles along the upper and/or lower surfaces shown in FIGS. 36-37J), and/or (ii) a combination of the upper strip major surface 11, the lower strip major surface 12, and the opposite strip side edges 15/16 is either (a) separated from one another by angles other than 90° (see, FIGS. 37A and 37D), or (b) separated from one another by more than four 90° angles (see, FIG. 37E, which depicts a cross-sectional configuration with 12 90° angles therein).

175. The agility ladder ground strip 10 of any one of embodiments 170 to 174, wherein each of the one or more agility ladder ground strips 10 independently comprises one or more hollow sections 135 extending along the strip length Ls.

176. The agility ladder ground strip 10 of any one of embodiments 170 to 175, wherein said agility ladder ground strip 10 comprises one or more strip end openings 135 extending within one or more of opposite strip ends 13/14. See, for example, FIGS. 36A-36B, 37F, 37I, and 37J. It should be understood that a given agility ladder ground strip 10 could have any number of strip end openings 135 within each of opposite strip ends 13/14. Typically, when present, a given agility ladder ground strip 10 has less than four strip end openings 135 within each of opposite strip ends 13/14.

177. The agility ladder ground strip 10 of any one of embodiments 170 to 176, wherein said agility ladder ground strip 10 comprises one or more strip end openings 135 extending within each of opposite strip ends 13/14.

178. The agility ladder ground strip 10 of embodiment 176 or 177, wherein each of the one or more strip end openings 135 independently extends a strip opening distance $d_{SO}$ from opposite strip end 13/14 into said agility ladder ground strip 10 along the strip length Ls, wherein each strip opening distance $d_{SO}$ independently ranges from about 0.2 inch (in) to the entire strip length Ls. It should be understood that each strip opening distance $d_{SO}$ may independently have any length along the strip length Ls, for example, from 10% of the overall strip length Ls up to 100% of the overall strip length Ls.

179. The agility ladder ground strip 10 of any one of embodiments 176 to 178, wherein said agility ladder ground strip 10 comprises one or more strip end openings 135 extending within each of opposite strip ends 13/14, and each strip end opening 135 at strip end 13 connects with a corresponding strip end opening 135 at strip end 14 to form a length-extending strip channel 138 extending from strip end 13 of said agility ladder ground strip 10 to strip end 14 of said agility ladder ground strip 10.

180. The agility ladder ground strip 10 of any one of embodiments 176 to 179, wherein said one or more strip end openings 135 comprises from about one to eight strip end openings 135. In this case, the agility ladder ground strip 10 could have from about one to eight length-extending strip channels 138 extending from strip end 13 to strip end 14 of the agility ladder ground strip 10.

181. The agility ladder ground strip 10 of any one of embodiments 176 to 180, wherein said one or more strip end openings 135 comprises from about two to four strip end openings 135. See again, for example, (1) exemplary agility ladder ground strip 10 with four length-extending strip channels 138 (and four strip end openings 135) shown in FIG. 36A, and (2) exemplary agility ladder ground strip 10 with three length-extending strip channels 138 (and three strip end openings 135) shown in FIG. 36B, with a centrally-located circular length-extending strip channel 138 (and centrally-located circular strip end opening 135), and length-extending strip channels 138 (and strip end openings 135) on opposite sides of the centrally-located circular length-extending strip channel 138 (and centrally-located circular strip end opening 135).

182. The agility ladder ground strip 10 of any one of embodiments 176 to 181, wherein said one or more strip end openings 135 comprises three strip end openings 135, with a centrally-located circular strip end opening 135, and strip end openings 135 on opposite sides of the centrally-located circular strip end opening 135. See again, FIG. 36B.

183. The agility ladder ground strip 10 of any one of embodiments 170 to 182, wherein said agility ladder ground strip 10 comprises one or more features recited in one or more of embodiments 9-11, 35-94, and 157.

Agility Ladder Ground Strips 10'

184. An agility ladder ground strip 10', said agility ladder ground strip 10' comprising an upper strip major surface 11, a lower strip major surface 12 opposite the upper strip major surface 11, opposite strip ends 13/14 separated by a strip length Ls, and opposite strip side edges 15/16 separated by a strip width Ws, wherein each of the opposite strip side edges 15/16 comprises one or more agility ladder strip connectors 20' extending thereon, each agility ladder strip connector 20' being capable of connecting to two or more additional agility ladder ground strips 10'.

185. The agility ladder ground strip 10' of embodiment 184, wherein said agility ladder ground strip 10 comprises one or more features recited in one or more of embodiments 9-11, 21-48, 74-94, and 149-157.

Agility Ladder Strip Connectors 20

186. An agility ladder strip connector 20 suitable for use in an agility ladder 100, said agility ladder strip connector 20 comprising: (i) an upper connector major surface 21, (ii) a lower connector major surface 22 opposite the upper connector major surface 21, (iii) opposite connector ends 23/24 separated by a connector length Lc, (iv) a first connector side edge 25 extending between the opposite connector ends 23/24, (v) a second connector side edge 26 opposite the first connector side edge 23/24, and being separated from the first connector side edge 25 by a connector width Wc, (vi) at least one strip receiving opening 27 within each of the opposite connector ends 23/24 with each strip receiving opening 27 sized to receive a strip end 13/14 of a given agility ladder ground strip 10, and (vii) at least one connector channel 28 extending from the first connector side edge 25 to the second connector side edge 26.

187. The agility ladder strip connector 20 of embodiment 186, wherein the agility ladder strip connector 20 comprises a single connector channel 28 extending from the first connector side edge 25 to the second connector side edge 26.

188. The agility ladder strip connector 20 of embodiment 186 or 187, wherein the agility ladder strip connector 20 comprises two or more connector channels 28 extending from the first connector side edge 25 to the second connector side edge 26. As discussed above, typically, a given agility ladder strip connector 20 may comprise from one to six, more typically, one or two connector channels 28 extending from the first connector side edge 25 to the second connector side edge 26. As discussed above, a given agility ladder strip connector 20 may comprise any desired number of connector channels 28 extending from the first connector side edge 25 to the second connector side edge 26 depending on, for example, the overall size of the agility ladder strip connector 20.

189. The agility ladder strip connector 20 of any one of embodiments 186 to 188, wherein the agility ladder strip connector 20 comprises a strip end stop 29 within one or more of the strip receiving openings 27 so that a given agility ladder ground strip end 13/14 extends a desired length into a given strip receiving opening 27.

190. The agility ladder strip connector 20 of any one of embodiments 186 to 189, wherein the agility ladder strip connector 20 comprises one or more length-extending connector channels 270 extending from a first connector end 23 of said opposite connector ends 23/24 to a second connector end 24 of said opposite connector ends 23/24.

191. The agility ladder strip connector 20 of any one of embodiments 186 to 190, wherein the agility ladder strip connector 20 comprises a single length-extending connector channel 270 extending from a first connector end 23 of said opposite connector ends 23/24 to a second connector end 24 of said opposite connector ends 23/24.

192. The agility ladder strip connector 20 of any one of embodiments 186 to 191, wherein each of (i) the upper connector major surface 21, (ii) the lower connector major surface 22, (iii) the opposite connector ends 23/24, (iv) the first connector side edge 25, and (v) the second connector side edge 26 independently has a rectangular shape. It should be understood that (i) the upper connector major surface 21, (ii) the lower connector major surface 22, (iii) the opposite connector ends 23/24, (iv) the first connector side edge 25, and (v) the second connector side edge 26 may independently have any desired shape (e.g., square, rectangular, etc.).

193. The agility ladder strip connector 20 of any one of embodiments 186 to 192, wherein said agility ladder strip connector 20 has a cross-sectional configuration such that when dissected along a centrally located vertically-extending plane $P_V$, the cross-sectional configuration comprise two mirror images of each other (i.e., two connector halves, namely, a left-side portion and a right-side portion that are mirror images of each other). See, for example, exemplary agility ladder strip connectors 20 with channels 28/270 therein shown in FIGS. 43A-43J.

194. The agility ladder strip connector 20 of any one of embodiments 186 to 193, wherein said agility ladder strip connector 20 has a cross-sectional configuration such that when dissected along a centrally located horizontally-extending plane $P_H$, the cross-sectional configuration comprise two mirror images of each other (i.e., two connector halves, namely, an upper-side portion and a lower-side portion that are mirror images of each other). See again, exemplary compatible agility ladder strip connectors 20 with channels 28/270 therein shown in FIGS. 43D-43F, and 43I-43J.

195. The agility ladder strip connector 20 of any one of embodiments 186 to 194, wherein the agility ladder strip connector 20 independently comprises a rubber. For example, a preferred rubber comprises an EPDM rubber (ethylene propylene diene monomer rubber).

196. The agility ladder strip connector 20 of any one of embodiments 186 to 195, wherein the agility ladder strip connector 20 comprises one or more of features recited and/or described in one or more of embodiments 95-148, and 157.

Hurdle Strip Components 30/30'

197. A hurdle strip component 30/30' suitable for use in an agility ladder 100, said hurdle strip component 30/30' comprising: (i) a hurdle strip body 31, and (ii) two hurdle connecting feet 32 extending angularly from each end 33 of the hurdle strip body 31. For example, the two hurdle connecting feet 32 may independently be angularly oriented to each end 33 of the hurdle strip body 31 by an angle ranging from about 30 degrees (°) to about 90° (or any other angle). See, for example, FIGS. 4, 8, and 15.

198. The hurdle strip component 30/30' of embodiment 197, wherein the said hurdle strip component 30/30' comprises one or more features recited and/or described in one or more of embodiments 158 to 167.

Other Possible Components

199. A spike component, such as exemplary spike component 80 shown in FIG. 9, said spike component 80 comprising: (i) a connecting component 83 facing upward and away from (ii) a ground spike portion 85 of the exemplary spike component 80. It should be noted that connecting component 83 may have, and desirably has, a connection configuration that is identical to the connection configuration at opposite ends 13/14 of the above-described agility ladder ground strip 10/10'.

200. A six-connector component, such as exemplary six-connector component 82 shown in FIG. 11A, said six-connector component 82 comprising: six horizontally-extending connectors 83/83$_H$ extending outward from a center point 89, and various apertures 87 extending through the exemplary six-connector component 82. It should be noted that each of the six horizontally-extending connectors 83/83$_H$ may have, and desirably has, a connection configuration that is identical to the connection configuration at opposite ends 13/14 of the above-described agility ladder ground strip 10/10'.

201. A nine-connector component, such as exemplary nine-connector component 84 shown in FIG. 11B, said nine-connector component 84 comprising: eight horizontally-extending connectors 83/83$_H$ extending outward from a center point 89, and a single vertically-extending connector 83/83$_V$ extending upward from the center point 89. It should be noted that each of the eight horizontally-extending connectors 83/83$_H$, and the single vertically-extending connector 83/83$_V$, may have, and desirably has, a connection configuration that is identical to the connection configuration at opposite ends 13/14 of the above-described agility ladder ground strip 10/10'.

202. An agility ladder strip connector, such as exemplary agility ladder strip connector 20 shown in FIG. 11C and exemplary agility ladder strip connector 20 shown in FIG. 11D, said agility ladder strip connector 20 comprising: two horizontally-extending strip receiving openings 27, two vertically-extending strip receiving openings 27, and a horizontally-extending connector channel 28 extending therethrough.

203. The agility ladder strip connector 20 of embodiment 202, wherein the horizontally-extending connector channel 28 is substantially (or exactly) perpendicular with the two vertically-extending strip receiving openings 27 (i.e., one or more strips 10 extend thru the horizontally-extending connector channel 28 in a direction that is perpendicular with a strip width Ws of one or more strips 10 within the two vertically-extending strip receiving openings 27). See, for example, exemplary agility ladder strip connector 20 shown in FIG. 11C.

204. The agility ladder strip connector 20 of embodiment 202, wherein the horizontally-extending connector channel 28 is substantially (or exactly) parallel with the two vertically-extending strip receiving openings 27 (i.e., one or more strips 10 extend thru the horizontally-extending connector channel 28 in a direction that is parallel with a strip width Ws of one or more strips 10 within the two vertically-extending strip receiving openings 27). See, for example, exemplary agility ladder strip connector 20 shown in FIG. 11D. It should be noted that each of the two horizontally-extending strip receiving openings 27, two vertically-extending strip receiving openings 27, and a horizontally-extending connector channel 28 may have features, configurations, and dimensions as discussed above, and as shown in FIGS. 5A-6B and 10E.

205. An agility ladder strip connector, such as exemplary agility ladder strip connector 20 shown in FIG. 10A, said agility ladder strip connector comprising: two strip receiving openings 27 at each connector end 23/24, and a single connector channel 28 extending therethrough. It should be noted that each of the strip receiving openings 27, and the connector channel(s) 28 may have features, configurations, and dimensions as discussed above, and as shown in FIGS. 5A-6B and 10E.

206. An agility ladder strip connector, such as exemplary agility ladder strip connector 20 shown in FIG. 10F, said agility ladder strip connector comprising: two strip receiving openings 27 at each connector end 23/24, and two connector channels 28 extending therethrough. It should be noted that each of the strip receiving openings 27, and the connector channel(s) 28 may have features, configurations, and dimensions as discussed above, and as shown in FIGS. 5A-6B and 10E.

Figure 41:
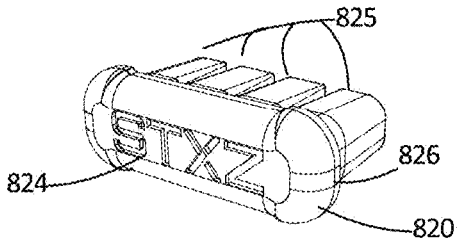
FIG. 41 is a perspective view of an exemplary agility ladder plug suitable for use in the agility ladders and agility ladder kits of the present invention.
Figure 42A:
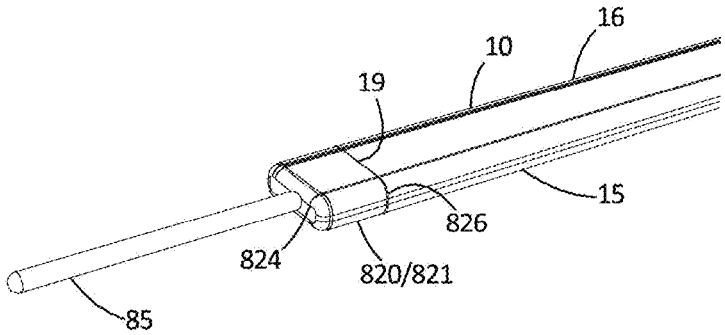
FIG. 42A is a perspective view of an exemplary agility ladder plug connector and an exemplary metal stake connected to the exemplary agility ladder plug connector, both of which being suitable for use in the agility ladders and agility ladder kits of the present invention.
Figure 42B:
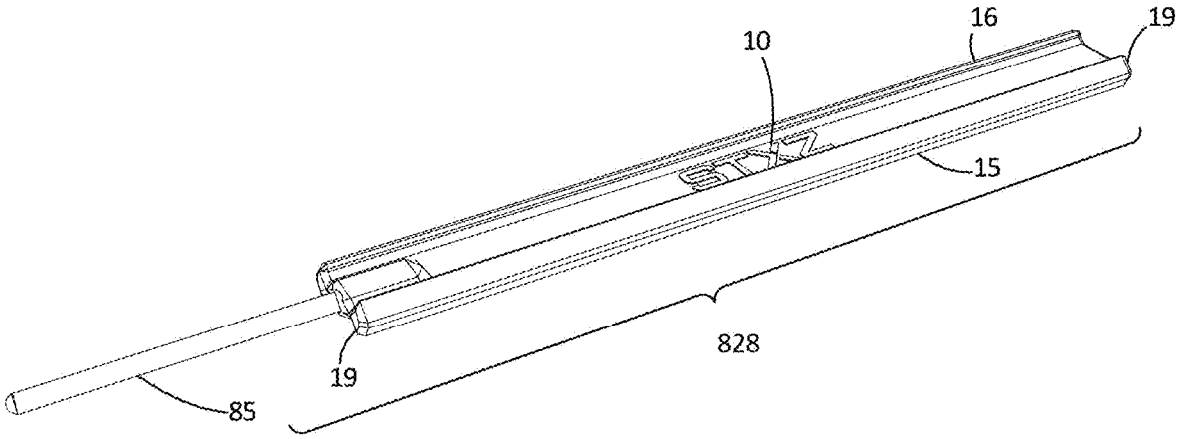
FIG. 42B is a perspective view of an exemplary agility ladder spike component comprising an exemplary metal stake overmolded and integrally connected to one end of an exemplary agility ladder ground strip of the present invention.
Figure 43A:
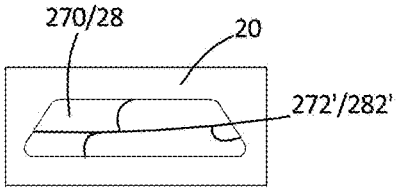
FIGS. 43A-43J depict other possible openings shapes for openings and channels extending through agility ladder connectors of the present invention.
Figure 43B:
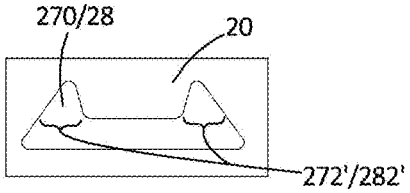
Figure 43C:
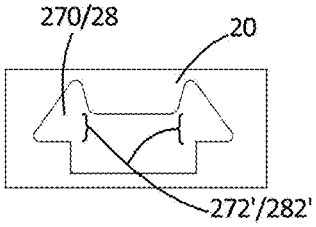
Figure 43D:
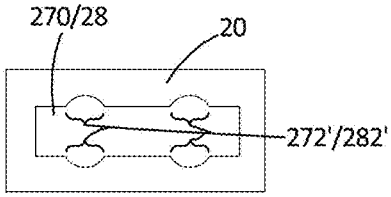
Figure 43E:
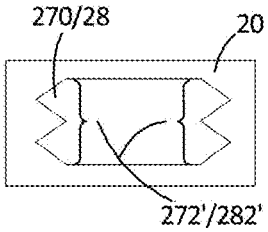
Figure 43F:
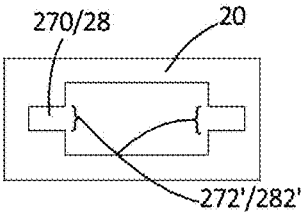
Figure 43G:
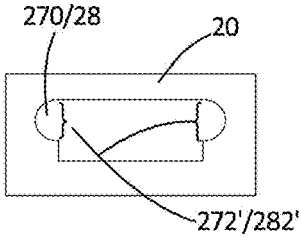
Figure 43H:
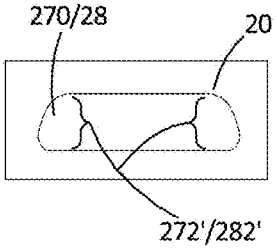
Figure 43I:
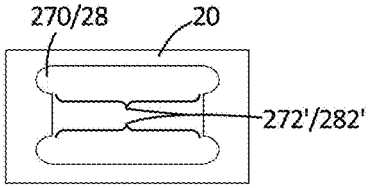
Figure 43J:
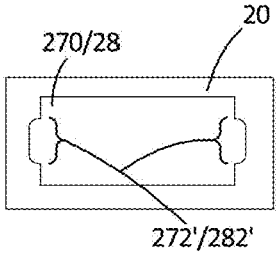

207. A plug connecting component 820, such as exemplary plug connecting component 820 shown in FIG. 41, said plug connecting component 820 comprising a plug component outer surface 824, and one or more plug component connectors 825 (typically, 1 to 5 connectors 825) extending along a plug connecting surface 826 opposite said plug component outer surface 824. As shown in FIG. 41, exemplary plug connecting component 820 has four plug component connectors 825 extending along a plug connecting surface 826.

208. A plug connector spike component 821, such as exemplary plug connector spike component 821 shown in FIG. 42A, said plug connector spike component 821 comprising (a) a plug connecting component 820 comprising (i) a plug component outer surface 824, and (ii) one or more plug component connectors 825 (typically, 1 to 5 connectors 825) extending along (iii) a plug connecting surface 826 opposite said plug component outer surface 824, and (b) a ground spike portion 85 connected to and extending from the plug component outer surface 824 of the plug connecting component 821.

209. A spike component 828, such as exemplary spike component 828 shown in FIG. 42B, comprising an exemplary ground spike portion 85 overmolded and integrally connected to one end 19 of an exemplary agility ladder ground strip 10.

In addition, it should be noted that one or more agility ladder ground strips 10/10'/10" and/or agility ladder ground strip connectors 20/20'/20" and/or agility ladder connector components 130 shown in FIGS. 18-35 could be used in combination with or in place of the above-described agility ladder ground strips 10/10', agility ladder ground strip connectors 20/20', and agility ladder connector components 130.

Figure 18:
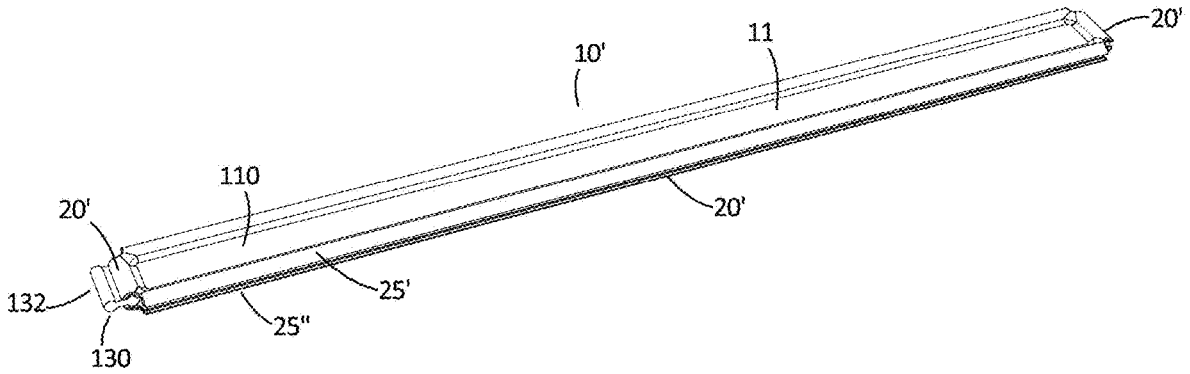
FIGS. 18-21 depict perspective views of four other possible exemplary agility ladder ground strips suitable for use in the agility ladders and agility ladder kits of the present invention.
Figure 19:
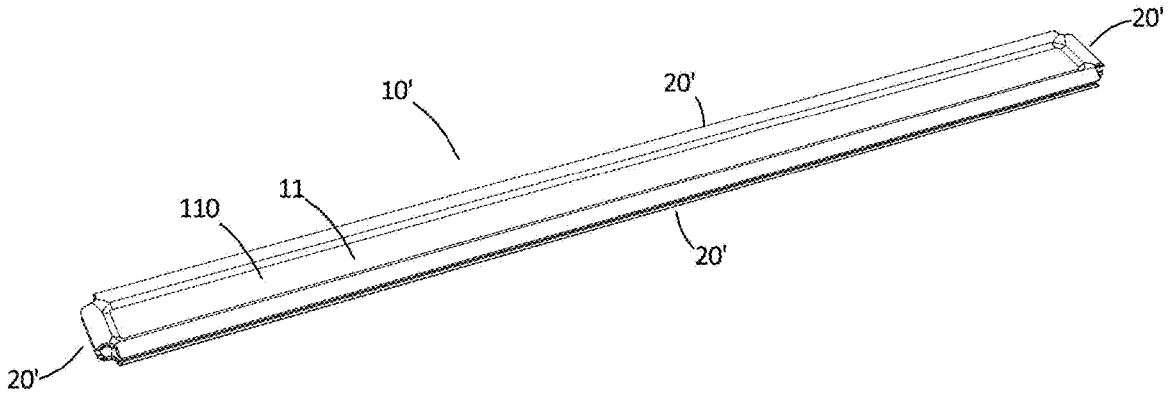
Figure 20:
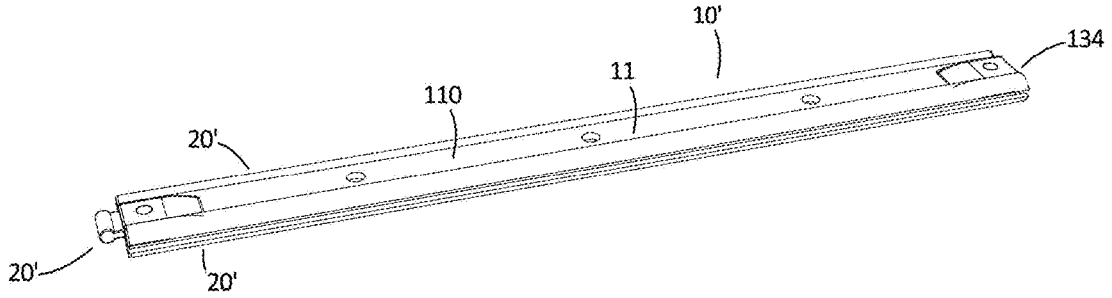

As shown in FIG. 18, an agility ladder ground strip 10' having agility ladder ground strip connectors 20' along all four edges of the agility ladder ground strip 10', and a connecting member 130 with a male connecting component 132 positioned within an end agility ladder ground strip connector 20' could be used in the agility ladders 100 and agility ladder kits 200 of the present invention.

Figure 21:
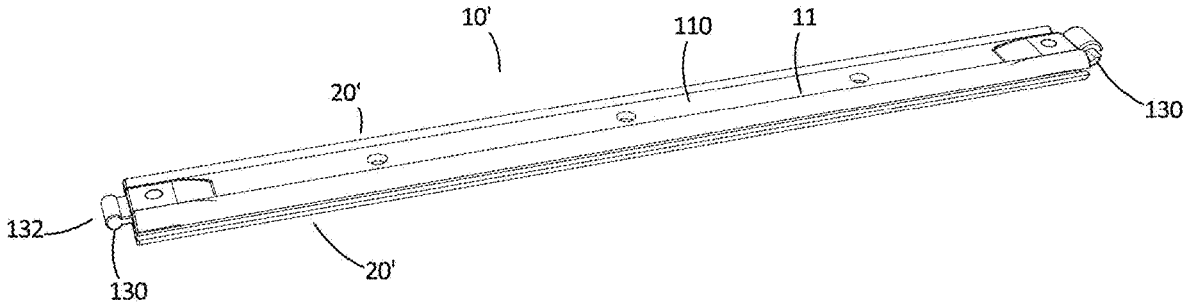
Figure 22:
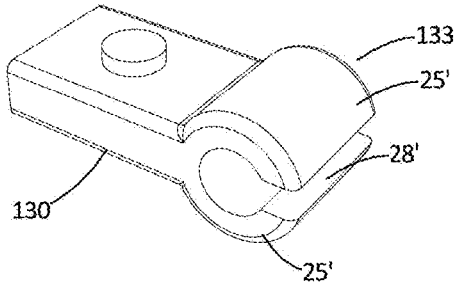
FIG. 22 depicts an exemplary connecting member having a female connecting component thereon for use in the agility ladders and agility ladder kits of the present invention.
Figure 23:
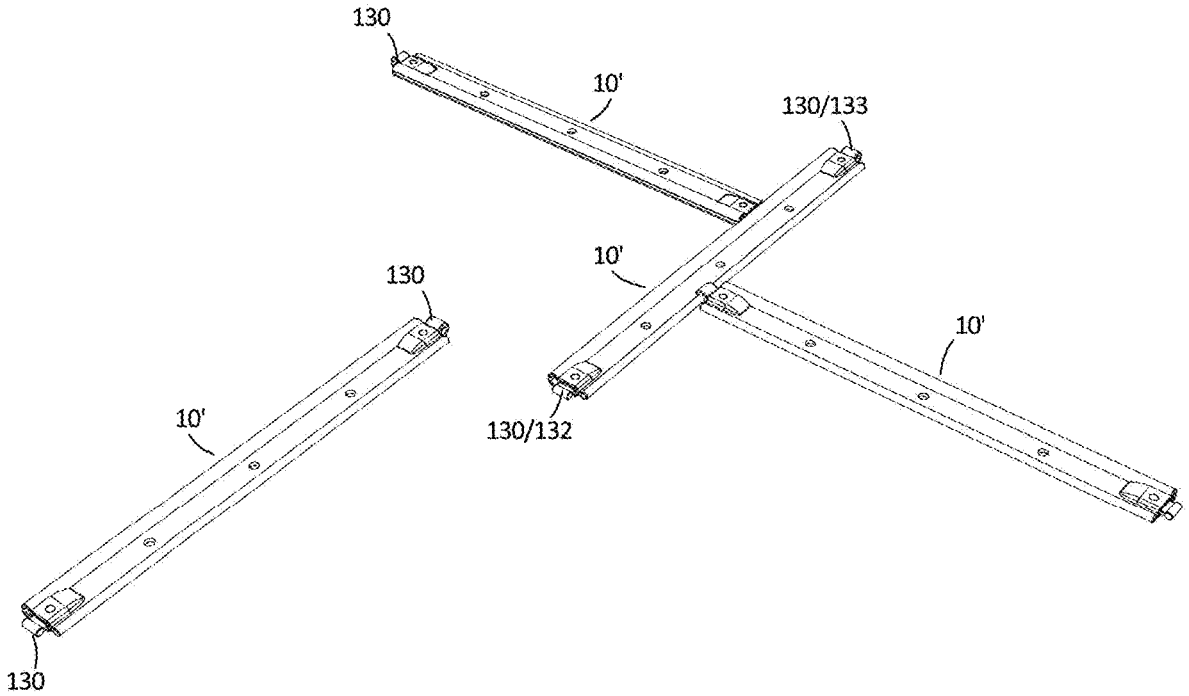
FIG. 23 depicts various exemplary agility ladder configurations using the exemplary agility ladder ground strip and components shown in FIGS. 21-22.

As shown in FIGS. 21-23, an agility ladder ground strip 10' having (i) agility ladder ground strip connectors 20' along opposite side edges 15/16 of the agility ladder ground strip 10', (ii) a connecting member 130 with a male connecting component 132 positioned within an end slot 134 of the agility ladder ground strip 10', and (iii) a connecting member 130 with a female connecting component 133 positioned within an opposite end slot 134 of the agility ladder ground strip 10' could be used in the agility ladders 100 and agility ladder kits 200 of the present invention.

Figure 24:
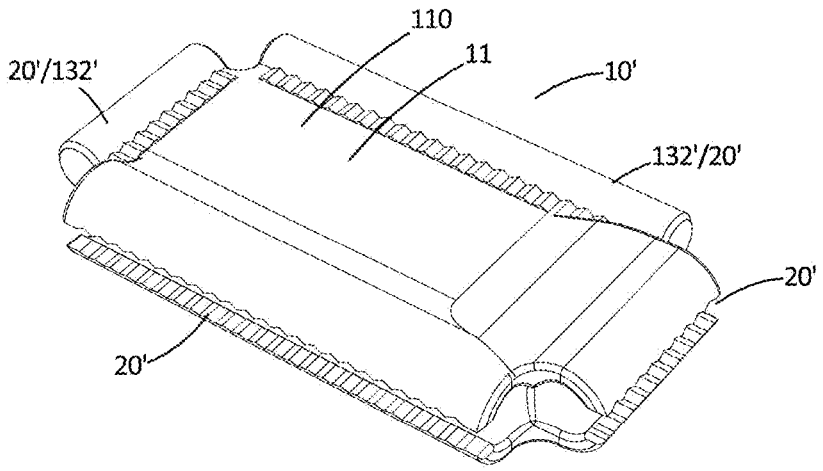
FIG. 24 is a perspective view of another exemplary agility ladder ground strip suitable for use in the agility ladders and agility ladder kits of the present invention.

As shown in FIG. 24, an agility ladder ground strip 10' having (i) an integrally attached male agility ladder ground strip connector 20'/132' along one side edge 15/16 of the agility ladder ground strip 10', (ii) an integrally attached female agility ladder ground strip connector 20'/132' along an opposite side edge 16/15 of the agility ladder ground strip 10', (iii) an integrally attached male agility ladder ground strip connector 20'/132' along one end 13/14 of the agility ladder ground strip 10', and (iv) an integrally attached female agility ladder ground strip connector 20'/132' along an opposite end 14/13 of the agility ladder ground strip 10'.

Figure 25:
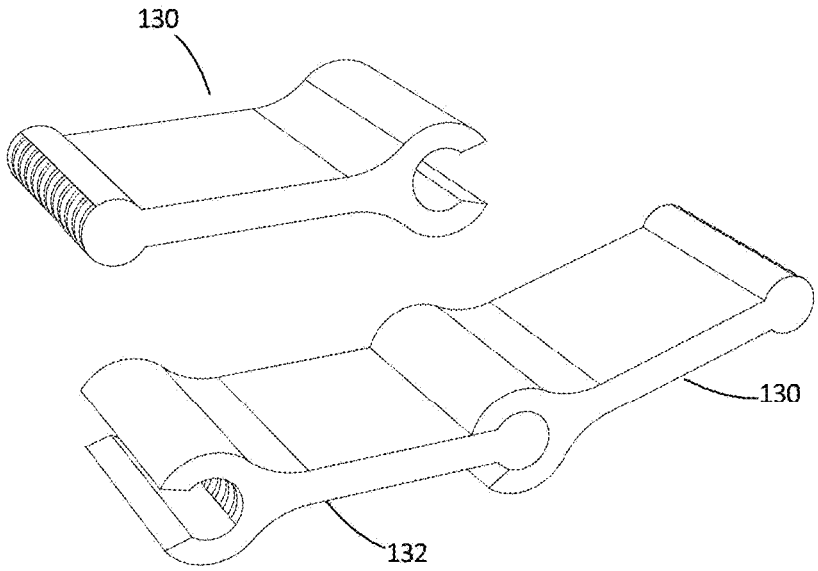
FIG. 25 depicts exemplary connecting members that can provide a hinged/jointed connector within the agility ladders and agility ladder kits of the present invention.

As shown in FIG. 25, hinged/jointed connectors 130 may also be used within the agility ladders 100 and agility ladder kits 200 of the present invention.

Figure 26:
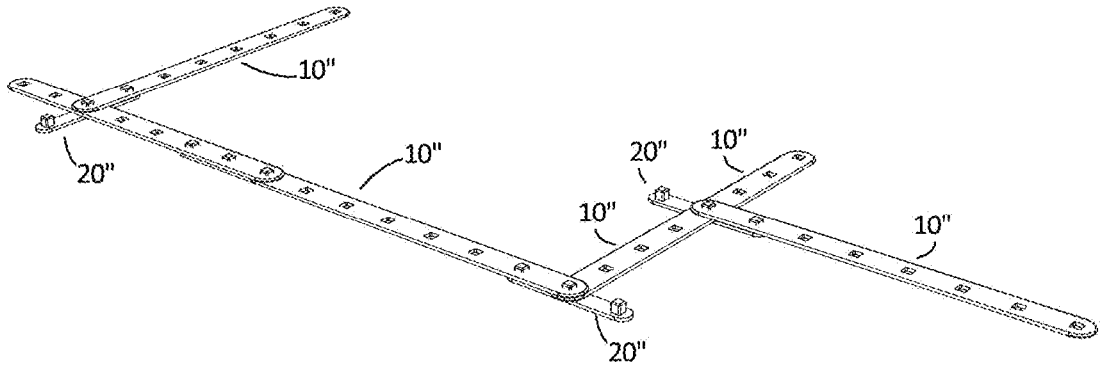
FIG. 26 depicts an exemplary agility ladder configuration using alternative exemplary agility ladder ground strips and connectors.
Figure 27:
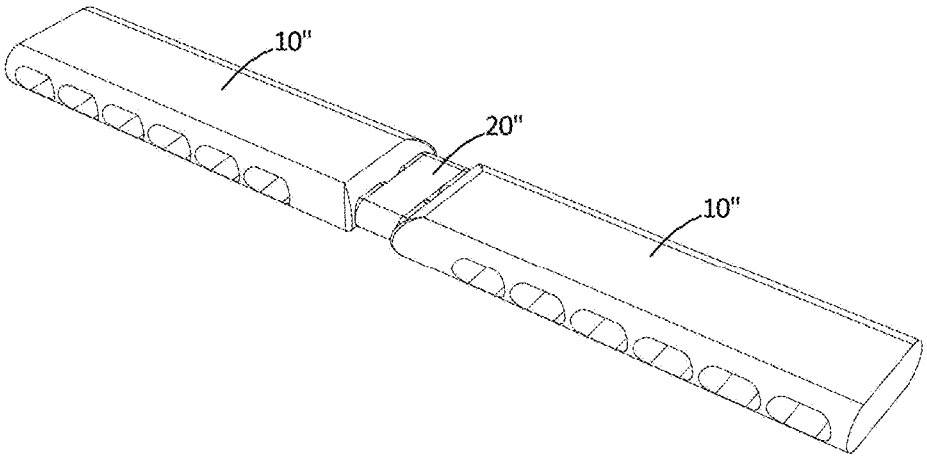
FIG. 27 is a perspective view of another exemplary agility ladder of the present invention showing two exemplary agility ladder ground strips and a single exemplary agility ladder strip connector.
Figure 28:
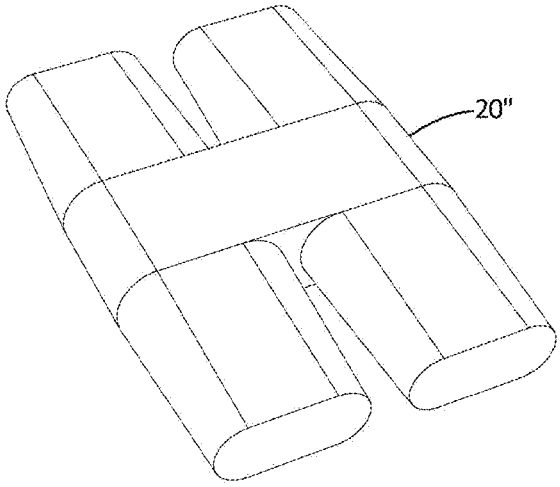
FIG. 28 is a perspective view of the exemplary agility ladder strip connector used in the exemplary agility ladder shown in FIG. 27.
Figure 29:
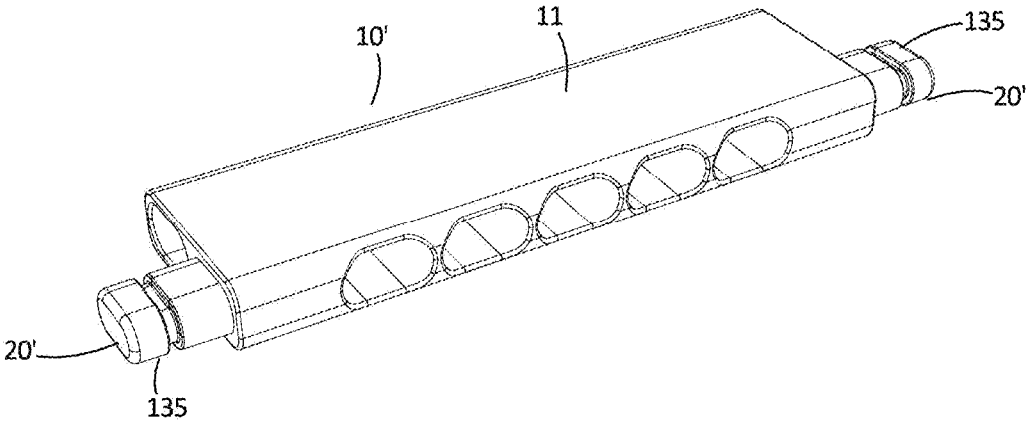
FIG. 29 is a perspective view of another exemplary agility ladder ground strip suitable for use in the agility ladders and agility ladder kits of the present invention.
Figure 30:
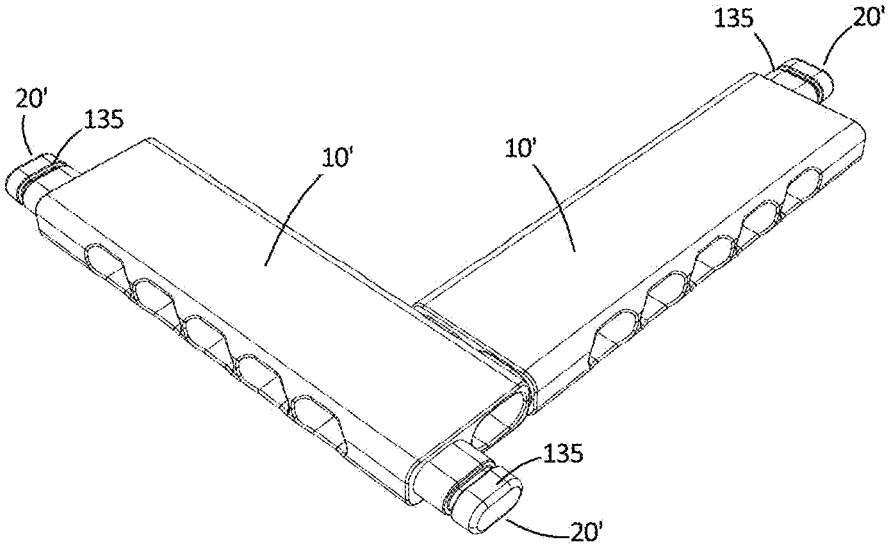
FIG. 30 is a perspective view of another exemplary agility ladder of the present invention formed by connecting two exemplary agility ladder ground strips shown in FIG. 29.
Figure 31:
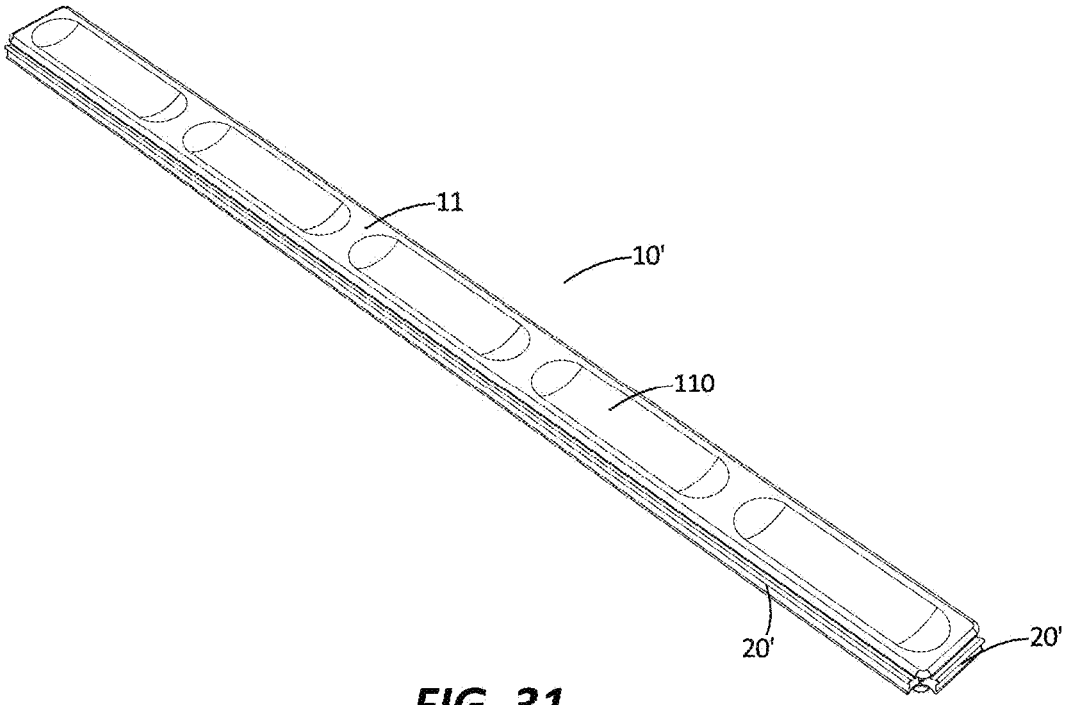
FIG. 31 is a perspective view of another exemplary agility ladder ground strip suitable for use in the agility ladders and agility ladder kits of the present invention.
Figure 32:
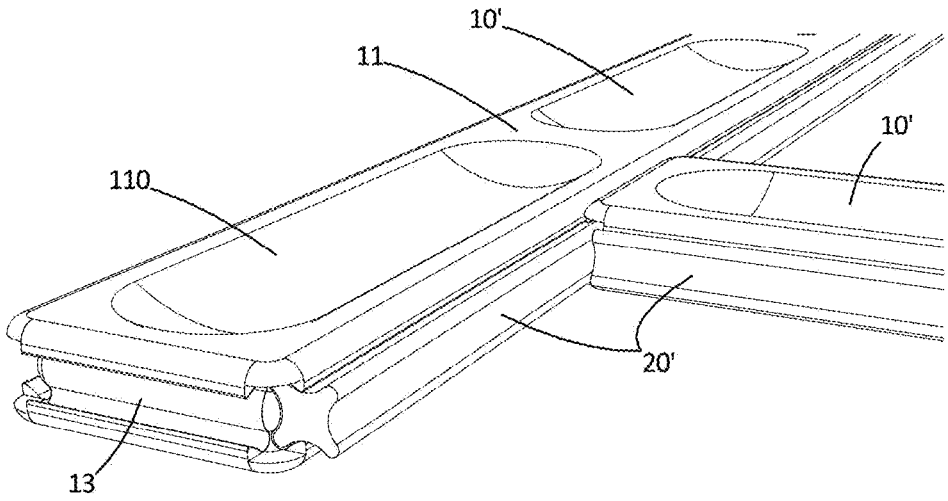
FIG. 32 is a perspective view of another exemplary agility ladder of the present invention formed by connecting two exemplary agility ladder ground strips shown in FIG. 31.
Figure 33:
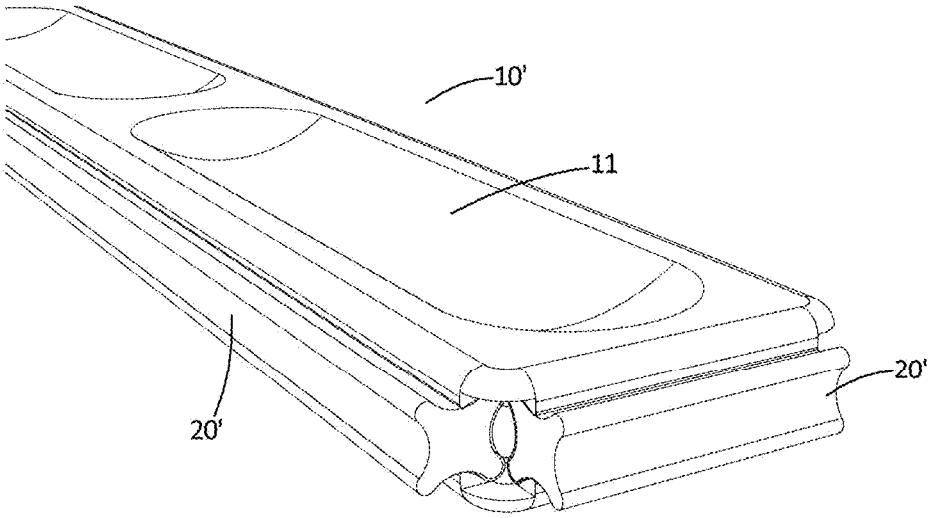
FIG. 33 is a perspective view of one end of the exemplary agility ladder ground strip shown in FIG. 31.
Figure 34:
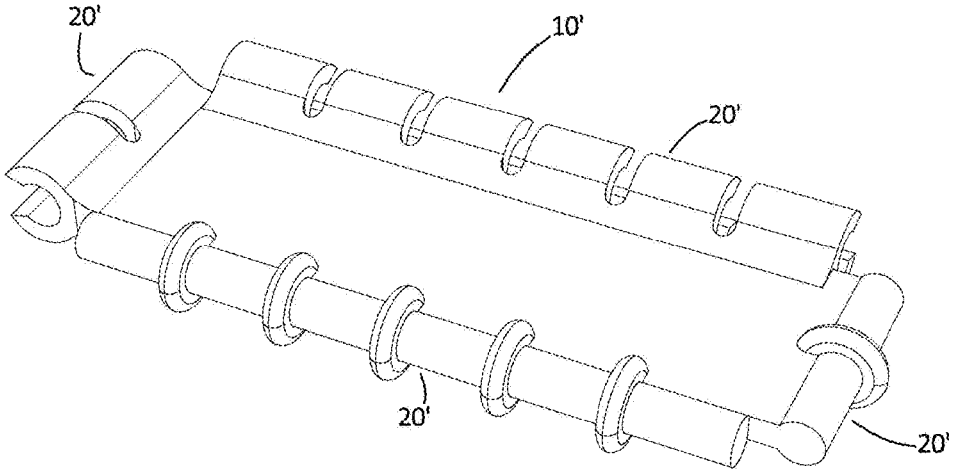
FIG. 34 is a perspective view of another exemplary agility ladder ground strip suitable for use in the agility ladders and agility ladder kits of the present invention.
Figure 35:
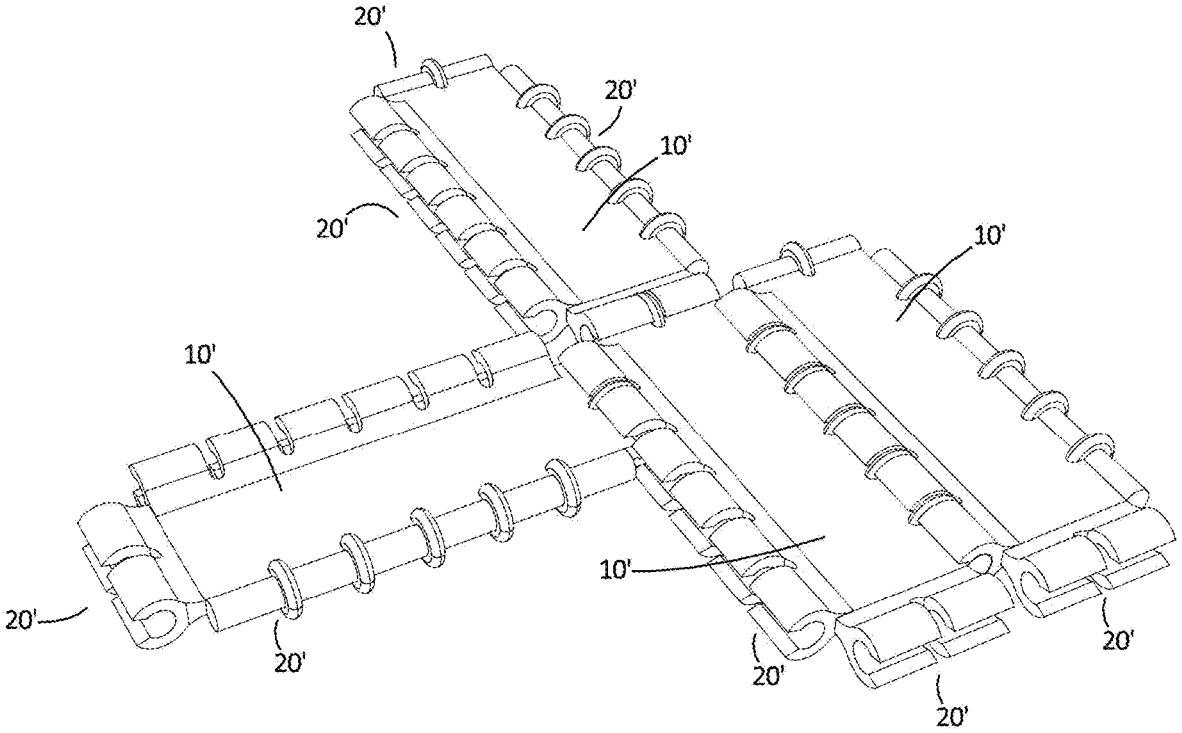
FIG. 35 is a perspective view of another exemplary agility ladder of the present invention formed by connecting four exemplary agility ladder ground strips shown in FIG. 34.
Figure 36:
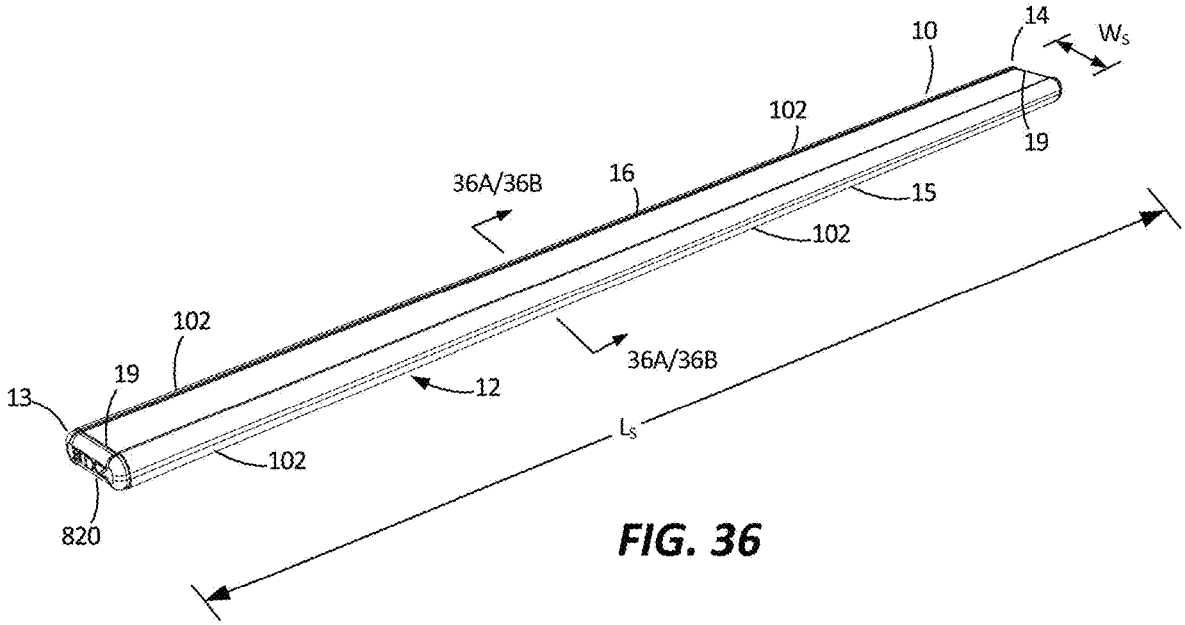
FIG. 36 is a perspective view of another exemplary agility ladder ground strip suitable for use in the agility ladders and agility ladder kits of the present invention.
Figure 36A:
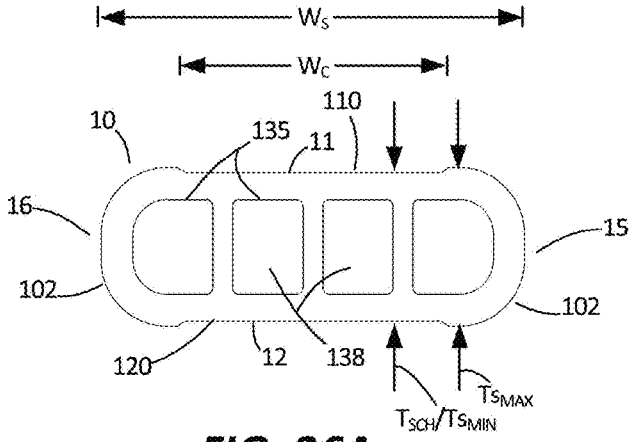
FIGS. 36A-36B depict cross-sectional views of the exemplary agility ladder strip shown in FIG. 36 as viewed along line 36A/36B-36A/36B in FIG. 36.
Figure 36B:
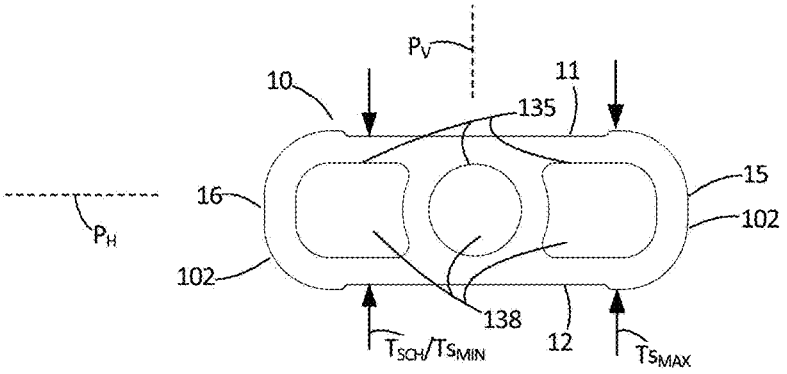
Figure 37A:
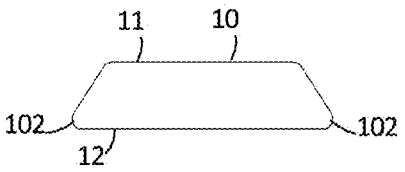
FIGS. 37A-37J depict other possible cross-sectional configurations of other possible agility ladder strips of the present invention.
Figure 37B:
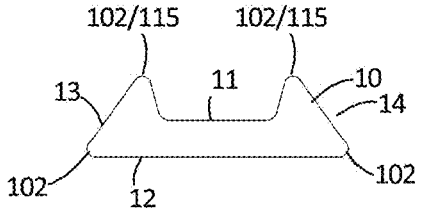
Figure 37C:
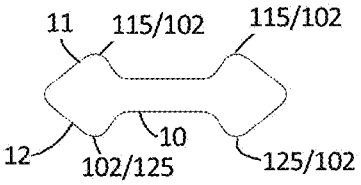
Figure 37D:
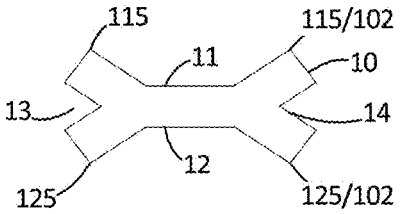
Figure 37E:
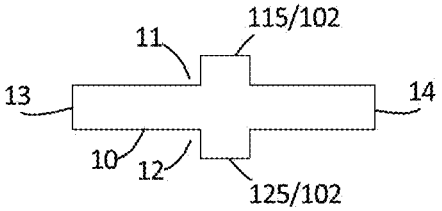
Figure 37F:
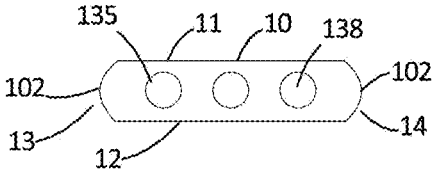
Figure 37G:
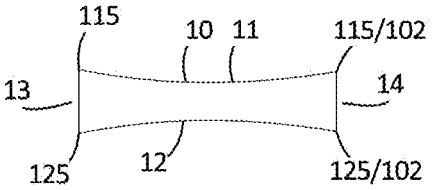
Figure 37H:
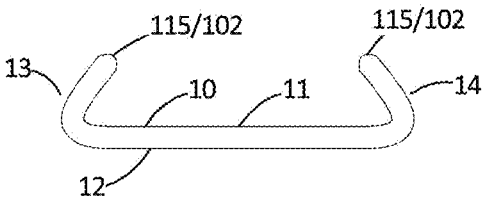
Figure 37I:
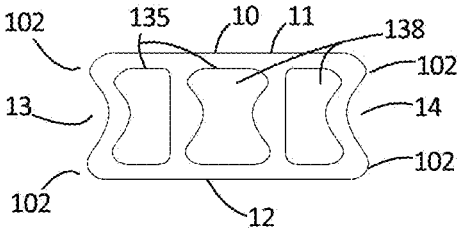
Figure 37J:
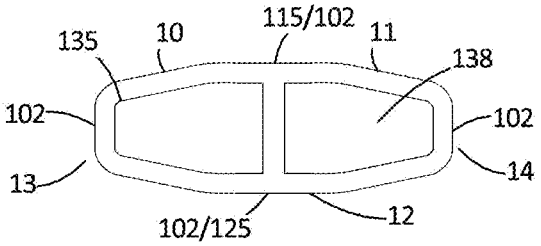
Figure 38:
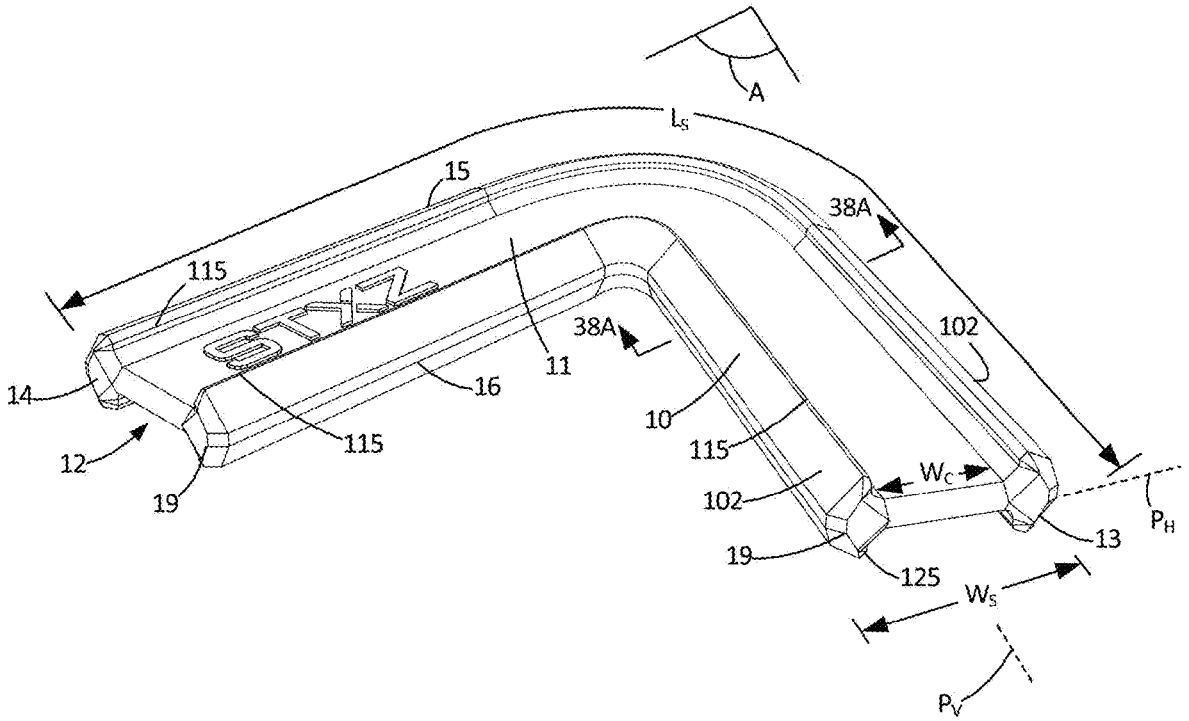
FIG. 38 is a front perspective view of another exemplary agility ladder ground strip suitable for use in the agility ladders and agility ladder kits of the present invention.
Figure 38A:
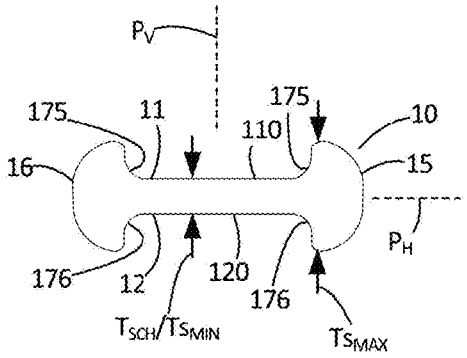
FIG. 38A is a cross-sectional view of the exemplary agility ladder strip shown in FIG. 38 as viewed along line 38A-38A in FIG. 38.

As shown in FIG. 26, alternative exemplary agility ladder ground strips 10" and connectors 20" can also be used within the agility ladders 100 and agility ladder kits 200 of the present invention. In this system, agility ladder ground strips 10" comprise multiple apertures extending from the upper surface 11 to the lower surface 12 of a given agility ladder ground strips 10", and connectors 20" comprise multiple projections that are sized to extend within one or more of the multiple apertures within of a given agility ladder ground strip 10".

In addition, any of the exemplary agility ladder ground strips 10' and agility ladder strip connectors 20' shown in FIGS. 27-35 may be incorporated into the agility ladders 100 and agility ladder kits 200 of the present invention.

Agility Ladder Kits 200

210. An agility ladder kit 200 suitable for forming an agility ladder 100, said agility ladder kit 200 comprising: (a) one or more agility ladder ground strips 10/10', and (b) one or more agility ladder strip connectors 20/20', wherein each agility ladder strip connector 20/20' is capable of connecting three or more agility ladder ground strips 10/10' to one another, wherein the one or more agility ladder ground strips 10/10' are connectable to the one or more agility ladder strip connectors 20/20' to form an agility ladder 100 configuration. See, for example, the exemplary agility ladder 100 configurations shown in FIGS. 1-6, 12A-12F, 14A-14B, and 40.

211. The agility ladder kit 200 of embodiment 210, wherein the agility ladder kit 200 comprises (a) two or more agility ladder ground strips 10/10', and (b) two or more agility ladder strip connectors 20/20'.

212. The agility ladder kit 200 of embodiment 210 or 211, wherein the agility ladder kit 200 comprises (a) from two to 500 (or more) agility ladder ground strips 10/10', and (b) from two to 1000 (or more) agility ladder strip connectors 20/20'.

213. The agility ladder kit 200 of any one of embodiments 210 to 212, wherein (i) each of the one or more agility ladder ground strips 10/10' comprises the agility ladder ground strip 10/10' of any one of embodiments 170 to 185, and (ii) each of the one or more agility ladder strip connectors 20/20' comprises the agility ladder strip connector 20/20' of any one of embodiments 186 to 196.

214. The agility ladder kit 200 of any one of embodiments 210 to 213, further comprising one or more hurdle strip components 30/30', wherein each of the one or more hurdle strip components 30/30' comprises the hurdle strip component 30/30' of any one of embodiments 197 to 198.

215. The agility ladder kit 200 of any one of embodiments 210 to 214, further comprising one or more spike components 80, wherein each of the one or more spike components 80 comprises the spike component 80 of embodiment 199.

216. The agility ladder kit 200 of any one of embodiments 210 to 215, further comprising one or more six-connector components 82, wherein each of the one or more six-connector component 82 comprises the six-connector component 82 of embodiment 200.

217. The agility ladder kit 200 of any one of embodiments 210 to 216, further comprising one or more nine-connector components 84, wherein each of the one or more nine-connector components 84 comprises the nine-connector component 84 of embodiment 210.

218. The agility ladder kit 200 of any one of embodiments 210 to 217, further comprising one or more agility ladder strip connectors 20, wherein each of the one or more agility ladder strip connectors 20 comprises the agility ladder strip connector 20 of any one of embodiments 186 to 196.

219. The agility ladder kit 200 of any one of embodiments 210 to 218, further comprising one or more agility ladder strip connectors 20, wherein each of the one or more agility ladder strip connectors 20 comprises the agility ladder strip connector 20 of embodiment 190 to 196.

Methods of Making Agility Ladders, Agility Ladder Components, and Kits

220. A method of making the agility ladder 100 of any one of embodiments 1 to 169, said method comprising: connecting one or more of the one or more agility ladder ground strips 10/10' to one or more of the one or more agility ladder strip connectors 20/20'.

221. The method of embodiment 194, further comprising: forming the one or more the agility ladder ground strips 10/10'; and forming the one or more agility ladder strip connectors 20/20'.

222. A method of making the agility ladder ground strip 10/10' of any one of embodiments 170 to 185, said method comprising: forming the agility ladder ground strip 10/10'.

223. A method of making the agility ladder strip connector 20/20' of any one of embodiments 186 to 196, said method comprising: forming the agility ladder strip connector 20/20'.

224. A method of making the hurdle strip component 30/30' of any one of embodiments 197 to 198, said method comprising: forming the hurdle strip component 30/30'.

225. A method of making the spike component 80 of embodiment 199, or the six-connector component 82 of embodiment 200, or the nine-connector component 84 of embodiment 201, or the agility ladder strip connector 20 of any one of embodiments 202 to 206, or a plug connecting component 820 of embodiment 207, or a plug connector spike component 821 of embodiment 208, or a spike component 828 of embodiment 209, said method comprising: forming the spike component 80, or the six-connector component 82, or the nine-connector component 84, or the agility ladder strip connector 20, or the plug connecting component 820, or the plug connector spike component 821, or the spike component 828.

226. The method of any one of embodiments 220 to 225, wherein each forming step independently comprises one or more of: (i) a molding step, (ii) a thermoforming step, (iii) a cutting step, (iv) a machining step, (v) a drilling step, (vi) an extrusion step, (vii) a bonding step, (viii) a heating step, (ix) a cooling step, (x) a molding step, or (xi) any combination thereof.

Methods of Using Agility Ladders, Agility Ladder Components, and Kits

227. A method of using the agility ladder ground strip 10/10' of any one of embodiments 170 to 185, and/or the agility ladder strip connector 20/20' of any one of embodiments 186 to 196, and/or the hurdle strip component 30/30' of any one of embodiments 197 to 198, and/or the spike component 80 of embodiment 199, and/or the six-connector component 82 of embodiment 200, and/or the nine-connector component 84 of embodiment 201, or the agility ladder strip connector 20 of any one of embodiments 202 to 206, or the plug connecting component 820 of embodiment 207, or the plug connector spike component 821 of embodiment 208, or the spike component 828 of embodiment 209, said method comprising: forming an agility ladder 100 with at least (i) the agility ladder ground strip 10/10', and (ii) the agility ladder strip connector 20/20'.

228. The method of embodiment 227, said method comprising: forming an agility ladder 100 with one or more of: (iii) one or more hurdle strip components 30/30', (iv) one or more spike components 80, (v) one or more six-connector components 82, (vi) one or more nine-connector components 84, (vii) one or more agility ladder strip connector 20 of any one of embodiments 202 to 206, (viii) one or more plug connecting component 820, (ix) one or more plug connector spike components 821, and (x) one or more spike components 828.

229. The method of embodiment 227 or 228, wherein the agility ladder comprises the agility ladder 100 of any one of embodiments 1 to 169.

230. The method of any one of embodiments 227 to 229, said method comprising: performing one or more agility exercises using the agility ladder 100.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of Agility Ladder Components

Exemplary agility ladder components, and agility ladder kit components having one of more features (i) as shown in FIGS. 1-43J and/or (ii) as described in embodiments 1 to 219 above were prepared using conventional steps (e.g., one or more thermoforming steps, one or more machining steps, one or more 3D printing steps, one or more connection/assembly steps, one or more cutting steps, etc.).

EXAMPLE 2

Use of Agility Ladder Components

The agility ladder components, and agility ladder kit components formed in Example 1 were used to form agility ladders having one of more features (i) as shown in FIGS. 1-43J and/or (ii) as described in embodiments 1 to 219. The resulting agility ladders were used in various agility exercises.

It should be understood that although the above-described agility ladders, agility ladder components, agility ladder kits, and/or methods are described as "comprising" one or more components or steps, the above-described agility ladders, agility ladder components, agility ladder kits, and/or methods may "comprise," "consists of," or "consist essentially of" any of the above-described components, features, or steps of the agility ladders, agility ladder components, and agility ladder kits, and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains," "containing," "characterized by" or any other variation thereof, are intended to encompass a non-exclusive inclusion, subject to any limitation explicitly indicated otherwise, of the recited components. For example, an agility ladder, agility ladder component, agility ladder kit, and/or method that "comprises" a list of elements (e.g., components, features, or steps) is not necessarily limited to only those elements (or components or steps), but may include other elements (or components or steps) not expressly listed or inherent to the agility ladder, agility ladder component, agility ladder kit, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define an agility ladder, agility ladder component, agility ladder kit, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of."

Further, it should be understood that the herein-described agility ladders, agility ladder components, agility ladder kits, and/or methods may comprise, consist essentially of, or consist of any of the herein-described components and features, as shown in the figures with or without any feature(s) not shown in the figures. In other words, in some embodiments, the agility ladders, agility ladder components, agility ladder kits, and/or methods of the present invention do not have any additional features other than those shown in the figures, and such additional features, not shown in the figures, are specifically excluded from the agility ladders, agility ladder components, agility ladder kits, and/or methods. In other embodiments, the agility ladders, agility ladder components, agility ladder kits, and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An agility ladder kit suitable for forming an agility ladder, said agility ladder kit comprising:

one or more agility ladder ground strips, and one or more agility ladder strip connectors, wherein:

(1) each of the one or more agility ladder ground strips comprises: an upper strip major surface, a lower strip major surface opposite the upper strip major surface, a first strip end, a second strip end opposite the first strip end, the first strip end and the second strip end being separated by a strip length Ls, opposite strip side edges separated by a strip width Ws, and from two to four length-extending strip channels extending (a) from the first strip end to the second strip end, and (b) between (i) the upper strip major surface, and the lower strip major surface, and (ii) the opposite strip side edges, (2) each of the one or more agility ladder strip connectors (a) is capable of connecting directly to three or more of the one or more agility ladder ground strips, and (b) comprises: (i) an upper connector major surface, (ii) a lower connector major surface opposite the upper connector major surface, (iii) a first connector end, (iv) a second connector end opposite the first connector end, the first connector end and the second connector end being separated by a connector length Lc, (v) a first connector side edge extending between the first connector end and the second connector end, (vi) a second connector side edge opposite the first connector side edge, and being separated from the first connector side edge by a connector width Wc, (vii) at least one strip receiving opening within each of the first connector end and the second connector end with each of the at least one strip receiving opening (a) sized to receive the first strip end or the second strip end of one agility ladder ground strip of the one or more agility ladder ground strips, and (b) having a strip receiving opening width greater than the strip width Ws, and wherein at least one strip receiving opening at the first connector end connects with a corresponding strip receiving opening at the second connector end to form a length-extending connector channel extending from the first connector end to the second connector end, and (viii) at least one connector channel extending from the first connector side edge to the second connector side edge with each of the at least one connector channel sized so that each agility ladder ground strip of the one or more agility ladder ground strips is capable of extending through the at least one connector channel, and (3) the one or more agility ladder ground strips are connectable to the one or more agility ladder strip connectors so as to form an agility ladder configuration.

2. The agility ladder kit of claim 1, wherein the opposite strip side edges have a straight, parallel configuration such that the strip width Ws is substantially constant or constant along at least a portion of the strip length Ls.

3. The agility ladder kit of claim 2, wherein the opposite strip side edges have some amount of curvature therein.

4. The agility ladder kit of claim 3, wherein each of the one or more agility ladder ground strips has a maximum strip thickness $Ts_{MAX}$ along the opposite strip side edges, and a channel strip thickness $Ts_{CH}$ along an upper surface channel extending between the opposite side edges along at least a portion of the strip length Ls, and wherein the upper surface channel has a surface channel width Wc that remains constant along at least a portion of the strip length Ls.

5. The agility ladder kit of claim 1, wherein each of the one or more agility ladder ground strips independently has a strip length Ls of from 5.0 in (12.70 cm) to 28.0 in (71.12 cm), a strip width Ws of from 0.8 in (2.03 cm) to 3.0 in (7.62 cm), and a strip thickness Ts of from 0.062 in (0.16 cm) to 1.00 in (2.54 cm).

6. The agility ladder kit of claim 5, wherein each of the one or more agility ladder ground strips independently has a strip length Ls of from 17.0 in (43.18 cm) to 20.0 in (50.80 cm), a strip width Ws of from 1.0 in (2.54 cm) to 1.5 in (3.81 cm), and a strip thickness Ts of from 0.125 in (0.32 cm) to 0.80 in (2.03 cm).

7. The agility ladder kit of claim 1, wherein each of the one or more agility ladder ground strips independently comprises a polymeric material or a filler- or fiber-reinforced polymeric material, and each of the one or more agility ladder strip connectors independently comprises an elastomeric material.

8. The agility ladder kit of claim 7, wherein each of the one or more agility ladder ground strips independently comprises a polypropylene or a glass-filled polypropylene, a polyvinyl chloride (PVC) or a glass-filled polyvinyl chloride (PVC), and each of the one or more agility ladder strip connectors independently comprises a rubber.

9. The agility ladder kit of any claim 1, wherein the one or more agility ladder ground strips comprises from 6 to 500 agility ladder ground strips, and the one or more agility ladder strip connectors comprises from 2 to 1000 agility ladder strip connectors.

10. The agility ladder kit of claim 1, wherein at least one agility ladder ground strip of the one or more agility ladder ground strips has a curved configuration such that the first strip end and the second strip end of the at least one agility ladder ground strip are oriented at an angle A to one another, wherein angle A is less than 180°.

11. The agility ladder kit of claim 1, wherein each of the one or more agility ladder ground strips independently comprises three or four length-extending strip channels extending from the first strip end to the second strip end.

12. The agility ladder kit of claim 1, wherein each of the one or more agility ladder strip connectors has a connector length $L_C$ of from 2.5 in (6.35 cm) to 6.0 in (15.24 cm), a connector width Wc of from 1.0 in (2.54 cm) to 3.5 in (8.89 cm), and a connector thickness Tc of from 0.50 in (1.27 cm) to 3.0 in (7.62 cm).

13. The agility ladder kit of claim 1, wherein each length-extending connector channel comprises opposing channel side edge portions that extend along a complete length of the length-extending connector channel between the first connector end and the second connector end except along an intersection of the length-extending connector channel with the at least one connector channel extending from the first connector side edge to the second connector side edge.

14. An agility ladder kit suitable for forming an agility ladder, said agility ladder kit comprising:

(a) one or more agility ladder ground strips, wherein each of the one or more agility ladder ground strips comprises an upper strip major surface, a lower strip major surface opposite the upper strip major surface, a first strip end, a second strip end opposite the first strip end, the first strip end and the second strip end being separated by a strip length Ls, and opposite strip side edges separated by a strip width Ws; and (b) one or more agility ladder strip connectors, each of said agility ladder strip connectors comprises: (i) an upper connector major surface, (ii) a lower connector major surface opposite the upper connector major surface, (iii) a first connector end, a second connector end opposite the first connector end, the first connector end and the second connector end being separated by a connector length Lc, (iv) a first connector side edge extending between the first connector end and the second connector end, (v) a second connector side edge opposite the first connector side edge, and being separated from the first connector side edge by a connector width Wc, (vi) at least one strip receiving opening within each of the first connector end and the second connector end with each of the at least one strip receiving opening (a) sized to receive the first strip end or the second strip end of one agility ladder ground strip of the one or more agility ladder ground strips, and (b) having a strip receiving opening width greater than the strip width Ws, and wherein (1) at least one strip receiving opening at the first connector end connects with a corresponding strip receiving opening at the second connector end to form a length-extending connector channel extending from the first connector end to the second connector end, and (2) each length-extending connector channel comprises opposing channel side edge portions that extend along a complete length of the length-extending connector channel between the first connector end and the second connector end except along an intersection of the length-extending connector channel with a connector channel extending from the first connector side edge to the second connector side edge, and (vii) at least one connector channel extending from the first connector side edge to the second connector side edge with each of the at least one connector channel sized so that one agility ladder ground strip of the one or more agility ladder ground strips is capable of extending through the at least one connector channel.

15. The agility ladder kit of claim 14, wherein each of the one or more agility ladder ground strips independently comprises a polypropylene or a glass-filled polypropylene, a polyvinyl chloride (PVC) or a glass-filled polyvinyl chloride (PVC), and each of the one or more agility ladder strip connectors independently comprises a rubber.

16. The agility ladder kit of claim 15, wherein each of the one or more agility ladder strip connectors comprises (i) a connector ground-contacting surface comprising rubber, or (ii) rubber in its entirety.

17. The agility ladder kit of claim 14, wherein each length-extending connector channel comprises opposing channel side edge portions that extend along from about 50.0% to 90% of the complete length of the length-extending connector channel between the first connector end and the second connector end.

18. The agility ladder kit of claim 14, wherein each of the one or more agility ladder ground strips independently comprises from two to four length-extending strip channels extending (a) from the first strip end to the second strip end, and (b) between (i) the upper strip major surface, and the lower strip major surface, and (ii) the opposite strip side edges.

19. The agility ladder kit of claim 14, wherein each of the one or more agility ladder strip connectors has a connector length $L_C$ of from 2.5 in (6.35 cm) to 6.0 in (15.24 cm), a connector width Wc of from 1.0 in (2.54 cm) to 3.5 in (8.89 cm), and a connector thickness Tc of from 0.50 in (1.27 cm) to 3.0 in (7.62 cm).

20. An agility ladder kit suitable for forming an agility ladder, said agility ladder kit comprising:

(a) one or more agility ladder ground strips, wherein each of the one or more agility ladder ground strips comprises an upper strip major surface, a lower strip major surface opposite the upper strip major surface, a first strip end, a second strip end opposite the first strip end, the first strip end and the second strip end being separated by a strip length Ls, and opposite strip side edges separated by a strip width Ws, and wherein (1) each of the opposite strip side edges comprises opposite strip side edge features (a) that extend along at least a portion of the strip length Ls, and (b) have some amount of curvature therein, and (2) each of the one or more agility ladder ground strips independently comprises from two to four length-extending strip channels extending (a) from the first strip end to the second strip end, and (b) between (i) the upper strip major surface, and the lower strip major surface, and (ii) the opposite strip side edges; and (b) one or more agility ladder strip connectors, each of said agility ladder strip connectors comprises: (i) an upper connector major surface, (ii) a lower connector major surface opposite the upper connector major surface, (iii) a first connector end, a second connector end opposite the first connector end, the first connector end and the second connector end being separated by a connector length Lc, (iv) a first connector side edge extending between the first connector end and the second connector end, (v) a second connector side edge opposite the first connector side edge, and being separated from the first connector side edge by a connector width Wc, (vi) at least one strip receiving opening within each of the first connector end and the second connector end with each of the at least one strip receiving opening (a) sized to receive the first strip end or the second strip end of one agility ladder ground strip of the one or more agility ladder ground strips, and (b) having a strip receiving opening width greater than the strip width Ws, and (vii) at least one connector channel extending from the first connector side edge to the second connector side edge with each of the at least one connector channel (a) being sized so that each agility ladder ground strip of the one or more agility ladder ground strips is capable of extending through the at least one connector channel, and (b) comprising opposing channel side edge portions that extend along from about 50.0% to 90% of the connector width Wc between the first connector side edge to the second connector side edge.

21. The agility ladder kit of claim 20, wherein each of the one or more agility ladder ground strips independently comprises a polypropylene or a glass-filled polypropylene, a polyvinyl chloride (PVC) or a glass-filled polyvinyl chloride (PVC), and each of the one or more agility ladder strip connectors independently comprises a rubber.

22. The agility ladder kit of claim 20, wherein each of the one or more agility ladder ground strips independently comprises three length-extending strip channels extending (a) from the first strip end to the second strip end, and (b) between (i) the upper strip major surface, and the lower strip major surface, and (ii) the opposite strip side edges, and (c) with a centrally-located circular length-extending strip channel, and length-extending strip channels on opposite sides of the centrally-located circular length-extending strip channel.

23. The agility ladder kit of claim 20, wherein each of the one or more agility ladder strip connectors has a connector length $L_C$ of from 2.5 in (6.35 cm) to 6.0 in (15.24 cm), a connector width Wc of from 1.0 in (2.54 cm) to 3.5 in (8.89 cm), and a connector thickness Tc of from 0.50 in (1.27 cm) to 3.0 in (7.62 cm).

* * * * *